US012054888B2

(12) United States Patent
Bailey et al.

(10) Patent No.: US 12,054,888 B2
(45) Date of Patent: Aug. 6, 2024

(54) FIBROUS STRUCTURES AND METHODS FOR MAKING SAME

(71) Applicant: The Procter & Gamble Company, Cincinnati, OH (US)

(72) Inventors: William Ellis Bailey, Unioin Township, OH (US); Ward William Ostendorf, West Chester, OH (US); Anthony Paul Bankemper, Green Township, OH (US); Douglas Jay Barkey, Salem Township, OH (US); J. Michael Bills, Mason, OH (US); Paul Dennis Trokhan, Hamilton, OH (US); Jeffrey Glen Sheehan, Symmes Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 20 days.

(21) Appl. No.: 17/238,493

(22) Filed: Apr. 23, 2021

(65) Prior Publication Data

US 2021/0332531 A1 Oct. 28, 2021

Related U.S. Application Data

(60) Provisional application No. 63/014,219, filed on Apr. 23, 2020.

(51) Int. Cl.

| | |
|---|---|
| ***D21H 27/02*** | (2006.01) |
| ***A47K 10/16*** | (2006.01) |
| ***D21F 5/18*** | (2006.01) |
| ***D21H 11/12*** | (2006.01) |
| ***D21H 27/00*** | (2006.01) |
| ***D21H 27/40*** | (2006.01) |

(52) U.S. Cl.

CPC ..... *D21H 27/02* (2013.01); *A47K 10/16* (2013.01); *D21F 5/182* (2013.01); *D21H 11/12* (2013.01); *D21H 27/002* (2013.01); *D21H 27/40* (2013.01)

(58) Field of Classification Search

CPC ..... D21H 27/02; D21H 11/12; D21H 27/002; D21H 27/40; D21H 27/30; A47K 10/16; D21F 5/182; D21F 11/006; D21F 11/14

See application file for complete search history.

(56) References Cited

U.S. PATENT DOCUMENTS

| | | | |
|---|---|---|---|
| 2005/0238700 | A1 | 10/2005 | Kleinwaechter et al. |
| 2015/0056148 | A1 | 2/2015 | Luu et al. |
| 2017/0022670 | A1 * | 1/2017 | Bailey ..... D21H 27/005 |

OTHER PUBLICATIONS

All Office Actions; U.S. Appl. No. 17/238,527.
All Office Actions; U.S. Appl. No. 17/238,562.
Unpublished U.S. Appl. No. 17/238,527, filed Apr. 23, 2021, to William Ellis Bailey et al.
Unpublished U.S. Appl. No. 17/238,562, filed Apr. 23, 2021, to William Ellis Bailey et al.

* cited by examiner

*Primary Examiner* — Jacob T Minskey
*Assistant Examiner* — Matthew M Eslami
(74) *Attorney, Agent, or Firm* — James E. Oehlenschlager

(57) ABSTRACT

Fibrous structures having a surface pattern of a continuous knuckle region and a plurality of discrete pillow regions such that the fibrous structures exhibit improved softness compared to known fibrous structures and better sheet control during the making of such fibrous structures are provided.

19 Claims, 32 Drawing Sheets

FIBROUS STRUCTURES AND METHODS FOR MAKING SAME

FIELD OF THE INVENTION

The present invention relates to fibrous structures, more particularly to fibrous structures having a surface comprising a novel surface pattern comprising a continuous knuckle region and a plurality of discrete pillow regions such that the fibrous structures and/or sanitary tissue products comprising such fibrous structures, for example bath tissue products, exhibit improved softness compared to known fibrous structures and/or sanitary tissue products comprising such known fibrous structures, and better sheet control during the making of such fibrous structures, methods for making same, and molding members, for example patterned molding members, such as patterned resin-containing belts, used in such methods.

BACKGROUND OF THE INVENTION

Certain consumers of fibrous structures, for example sanitary tissue products, such as bath tissue products, continue to desire improved softness from their fibrous structures. Previous attempts to deliver softness from fibrous structures, for example sanitary tissue products, such as bath tissue products, have employed fibrous structures that have a surface comprising a surface pattern comprising a continuous pillow and discrete knuckles. Examples of such prior art fibrous structures are shown in Prior Art FIGS. 1A-9C.

As shown in Prior Art FIG. 1A, one prior art fibrous structure 10, which was "fabric side out" ("FSO"), comprised a surface pattern comprising a continuous pillow region 12, which since it was a FSO prior art fibrous structure meant that the continuous pillow region 12 created the consumer-contacting surface during use, and discrete knuckle regions 14 oriented at a 45° angle relative to the cross machine direction ("CD") of the prior art fibrous structure 10. The prior art fibrous structure 10 of Prior Art FIG. 1A was created by a molding member 16, for example a through-air-drying belt, as shown in Prior Art FIG. 1B. The molding member 16 of Prior Art FIG. 1B comprises a plurality of discrete knuckles 18 formed by line segments of resin 20 arranged in a non-random, repeating pattern, such as a woven pattern, for example a herringbone pattern. The plurality of discrete knuckles 18 are dispersed within a continuous pillow network 22, which constitutes a deflection conduit into which portions of a prior art fibrous structure ply being made on the molding member 16 deflect. The discrete knuckles 18 are represented by the white regions, and the continuous pillow network 22, which is represented by the black region between the discrete knuckles 18. The resulting prior art fibrous structure 10 of Prior Art FIG. 1A exhibited poor "sheet control" during making of the prior art fibrous structure 10 and also resulted in the formation of nubs 24. The nubs 24 protruded outwardly from the surface 26 of the prior art fibrous structure 10 as shown in Prior Art FIG. 1A. Consumers of such prior art fibrous structure 10 experienced softness negatives during wiping as a result of the presence of the nubs 24. In addition to the softness negatives associated with such prior art fibrous structure 10, as mentioned above, the prior art fibrous structure 10 suffered from poor "sheet control" during making of the prior art fibrous structure 10 due to necking (narrowing and/or reduction of the sheet width of the prior art fibrous structure 10) of the prior art fibrous structure 10 during papermaking.

As shown in Prior Art FIG. 1A, the prior art fibrous structure 10, for example a sanitary tissue product, such as a bath tissue product, comprises a continuous pillow region 12, which is represented by the white continuous network, imparted by the continuous pillow network 22, which is represented by the black region between the discrete knuckles 18, of the molding member 16 of Prior Art FIG. 1B. The prior art fibrous structure 10 further comprises a plurality of discrete knuckle regions 14, which are represented by the black (darker) regions in Prior Art FIG. 1A, imparted by the discrete knuckles 18, which are represented by the white regions, of the molding member 16 of Prior Art FIG. 1B. The continuous pillow region 12 and discrete knuckle regions 14 of Prior Art FIG. 1A may exhibit different densities, for example, one or more of the discrete knuckle regions 14 may exhibit a density that is greater than the density of the continuous pillow region 12.

In an attempt to overcome the negatives associated with the prior art fibrous structure of Prior Art FIG. 1A, formulators made fibrous structures on a molding member 16 as shown in Prior Art FIGS. 2B and 2C. Prior Art FIG. 2A shows the resulting prior art fibrous structure 10 made on molding member 16 of Prior Art FIGS. 2B and 2C, which is similar to the prior art fibrous structure 10 shown in Prior Art FIG. 1A. The prior art fibrous structure 10, for example a sanitary tissue product, such as a bath tissue product, of Prior Art FIG. 2A, which was FSO, comprises a surface pattern on its surface 26 comprising a continuous pillow region 12, which is represented by the black (darker) continuous network, imparted by the continuous pillow network 22, which is represented by the black region between the discrete knuckles 18, which are oriented at an angle of 75° relative to the CD, of the molding member 16 of Prior Art FIGS. 2B and 2C. As shown in Prior Art FIG. 2C, in one example, the molding member 16 comprises a reinforcing element 28 upon which line segments of resin 20 are arranged in a non-random, repeating pattern, such as a woven pattern, for example a herringbone pattern. The plurality of discrete knuckles 18 are dispersed within a continuous pillow network 22, which constitutes a deflection conduit 30 into which portions of a prior art fibrous structure ply being made on the molding member 16 deflect. The reinforcing element 28 may be a desirable (but not necessary) element in some examples of the molding member 16, serving primarily to provide or facilitate integrity, stability, and durability of the molding member 16 comprising, for example, a resinous material. The reinforcing element 28 may be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof. The molding member 10 of Prior Art FIG. 1B may be similar to the molding member 10 as shown in Prior Art FIGS. 2B and 2C. The prior art fibrous structure 10 further comprises a plurality of discrete knuckle regions 14, which are represented by the white regions in Prior Art FIG. 2A, imparted by the discrete knuckles 18, which are represented by the white regions, of the molding member 16 of Prior Art FIG. 2B. Unlike Prior Art FIG. 1A, the discrete knuckles 18 of Prior Art FIG. 2B were oriented at a 75° angle relative to the cross machine direction ("CD") of the prior art fibrous structure 10.

The continuous pillow region 12 and discrete knuckle regions 14 of Prior Art FIG. 2A may exhibit different densities, for example, one or more of the discrete knuckle regions 14 may exhibit a density that is greater than the density of the continuous pillow region 12. Like the prior art fibrous structure 10 of Prior Art FIG. 1A, the prior art fibrous structure 10 of Prior Art FIG. 2A comprises nubs 24 that create similar negatives as discussed above with respect to the prior art fibrous structure 10 of Prior Art FIG. 1A. In particular, the prior art fibrous structure 10 of Prior Art FIG. 2A exhibited better "sheet control" and/or less necking (more sheet width stability) of the prior art fibrous structure 10 during papermaking of the prior art fibrous structure 10 than its 45° counterpart discussed immediately above, but unfortunately exhibited worse softness than its 45° counterpart due to the continued presence of nubs 24.

Other example of prior art fibrous structures 10 that have fallen short of the softness and/or sheet control desires of formulators are described below.

Another prior art fibrous structure 10 has been made on a molding member 10 as shown in Prior Art FIG. 3, which is similar to the molding members 10 of Prior Art FIGS. 1B, 2B, and 2C. Such prior art fibrous structure 10 made on molding member 10 of Prior Art FIG. 3 exhibits the similar negatives as the above prior art fibrous structures 10 of Prior Art FIGS. 1A and 2A.

Another prior art fibrous structure 10 has been made on a molding member 10 as shown in Prior Art FIG. 4. The molding member 10 of Prior Art FIG. 4 comprises a continuous pillow network 22, which is represented by the white region between the discrete knuckles 18, of the molding member 16 of Prior Art FIG. 4.

In order to improve the structure from a FSO point of view on discrete knuckle belts, previously disclosed discrete knuckle structures straightened the pillows and knuckle and made the knuckle and pillow dimensions more uniform.

Other known prior art fibrous structures 10 have been made on various molding members 16, such as shown in Prior Art FIGS. 5-7. The molding members 10 of Prior Art FIGS. 5-7 comprise a continuous knuckle network 34, which is represented by the white region in these cases, and a plurality of discrete pillows 38, which are represented by the black regions in these cases.

Another known prior art fibrous structure 10 has been made on a molding member 16 as shown in Prior Art FIG. 8. The molding member 16 of Prior Art FIG. 8 comprises a continuous knuckle network 34, which is represented by the white region, and a plurality of discrete pillows 38, which are represented by the black regions. The prior art fibrous structure 10 made on such a molding member 16 of Prior Art FIG. 8 would exhibit nubs in the FSO orientation and thus exhibit softness negatives. In addition, since the molding member 16 shown in Prior Art FIG. 8 lacks continuity of a repeat unit, for example juxtaposed groups of discrete pillows 38. Not maintaining continuity of the discrete pillows 38 and juxtaposed groups of discrete pillows 38 and/or the curvature present in the discrete pillows 38 results in the fibrous structure made using the molding member 16 exhibiting non-uniform surface feel and thus exhibit softness negatives, not to mention a non-uniform appearance.

Still another known prior art fibrous structure 10 of Prior Art FIG. 9A comprises a surface pattern on its surface 26 comprising a continuous knuckle region 32, which is represented by the black (darker) continuous network, imparted by the continuous knuckle network 34, which is represented by the white continuous network of Prior Art FIG. 9B. Discrete pillow regions 36, which are represented by the white regions in Prior Art FIG. 9A, are dispersed within the continuous knuckle region 32 as shown in Prior Art FIG. 9A. The discrete pillow regions 36 are imparted by the discrete pillows 38, represented by the black regions of the molding member 16 of Prior Art FIGS. 9B and 9C. The discrete pillows 38 comprise deflection conduits 30 into which portions of a prior art fibrous structure ply being made on the molding member 16 deflect. As shown in Prior Art FIG. 9C, in one example, the molding member 16 comprises a reinforcing element 28 upon which a continuous knuckle network 34 formed by a continuous network of resin 20 that defines a non-random, repeating pattern of discrete pillows 38 not groups of discrete pillows 38. The prior art fibrous structure 10 made on such a molding member 16 of Prior Art FIGS. 9B and 9C would exhibit softness negatives and/or sheet control negatives including necking (narrowing of the sheet width during papermaking of the prior art fibrous structure 10.

Accordingly, the problem faced by formulators is how to make a fibrous structure that exhibits improved softness and better sheet control and/or less necking (more sheet width stability and/or less sheet width narrowing) compared to known fibrous structures.

Accordingly, there exists a need for a fibrous structure that exhibits improved softness and better sheet control during papermaking of the fibrous structure than known fibrous structures and/or sanitary tissue products comprising such fibrous structures, for example bath tissue products, methods for making same, and molding members used in such methods.

SUMMARY OF THE INVENTION

The present invention fulfills the need described above by providing fibrous structures, for example sanitary tissue products, such as bath tissue products, that exhibit improved softness compared to known prior art fibrous structures and/or sanitary tissue products comprising such known prior art fibrous structures, and/or better sheet control, including less necking (less or no narrowing of the fibrous structure's width in the CD during the making of such fibrous structures), methods for making same, and molding members, for example patterned molding members, such as patterned resin-containing belts, used in such methods to impart a surface pattern of a continuous knuckle region and a plurality of discrete pillow regions to a surface of the fibrous structures.

One solution to the problem set forth above is achieved by making the fibrous structures, for example sanitary tissue products or at least one fibrous structure ply employed in the sanitary tissue products on molding members, for example patterned molding members that impart a surface pattern, for example a three-dimensional (3D) pattern to surfaces of the fibrous structures and/or sanitary tissue products and/or fibrous structure plies made thereon, wherein the molding members are designed such that the resulting fibrous structures and/or sanitary tissue products, for example bath tissue products, made using the molding members are softer than known prior art fibrous structures, for example known prior art sanitary tissue products. In order to achieve the benefits of the fibrous structures of the present invention, one or more of the following dimensions/properties/characteristics need to be present in the surface pattern: 1) the surface pattern comprises a continuous knuckle region and a plurality of discrete pillow regions dispersed within the continuous knuckle region; 2) the surface pattern comprises a repeat unit defined by two or more groups of two or more discrete pillow regions; 3) the surface pattern comprises at least two groups of two or more discrete pillow regions that are non-parallelly juxtaposed; 4) the surface pattern comprises two or more discrete pillow regions that are non-parallelly juxtaposed; 5) the surface pattern comprises at least two discrete pillow regions that are non-parallelly juxtaposed, especially when the at least two discrete pillow regions are present in different groups of two or more discrete pillow regions; 6) the surface pattern comprises at least one and/or a plurality and/or all discrete pillow region(s) wherein an individual discrete pillow region exhibits a discrete pillow region length of greater than 2 mm as measured according to the Micro-CT Intensive Property Measurement Test Method described herein; 7) the surface pattern comprises at least one and/or a plurality and/or all discrete pillow region(s) wherein an individual discrete pillow region exhibits a discrete pillow region length to discrete pillow region width ratio of greater than 1.3 as measured according to the Micro-CT Intensive Property Measurement Test Method described herein; 8) the surface pattern comprises at least one and/or a plurality and/or all discrete pillow region(s) wherein an individual discrete pillow region exhibits a perimeter of greater than 5 mm as measured according to the Micro-CT Intensive Property Measurement Test Method described herein; 9) the surface pattern comprises at least one and/or a plurality and/or all discrete pillow region(s) wherein an individual discrete pillow region exhibits a discrete pillow region perimeter to average knuckle region width of greater than 21 as measured according to the Micro-CT Intensive Property Measurement Test Method described herein; 10) the surface pattern comprises at least one and/or a plurality and/or all discrete pillow region(s) wherein an individual discrete pillow region exhibits a discrete pillow region length to average knuckle region width of greater than 6.5 as measured according to the Micro-CT Intensive Property Measurement Test Method described herein; 11) the surface pattern comprising a continuous knuckle region and a plurality of discrete pillow regions such that the fibrous structure is void of nubs; 12) the surface pattern comprises a continuous knuckle region that exhibits a substantially uniform knuckle region width, for example the knuckle region width of the continuous knuckle region exhibits a relative standard deviation of less than 25% as measured according to the Micro-CT Intensive Property Measurement Test Method described herein; 13) the surface pattern comprises at least one and/or a plurality and/or all discrete pillow region(s) wherein an individual discrete pillow region exhibits a substantially uniform discrete pillow region width, for example the discrete pillow region width of the discrete pillow region exhibits a relative standard deviation of less than 25% as measured according to the Micro-CT Intensive Property Measurement Test Method described herein; 14) the surface pattern comprises minimal and/or no discrete pillow regions having a shape that includes a curvature, especially if the discrete pillow region(s) are oriented in two or more different directions in the x-y plane of the surface of the fibrous structure; and 15) the surface pattern exhibits multi-axiality, for example biaxiality, in other words the surface pattern is a biaxial surface pattern, for example based on the discrete pillow regions and/or the groups of two or more discrete pillow regions.

Non-limiting examples of such molding members for use in the present invention include patterned felts, patterned forming wires, patterned rolls, patterned fabrics, and patterned belts utilized in conventional wet-pressed papermaking processes, air-laid papermaking processes, and/or wet-laid papermaking processes that produce surface patterned, for example 3D patterned fibrous structures and/or 3D patterned sanitary tissue products and/or 3D patterned fibrous structure plies employed in sanitary tissue products. Other non-limiting examples of such molding members include through-air-drying fabrics and through-air-drying belts utilized in through-air-drying papermaking processes that produce through-air-dried fibrous structures and/or sanitary tissue products, for example 3D patterned through-air dried fibrous structures and/or 3D patterned through-air-dried sanitary tissue products and/or 3D patterned through-air-dried fibrous structure plies employed in sanitary tissue products.

In addition to the impact of the patterned molding members, the fibers utilized to make the sanitary tissue products of the present invention also may influence the softness of the fibrous structures and/or sanitary tissue products. For example, the use of non-wood pulp fibers, for example trichomes, positively impact the surface smoothness of the sanitary tissue products, for example when they form at least part of an exterior surface of the sanitary tissue products compared to fibrous structures and/or sanitary tissue products containing only wood pulp fibers.

In one example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern is defined by two or more groups of two or more discrete pillow regions, wherein the at least two of the two or more groups are non-parallelly juxtaposed is provided.

In one example of the present invention, a fibrous structure comprising a surface comprising a surface pattern, wherein the surface pattern comprises a continuous knuckle region and a plurality of discrete pillow regions dispersed within the continuous knuckle region, wherein the surface pattern's repeat unit is defined by two or more groups of two or more discrete pillow regions, wherein at least two of the two or more groups are non-parallelly juxtaposed is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern is defined by two or more groups of two or more discrete pillow regions, wherein at least two of the two or more groups are non-parallelly juxtaposed and wherein the plurality of discrete pillow regions exhibits a substantially uniform discrete pillow region width is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern is defined by two or more groups of two or more discrete pillow regions, wherein at least two of the two or more groups are non-parallelly juxtaposed and wherein the plurality of discrete pillow regions exhibits a substantially uniform discrete pillow region width, wherein the plurality of discrete pillow regions exhibits an average discrete pillow region width that exhibits a relative standard deviation of less than 25% as measured according to the Micro-CT Intensive Property Measurement Test Method is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein the surface pattern's repeat unit is defined by two or more groups of two or more discrete pillow regions, wherein at least two of the two or more groups are non-parallelly juxtaposed and wherein the plurality of discrete pillow regions exhibits a substantially uniform discrete pillow region width is provided.

In one example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern only comprises or consists of or consists essentially of two or more groups of two or more discrete pillow regions, wherein at least two of the two or more groups are non-parallelly juxtaposed.

In one example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern comprises at least two groups of two or more discrete pillow regions, wherein the at least two groups are non-parallelly juxtaposed, for example the repeat unit is defined by two or more groups of two or more discrete pillow regions, wherein at least two of the two or more groups are non-parallelly juxtaposed is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern comprises at least two groups of two, for example three, or more discrete pillow regions, wherein at least one of the at least two groups comprises three or more discrete pillow regions and wherein the at least two groups are non-parallelly juxtaposed is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern comprises at least two groups of two or more discrete pillow regions, wherein the at least one of the two or more groups is oriented at an angle of from about 30° to about 85° and/or from about 45° to about 80° relative to the CD is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein the surface pattern exhibits a concentration of discrete pillow regions within the surface pattern of less than 200 and/or less than 175 and/or less than 150 and/or less than 125 and/or less than 100 and/or less than 75 discrete pillow regions/in$^2$ and wherein at least 50% and/or at least 75% and/or at least 85% and/or at least 95% and/or 100% of the discrete pillow regions exhibit a discrete pillow region length to discrete pillow region width of at greater than 3 and/or greater than 3.1 and/or greater than 3.5 and/or greater than 4 and/or greater than 5 and/or greater than 6 and/or greater than 7 mm as measured according to the Micro-CT Intensive Property Measurement Test Method described herein as measured according to the Micro-CT Intensive Property Measurement Test Method described herein, and optionally wherein a repeat unit of the surface pattern comprises at least two groups of two or more discrete pillow regions, and optionally wherein the at least two groups are non-parallelly juxtaposed is provided.

In another example of the present invention, a fibrous structure comprising a surface comprising a surface pattern, wherein the surface pattern comprises a continuous knuckle region and a plurality of discrete pillow regions dispersed within the continuous knuckle region, wherein a repeat unit of the surface pattern comprises less than 20 discrete pillow regions, and optionally wherein the surface patter comprises at least two groups of two or more discrete pillow regions, and optionally wherein the at least two groups are non-parallelly juxtaposed is provided.

In another example of the present invention, a fibrous structure comprising a surface comprising a surface pattern, wherein the surface pattern comprises a continuous knuckle region and a plurality of discrete pillow regions, wherein one or more of the plurality of discrete pillow regions exhibits a discrete pillow region length of greater than 3.8 mm as measured according to the Micro-CT Intensive Property Measurement Test Method described herein is provided.

In yet another example of the present invention, a fibrous structure comprising a surface comprising a surface pattern, wherein the surface pattern comprises a continuous knuckle region and a plurality of discrete pillow regions, wherein one or more of the plurality of discrete pillow regions exhibits a discrete pillow region length to discrete pillow region width ratio of greater than 3.1 as measured according to the Micro-CT Intensive Property Measurement Test Method described herein is provided.

In still another example of the present invention, a fibrous structure comprising a surface comprising a surface pattern, wherein the surface pattern comprises a continuous knuckle region and a plurality of discrete pillow regions, wherein one or more of the plurality of discrete pillow regions exhibits a discrete pillow region perimeter of greater than 12.7 mm as measured according to the Micro-CT Intensive Property Measurement Test Method described herein is provided.

In even another example of the present invention, a fibrous structure comprising a surface comprising a surface pattern, wherein the surface pattern comprises a continuous knuckle region and a plurality of discrete pillow regions, wherein one or more of the plurality of discrete pillow regions exhibits a discrete pillow region perimeter to knuckle (continuous knuckle) region width ratio of greater than 40 as measured according to the Micro-CT Intensive Property Measurement Test Method described herein is provided.

In still yet another example of the present invention, a bath tissue product that exhibits temporary wet strength but is void of permanent wet strength (for example exhibits wet burst values of less than 100 g and/or less than 75 g and/or less than 50 g and/or wet strength decay of less than 25%), wherein the bath tissue product comprises a surface comprising a surface pattern, wherein the surface pattern comprises a continuous knuckle region and a plurality of discrete pillow regions, wherein one or more of the plurality of discrete pillow regions exhibits a discrete pillow region perimeter to knuckle (continuous knuckle) region width ratio of greater than 21 as measured according to the Micro-CT Intensive Property Measurement Test Method described herein is provided.

In even yet another example of the present invention, a fibrous structure comprising a surface comprising a surface pattern, wherein the surface pattern comprises a continuous knuckle region and a plurality of discrete pillow regions, wherein one or more of the plurality of discrete pillow regions exhibits a discrete pillow region length to knuckle (continuous knuckle) region width of greater than 12 as measured according to the Micro-CT Intensive Property Measurement Test Method described herein is provided.

In even still yet another example of the present invention, a bath tissue product that exhibits temporary wet strength but is void of permanent wet strength (for example exhibits wet burst values of less than 100 g and/or less than 75 g and/or less than 50 g and/or wet strength decay of less than 25%), wherein the bath tissue product comprises a surface comprising a surface pattern, wherein the surface pattern comprises a continuous knuckle region and a plurality of discrete pillow regions, wherein one or more of the plurality of discrete pillow regions exhibits a discrete pillow region length to average knuckle region width ratio of greater than 6.5 as measured according to the Micro-CT Intensive Property Measurement Test Method described herein is provided.

In another example of the present invention, a fibrous structure comprising a surface comprising a surface pattern, wherein the surface pattern comprises a continuous knuckle region and a plurality of discrete pillow regions such that the fibrous structure is void of nubs is provided.

In yet another example of the present invention, a fibrous structure comprising a surface comprising a surface pattern, wherein the surface pattern comprises a continuous knuckle region that exhibits a substantially uniform knuckle region width and a plurality of discrete pillow regions is provided.

In still yet another example of the present invention, a fibrous structure comprising a surface comprising a surface pattern, wherein the surface pattern comprises a continuous knuckle region and a plurality of discrete pillow regions wherein at least one individual discrete pillow region exhibits a substantially uniform discrete pillow region width is provided.

In even another example of the present invention, a fibrous structure comprising a surface comprising a surface pattern, wherein the surface pattern comprises a continuous knuckle region and a plurality of discrete pillow regions wherein minimal and/or no discrete pillow regions have a shape that includes a curvature is provided.

In still another example of the present invention, a fibrous structure comprising a surface comprising a surface pattern, wherein the surface pattern comprises a continuous knuckle region and a plurality of discrete pillow regions wherein the surface pattern comprises at least two groups of two or more discrete pillow regions and wherein the surface pattern exhibits biaxiality is provided.

In even still yet another example of the present invention, a fibrous structure comprising a surface comprising a surface pattern, wherein the surface pattern comprises a continuous knuckle region and a plurality of discrete pillow regions wherein one or more of the discrete pillow regions exhibits less than five sides and wherein two or more of the discrete pillow regions are oriented into 2 or more different directions, for example in the x-y plane of the surface, is provided.

In still yet another example of the present invention, a method for making a fibrous structure according to the present invention, wherein the method comprises the step of contacting a molding member with a fibrous structure comprising a plurality of pulp fibers such that a surface pattern is imparted to the fibrous structure to form a patterned, for example 3D patterned, fibrous structure ply, which can then form or be incorporated into a single- or multi-ply sanitary tissue product, for example a single- or multi-ply bath tissue product is provided.

In even another example of the present invention, a molding member, for example a patterned molding member, such as a through-air-drying fabric, comprising a pattern that is capable of imparting a surface pattern according to the present invention to a fibrous structure during a fibrous structure making process, for example a papermaking process is provided.

In yet another example of the present invention, a single- or multi-ply sanitary tissue product comprising a fibrous structure according to the present invention is provided.

In still yet another example of the present invention, a roll of sanitary tissue product comprising a single- or multi-ply sanitary tissue product according to the present invention is provided.

In even yet another example of the present invention, a package comprising one or more rolls of sanitary tissue product according to the present invention is provided.

It has unexpectedly been found that the discrete pillow regions of the fibrous structures of the present invention improves surface mobility as a result of the pillow regions being mobile during use such as wiping, and thus the softness that the consumers of the fibrous structures experience. Not wishing to be bound by theory, it is believed that the one or more of the discrete pillow region's sidewalls exhibits a different common intensive property value than the top of the discrete pillow region (the consumer contacting surface of the discrete pillow region). In one example, at least one and/or a plurality and/or all of the discrete pillow regions in a surface pattern of a fibrous structure of the present invention exhibits one or more sidewalls that exhibit lower values of a common intensive property than the top of the discrete pillow region, for example the sidewall(s) exhibits a lower basis weight than the basis weight of the top of the discrete pillow region and/or the sidewall(s) exhibits a lower thickness than the thickness of the top of the discrete pillow region.

It has been found that the orientation of the fibrous structure, specifically converting the fibrous structure such that its uncreped surface (the surface that has not contacted the dryer and/or Yankee and thus has not been creped off the dryer and/or Yankee) (low density discrete pillow region side out ("FSO") thus forming the consumer contacting surface rather than the high density continuous knuckle region side out (wire side out "WSO") improves surface mobility. Not wishing to be bound by theory, it is believed that one of the reasons for the improved surface mobility when the orientation of the fibrous structure is uncreped surface (low density discrete pillow region surface) side out ("FSO") is the fact that the lower density pillows are on the surface of the fibrous structure. When the fibrous structure undergoes compressive force with the lower density pillows on the surface of the fibrous structure, the fibrous structure will have increased "cushiness". At the same time, having the low density pillows on the surface of the fibrous structure creates better surface mobility, because a strain imparted on the surface of the fibrous structure will move through the discrete pillow region more easily than through a continuous knuckle region, providing less stress on the surface of the fibrous structure due to the lower density of the discrete pillow region.

Accordingly, the present invention provides fibrous structures, for example sanitary tissue products, such as bath tissue products, that are softer and/or exhibit better sheet control during the fibrous structure making, for example papermaking, processes, methods for making such fibrous structures, molding members used therein, and methods for making such molding members.

DETAILED DESCRIPTION OF THE INVENTION

Definitions

Figure 1A:
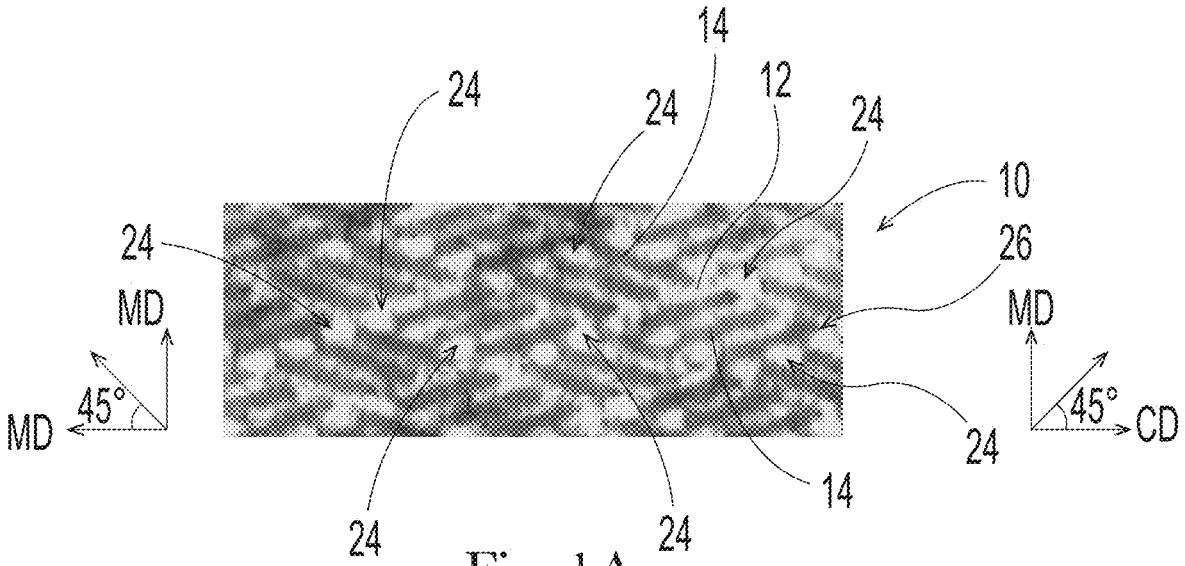
Fig. 1A PRIOR ART
FIG. 1A is a MikroCAD image of a prior art fibrous structure that illustrates nubs present in the prior art fibrous structure having a surface pattern having a continuous pillow region and a plurality of discrete knuckle regions that are oriented at an angle of 45° relative to the CD.

"Sanitary tissue product" as used herein means a soft, low density (i.e. < about 0.15 g/cm$^3$) article comprising one or more fibrous structure plies according to the present invention, wherein the sanitary tissue product is useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

The sanitary tissue products and/or fibrous structures of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a sum of MD and CD dry tensile strength of greater than about 59 g/cm (150 g/in) and/or from about 78 g/cm to about 394 g/cm and/or from about 98 g/cm to about 335 g/cm. In addition, the sanitary tissue product of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm. In one example, the sanitary tissue product exhibits a sum of MD and CD dry tensile strength of less than about 394 g/cm and/or less than about 335 g/cm.

In another example, the sanitary tissue products of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 787 g/cm.

The sanitary tissue products of the present invention may exhibit an initial sum of MD and CD wet tensile strength of less than about 78 g/cm and/or less than about 59 g/cm and/or less than about 39 g/cm and/or less than about 29 g/cm.

The sanitary tissue products of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm.

The sanitary tissue products of the present invention may exhibit a density (based on measuring caliper at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

"Fibrous structure" as used herein means a structure that comprises a plurality of fibers, for example pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments), such as in the form of a co-formed fibrous structure where the pulp fibers and filaments are commingled together. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes, for example conventional wet-pressed papermaking processes and through-air-dried papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, often referred to as a parent roll, and may subsequently be converted into a finished product, e.g. a single- or multi-ply sanitary tissue product.

The fibrous structures of the present invention may be homogeneous or may be layered. If layered, the fibrous structures may comprise at least two and/or at least three and/or at least four and/or at least five layers of fiber and/or filament compositions.

In one example, the fibrous structure of the present invention consists essentially of fibers, for example pulp fibers, such as cellulosic pulp fibers and more particularly wood pulp fibers.

In another example, the fibrous structure of the present invention comprises fibers and is void of filaments.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include synthetic polymers including, but not limited to thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments, polyesteramide filaments, and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc.), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

In one example, the fibers may comprise monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc) and mixtures thereof.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, microcreping, printing or other processes that may also impart a texture and/or decorative pattern to a fibrous structure and/or sanitary tissue product.

"Differential density", as used herein, means a fibrous structure and/or sanitary tissue product that comprises one or more regions of relatively low fiber density, which are referred to as pillow regions, and one or more regions of relatively high fiber density, which are referred to as knuckle regions. In one example, a fibrous structure of the present invention comprises a surface comprising a surface pattern comprising a continuous knuckle region and a plurality of discrete pillow regions that exhibit different densities, for example, one or more of the discrete pillow regions may exhibit a density that is lower than the density of the continuous knuckle region.

"Densified", as used herein means a portion of a fibrous structure and/or sanitary tissue product that is characterized by regions of relatively high fiber density (knuckle regions).

"Non-densified", as used herein, means a portion of a fibrous structure and/or sanitary tissue product that exhibits a lesser density (one or more regions of relatively lower fiber density) (pillow regions) than another portion (for example a knuckle region) of the fibrous structure and/or sanitary tissue product.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutedly wound about a core or itself. For example, a non-rolled product comprises a facial tissue.

"Creped" as used herein means creped off of a Yankee dryer or other similar roll and/or fabric creped and/or belt creped. Rush transfer of a fibrous structure alone does not result in a "creped" fibrous structure or "creped" sanitary tissue product for purposes of the present invention.

"Juxtaposed" as used herein means two or more groups (of two or more discrete pillow regions) are arranged side-by-side for contrasting effect.

"Repeat unit" as used herein means a pattern unit, which is the part or section of a pattern that is repeated to create the pattern, such as the surface pattern of a fibrous structure according to the present invention. In one example, the repeat unit is defined by and/or formed by and/or consists of a group of two or more and/or three or more discrete pillow regions. In another example, the repeat unit is defined by and/or formed by and/or consists of two or more groups of two or more and/or three or more discrete pillow regions.

In one example, a repeat unit, for example a group of two or more and/or three or more discrete pillow regions is translated and/or rotated and/or reflected to form a surface pattern on a fibrous structure from the repeat unit.

In another example, a repeat unit, for example a group of two or more and/or three or more discrete pillow regions is translated and rotated to form a surface pattern on a fibrous structure from the repeat unit.

In one example, a repeat unit, for example two groups of two or more and/or three or more discrete pillow regions is translated and/or rotated and/or reflected to form a surface pattern on a fibrous structure from the repeat unit.

In another example, a repeat unit, for example two groups of two or more and/or three or more discrete pillow regions is translated and rotated to form a surface pattern on a fibrous structure from the repeat unit.

Fibrous Structures/Sanitary Tissue Products

The sanitary tissue products of the present invention may be single-ply or multi-ply sanitary tissue products. In other words, the sanitary tissue products of the present invention may comprise one or more fibrous structures. The fibrous structures and/or sanitary tissue products of the present invention are made from a plurality of pulp fibers, for example wood pulp fibers and/or other cellulosic pulp fibers, for example trichomes. In addition to the pulp fibers, the fibrous structures and/or sanitary tissue products of the present invention may comprise synthetic fibers and/or filaments.

Figure 10A:
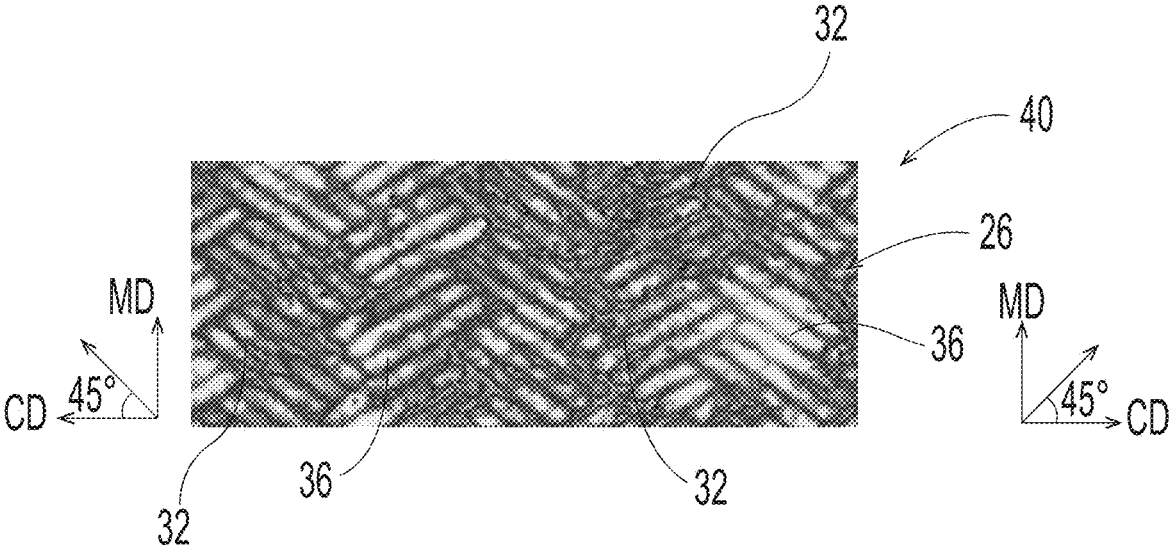
FIG. 10A is a MikroCAD image of an example of a fibrous structure of the present invention having a surface pattern having a continuous knuckle region and a plurality of discrete pillow regions, and illustrating the lack of nubs in the fibrous structure.
Figure 10B:
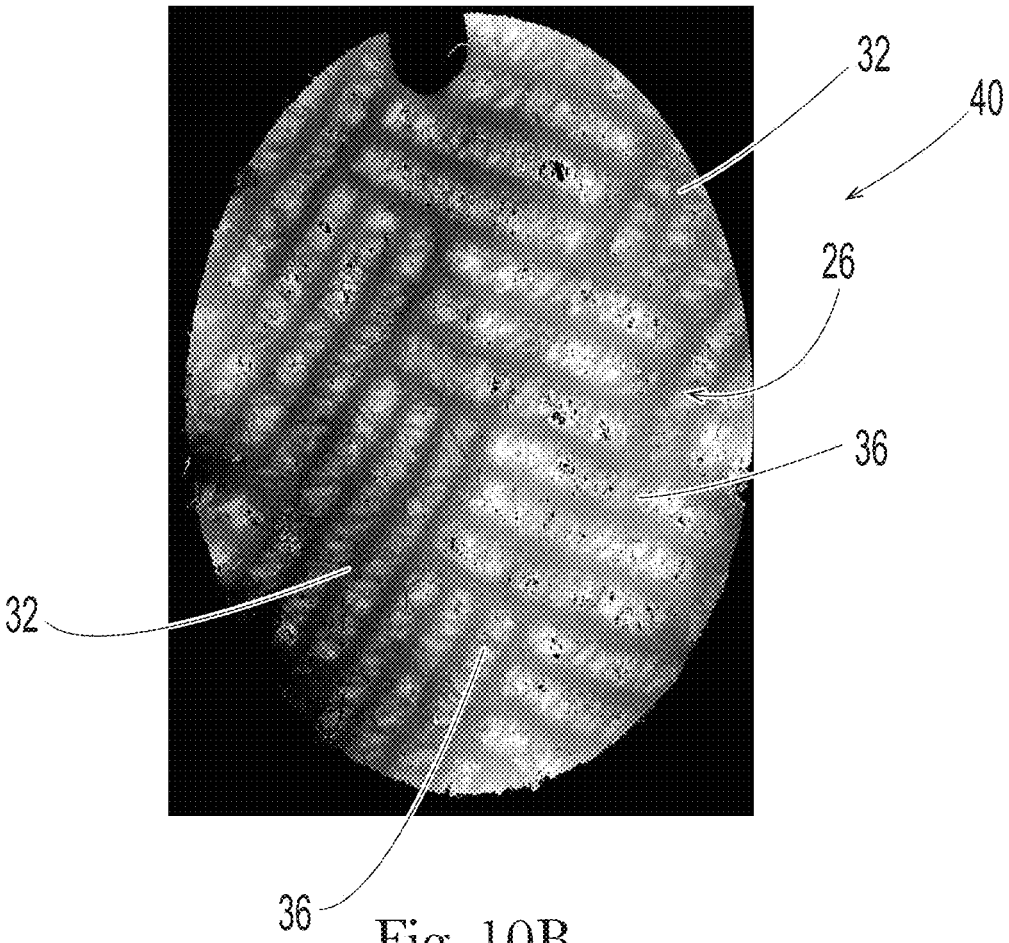
FIG. 10B is a Micro-CT image of the fibrous structure of FIG. 10A structure having a surface pattern having a continuous knuckle region and a plurality of discrete pillow regions that are oriented at an angle of 45° relative to the CD.
Figure 10C:
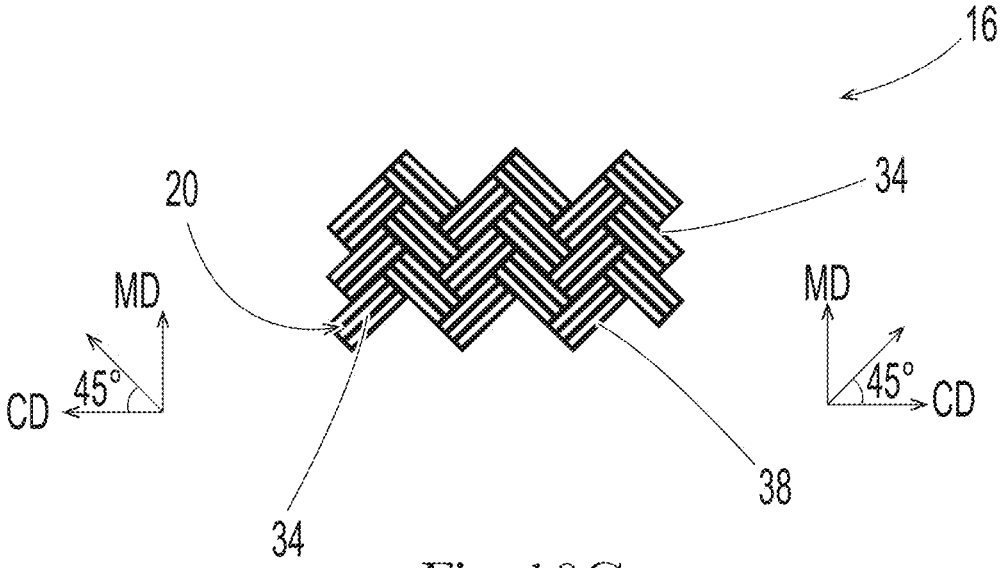
FIG. 10C is a schematic representation of a portion of the pattern of an example of a molding member according to the present invention used to make the fibrous structure of FIGS. 10A and 10B.
Figure 10D:
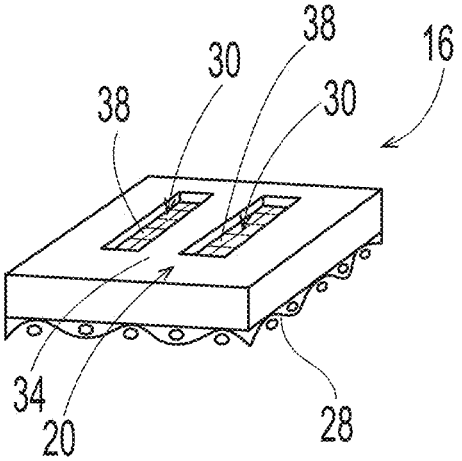
FIG. 10D is a schematic representation of a closeup of a portion of the molding member of FIG. 10C showing the resinous continuous knuckle network, which may lock onto the reinforcing element by a portion of the resin penetrating through the reinforcing element to the backside, and the discrete pillows.

As shown in FIGS. 10A and 10B, a fibrous structure of the present invention 40 comprises a surface 26 comprising a surface pattern, wherein the surface pattern comprises a continuous knuckle region 32, which is represented by the black (darker) continuous network, imparted by the continuous knuckle network 34, which is represented by the black continuous network of FIG. 10C. Discrete pillow regions 36, which are oriented at an angle of 45° relative to the CD and which are represented by the white (lighter) discrete regions in FIGS. 10A and 10B, are dispersed within the continuous knuckle region 32 the black (darker) continuous network as shown in FIGS. 10A and 10B. The discrete pillow regions 36 are imparted by the discrete pillows 38, represented by the white regions of the molding member 16 of FIG. 10C. As shown in FIG. 10D, the molding member 16 comprises the discrete pillows 38, which comprise deflection conduits 30 into which portions of a fibrous structure ply being made on the molding member 16 deflect. The molding member 16 further comprise resin 20 from which the continuous knuckle network 34 is formed. The resin 20 may be supported by a reinforcing element 28. The fibrous structure 40 made on such a molding member 16 of FIG. 10C exhibits improved softness and/or better sheet control and/or less necking compared to prior art fibrous structures. In addition, as shown in FIGS. 10A and 10B, the fibrous structure 40 is void of nubs 24, which are present in the prior art fibrous structure 10 of Prior Art FIG. 1A, for example.

Figure 11:
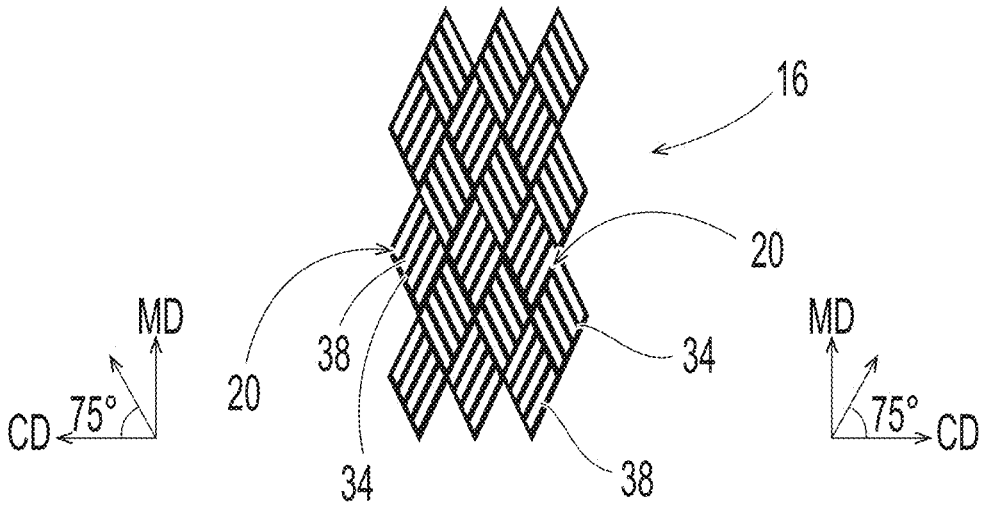
FIG. 11 is a schematic representation of a portion of a pattern of an example of a molding member according to the present invention having a continuous knuckle network and a plurality of discrete pillows used to produce a fibrous structure of the present invention that is similar to the fibrous structure of FIGS. 10A and 10B except that the discrete pillow regions would be oriented at an angle of 75° relative to the CD.

A similar fibrous structure of the present invention 40 as shown in FIGS. 10A and 10B is formed on the molding member 16 of FIG. 11 where the discrete pillows 38 (white regions) are oriented at an angle of 75° relative to the CD, and thus impart discrete pillow regions 36 in the fibrous structure 40 that are oriented at an angle of 75° relative to the CD. The discrete pillows 38 are dispersed within the continuous knuckle network 34 (black region)

Figure 12:
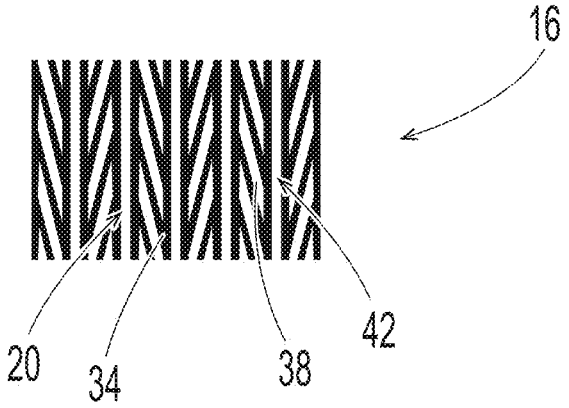
FIG. 12 is a schematic representation of a portion of a pattern of an example of a molding member according to the present invention having a continuous knuckle network and a plurality of discrete pillows used to produce a fibrous structure of the present invention.

FIG. 12 shows an example of another molding member 16 that produces a fibrous structure of the present invention 40. The molding member 16 comprises a continuous knuckle network 34, which is represented by the black continuous network, that imparts a continuous knuckle region 32 in a fibrous structure, and a plurality of discrete pillows 38 and one or more semi-continuous pillows 42, both of which are represented by the white regions.

Figure 13:
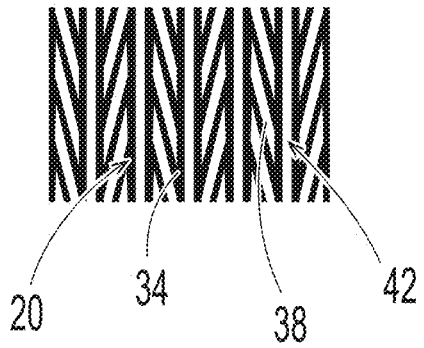
FIG. 13 is a schematic representation of a portion of a pattern of an example of a molding member according to the present invention having a continuous knuckle network and a plurality of discrete pillows used to produce a fibrous structure of the present invention.

FIG. 13 shows an example of another molding member 16 that produces a fibrous structure of the present invention 40. The molding member 16 comprises a continuous knuckle network 34, which is represented by the black continuous network, that imparts a continuous knuckle region 32 in a fibrous structure, and a plurality of discrete pillows 38 and one or more semi-continuous pillows 42, both of which are represented by the white regions.

Figure 14:
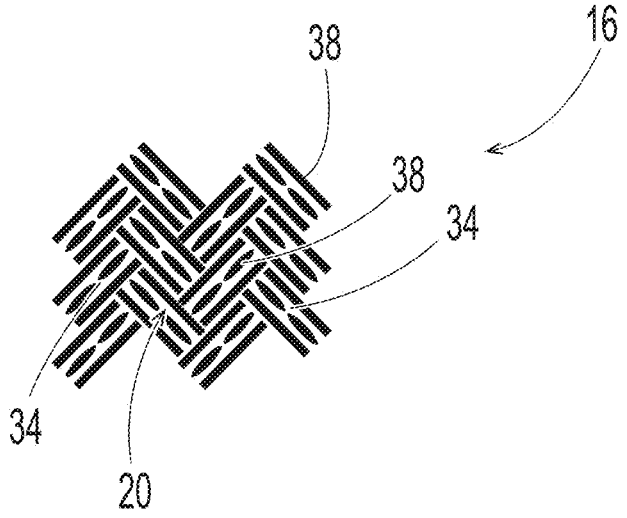
FIG. 14 is a schematic representation of a portion of a pattern of an example of a molding member according to the present invention having a continuous knuckle network and a plurality of discrete pillows used to produce a fibrous structure of the present invention.

FIG. 14 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 15:
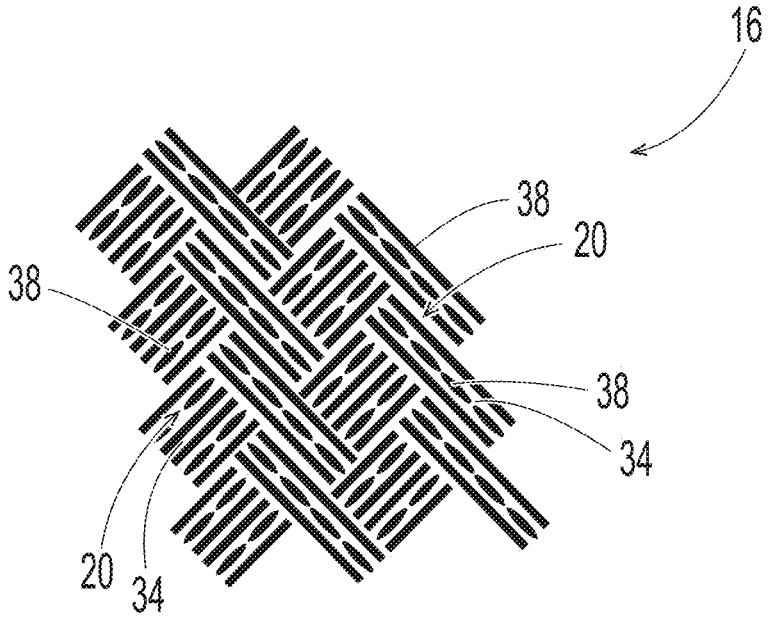
FIG. 15 is a schematic representation of a portion of a pattern of an example of a molding member according to the present invention having a continuous knuckle network and a plurality of discrete pillows used to produce a fibrous structure of the present invention.

FIG. 15 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 16:
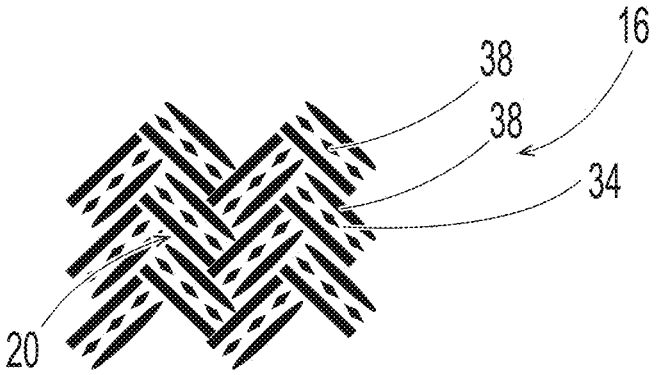
FIG. 16 is a schematic representation of a portion of a pattern of an example of a molding member according to the present invention having a continuous knuckle network and a plurality of discrete pillows used to produce a fibrous structure of the present invention.

FIG. 16 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 17:
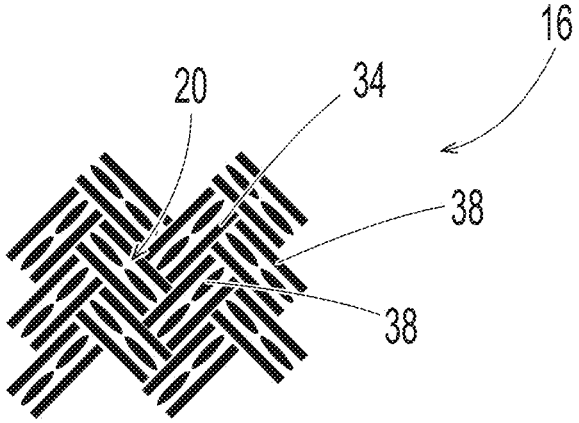
FIG. 17 is a schematic representation of a portion of a pattern of an example of a molding member according to the present invention having a continuous knuckle network and a plurality of discrete pillows used to produce a fibrous structure of the present invention.

FIG. 17 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 18:
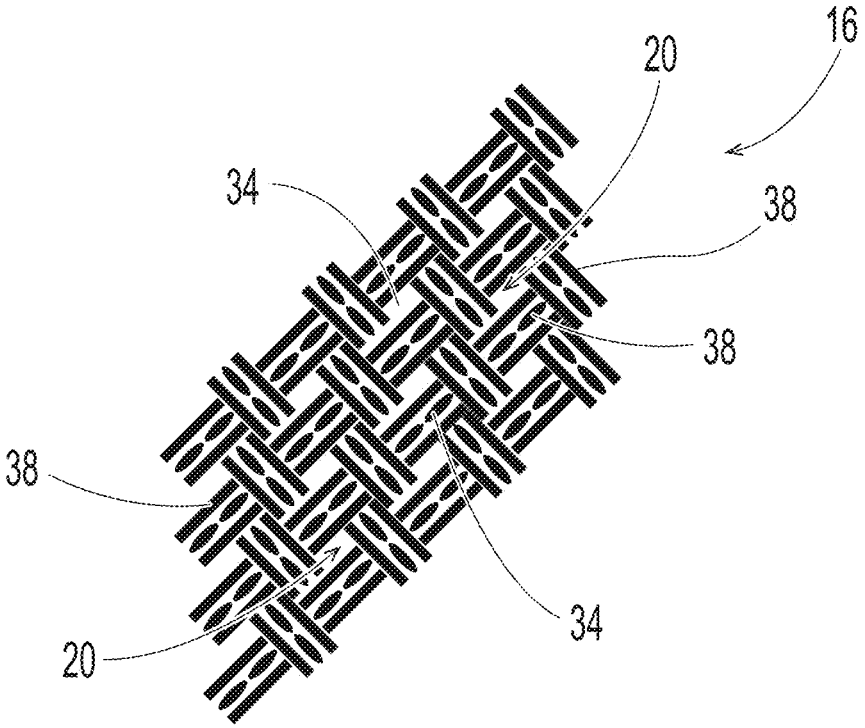
FIG. 18 is a schematic representation of a portion of a pattern of an example of a molding member according to the present invention having a continuous knuckle network and a plurality of discrete pillows used to produce a fibrous structure of the present invention.

FIG. 18 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 18, the continuous knuckle network 34 is not substantially uniform in width.

Figure 19:
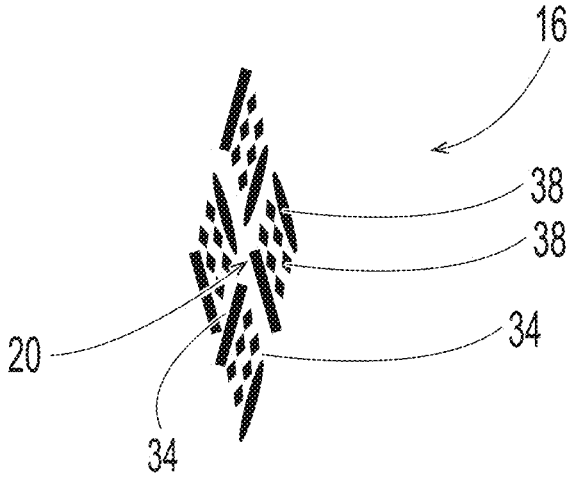
FIG. 19 is a schematic representation of a portion of a pattern of an example of a molding member according to the present invention having a continuous knuckle network and a plurality of discrete pillows used to produce a fibrous structure of the present invention.

FIG. 19 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 19, the continuous knuckle network 34 is not substantially uniform in width.

Figure 20:
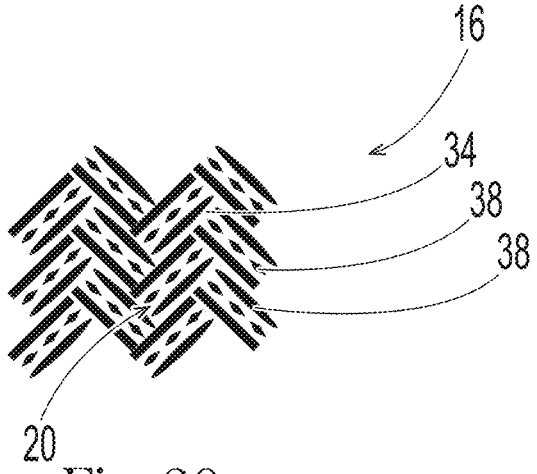
FIG. 20 is a schematic representation of a portion of a pattern of an example of a molding member according to the present invention having a continuous knuckle network and a plurality of discrete pillows used to produce a fibrous structure of the present invention.

FIG. 20 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 21:
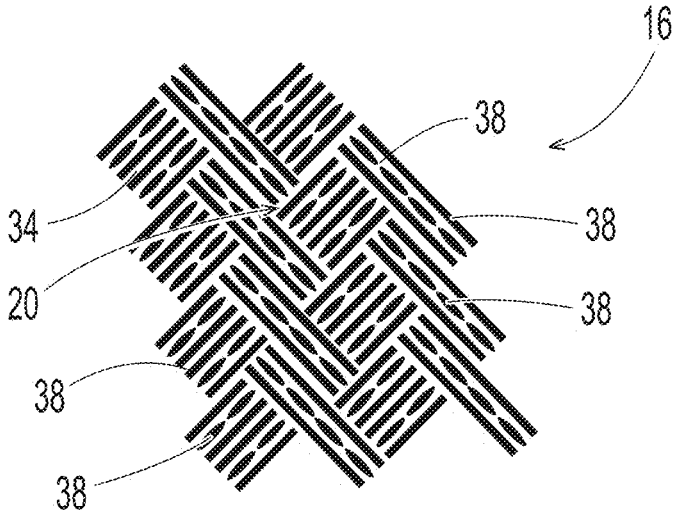
FIG. 21 is a schematic representation of a portion of a pattern of an example of a molding member according to the present invention having a continuous knuckle network and a plurality of discrete pillows used to produce a fibrous structure of the present invention.

FIG. 21 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions.

Figure 22:
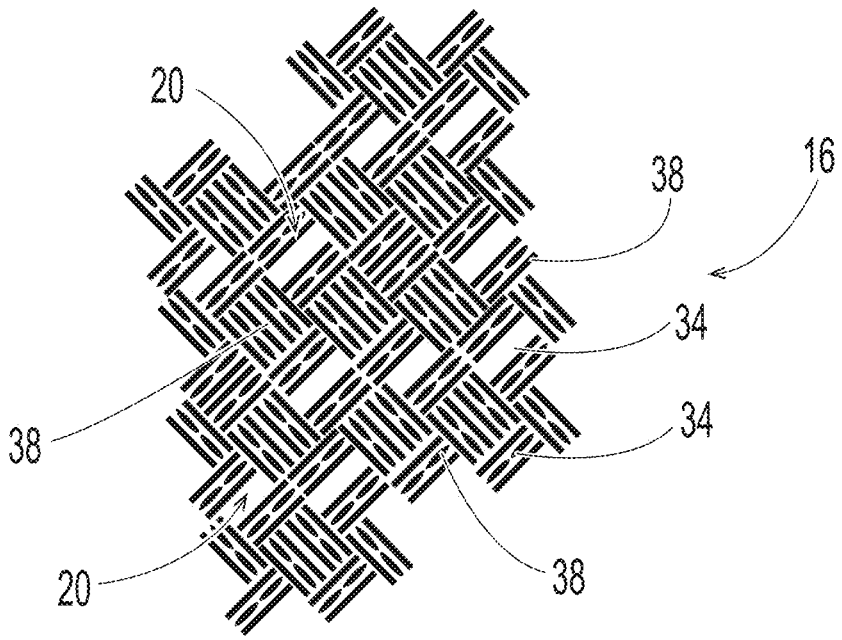
FIG. 22 is a schematic representation of a portion of a pattern of an example of a molding member according to the present invention having a continuous knuckle network and a plurality of discrete pillows used to produce a fibrous structure of the present invention.

FIG. 22 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 22, the continuous knuckle network 34 is not substantially uniform in width.

Figure 23:
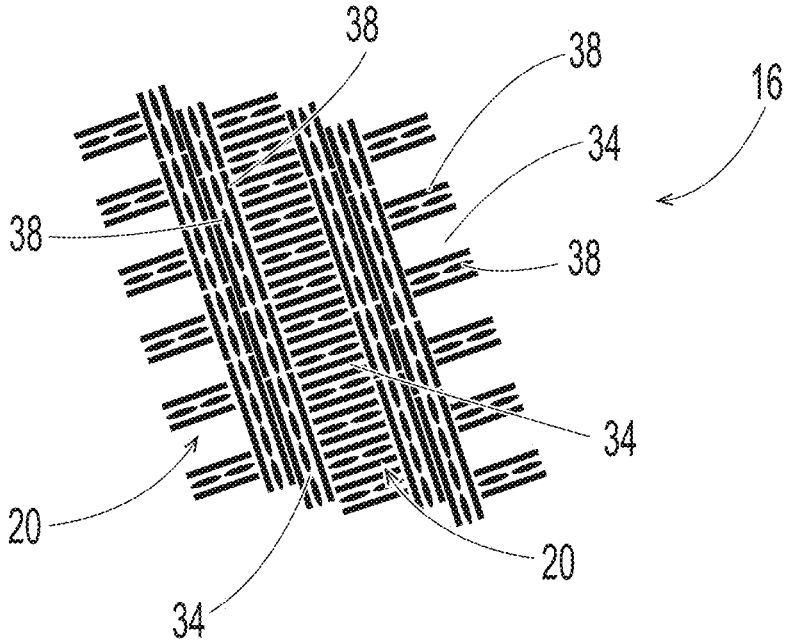
FIG. 23 is a schematic representation of a portion of a pattern of an example of a molding member according to the present invention having a continuous knuckle network and a plurality of discrete pillows used to produce a fibrous structure of the present invention.

FIG. 23 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 23, the continuous knuckle network 34 is not substantially uniform in width.

Figure 24:
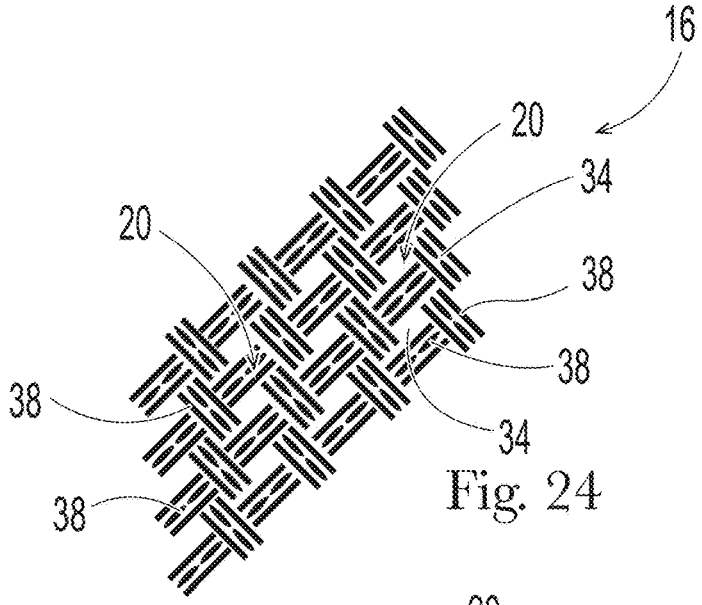
FIG. 24 is a schematic representation of a portion of a pattern of an example of a molding member according to the present invention having a continuous knuckle network and a plurality of discrete pillows used to produce a fibrous structure of the present invention.

FIG. 24 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 24, the continuous knuckle network 34 is not substantially uniform in width.

Figure 25:
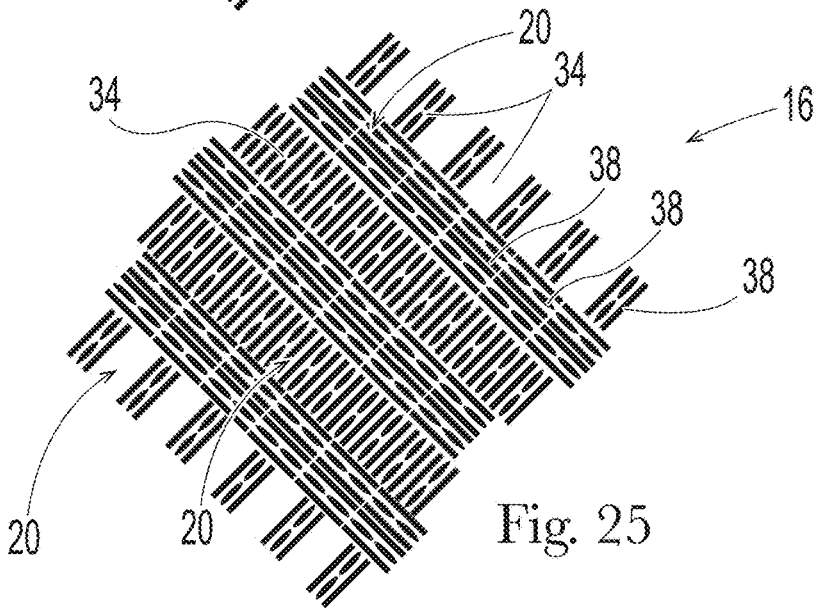
FIG. 25 is a schematic representation of a portion of a pattern of an example of a molding member according to the present invention having a continuous knuckle network and a plurality of discrete pillows used to produce a fibrous structure of the present invention.

FIG. 25 shows an example of another molding member 16 that produces a fibrous structure of the present invention 40. The molding member 16 comprises a continuous knuckle network 34, which is represented by the white continuous network, that imparts a continuous knuckle region 32 in a fibrous structure, and a plurality of discrete pillows 38, wherein at least two of the discrete pillows 38 have different lengths and/or shapes, both of which are represented by the black (darker) regions. As shown in FIG. 25, the continuous knuckle network 34 is not substantially uniform in width.

As shown above, examples of the fibrous structures of the present invention may comprise a surface comprising a surface pattern, wherein the surface pattern comprises a continuous knuckle region and a plurality of discrete pillow regions dispersed within the continuous knuckle region, wherein a repeat unit of the surface pattern comprises at least two groups of two or more discrete pillow regions, wherein the at least two groups are non-parallelly juxtaposed, for example the repeat unit is defined by two or more groups of two or more discrete pillow regions, wherein at least two of the two or more groups are non-parallelly juxtaposed.

As shown above, examples of the fibrous structures of the present invention may comprise a surface comprising a surface pattern, wherein the surface pattern comprises a continuous knuckle region and a plurality of discrete pillow regions dispersed within the continuous knuckle region, wherein a repeat unit of the surface pattern comprises at least two groups of two, for example three, or more discrete pillow regions, wherein at least one of the at least two groups comprises three or more discrete pillow regions and wherein the at least two groups are non-parallelly juxtaposed.

As shown above, examples of the fibrous structures of the present invention may comprise a surface comprising a surface pattern, wherein the surface pattern comprises a continuous knuckle region and a plurality of discrete pillow regions dispersed within the continuous knuckle region, wherein a repeat unit of the surface pattern comprises at least two groups of two or more discrete pillow regions, wherein the at least one of the two or more groups is oriented at an angle of from about 30° to about 85° and/or from about 45° to about 80° relative to the CD.

As shown above, examples of the fibrous structures of the present invention may comprise a surface comprising a surface pattern, wherein the surface pattern comprises a continuous knuckle region and a plurality of discrete pillow regions dispersed within the continuous knuckle region, wherein the surface pattern exhibits a concentration of discrete pillow regions within the surface pattern of less than 200 and/or less than 175 and/or less than 150 and/or less than 125 and/or less than 100 and/or less than 75 discrete pillow regions/in$^2$ and wherein at least 50% and/or at least 75% and/or at least 85% and/or at least 95% and/or 100% of the discrete pillow regions exhibit a discrete pillow region length to discrete pillow region width of at greater than 3 and/or greater than 3.1 and/or greater than 3.5 and/or greater than 4 and/or greater than 5 and/or greater than 6 and/or greater than 7, and optionally wherein a repeat unit of the surface pattern comprises at least two groups of two or more discrete pillow regions, and optionally wherein the at least two groups are non-parallelly juxtaposed.

As shown above, examples of the fibrous structures of the present invention comprise a surface comprising a surface pattern, wherein the surface pattern comprises a continuous knuckle region and a plurality of discrete pillow regions dispersed within the continuous knuckle region, wherein a repeat unit of the surface pattern comprises less than 20 discrete pillow regions, and optionally wherein the surface patter comprises at least two groups of two or more discrete pillow regions, and optionally wherein the at least two groups are non-parallelly juxtaposed.

Figure 26:
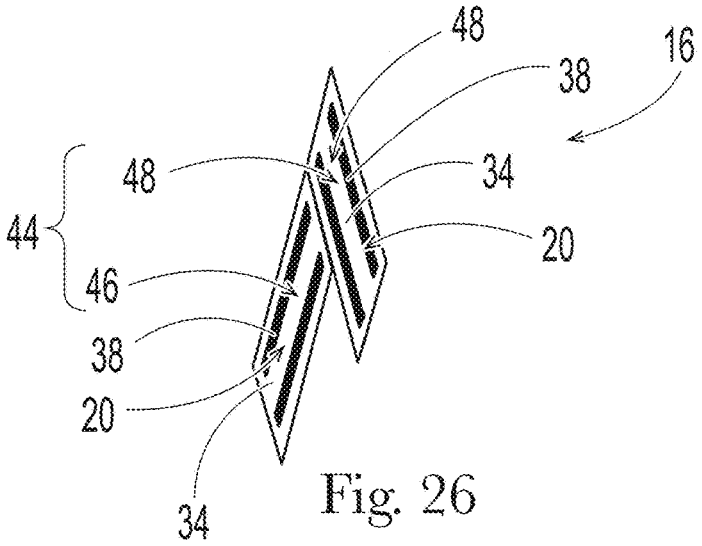
FIG. 26 is a schematic representation of a portion of a pattern of an example of a molding member according to the present invention having a continuous knuckle network and a plurality of discrete pillows used to produce a fibrous structure of the present invention.

The repeat unit of the surface pattern comprises at least two groups of two or more discrete pillow regions. As shown in FIG. 26, a repeat unit 44 of a molding member 16 comprises at least two groups of two or more discrete pillows that impart a surface pattern comprising a continuous knuckle region and a plurality of discrete pillow regions dispersed within the continuous knuckle region 34 (white region). The repeat unit 44 of FIG. 26 comprises a first group 46 comprising two or more discrete pillows 38 (in this case two discrete pillows, the black regions) and a second group 48 comprising two or more discrete pillows 38 (in this case two discrete pillows, the black regions), wherein the at least two groups 46, 48 of two or more discrete pillows 38 (in this case two groups of two discrete pillows) are non-parallelly juxtaposed.

Figure 27:
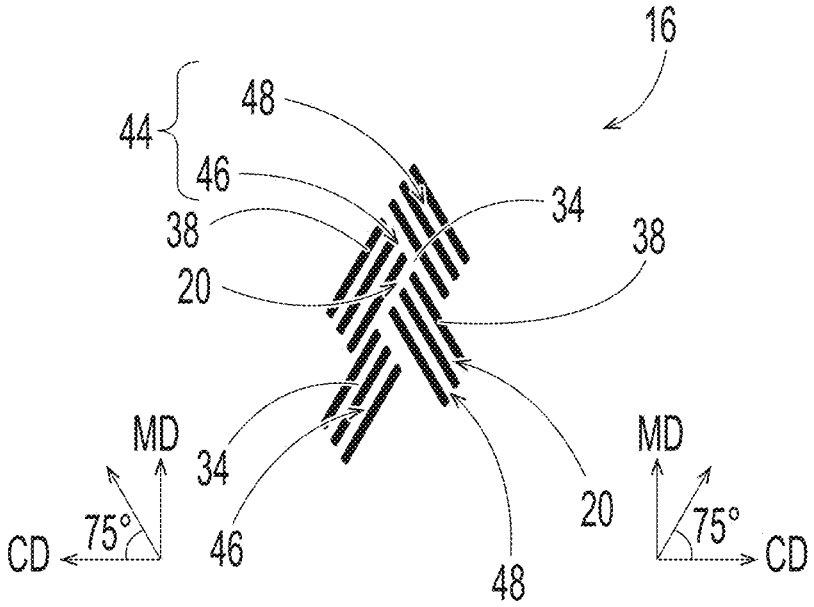
FIG. 27 is a schematic representation of a portion of a pattern of an example of a molding member according to the present invention having a continuous knuckle network and a plurality of discrete pillows used to produce a fibrous structure of the present invention.

The repeat unit of the surface pattern comprises at least two groups of two or more discrete pillow regions. As shown in FIG. 27, a repeat unit 44 of a molding member 16 comprises at least two groups of two or more discrete pillows that impart a surface pattern comprising a continuous knuckle region and a plurality of discrete pillow regions dispersed within the continuous knuckle region 34 (white region). The repeat unit 44 of FIG. 27 comprises a first group 46 comprising two or more discrete pillows 38 (in this case three discrete pillows, the black regions) and a second group 48 comprising two or more discrete pillows 38 (in this case three discrete pillows, the black regions), wherein the at least two groups 46, 48 of two or more discrete pillows 38 (in this case two groups of three discrete pillows, the black regions) are non-parallelly juxtaposed. Further, the repeat unit 44 is translated once such that the molding member 16 comprises four groups 46, 46, and 48, 48 of three discrete pillows 38.

Figure 28:
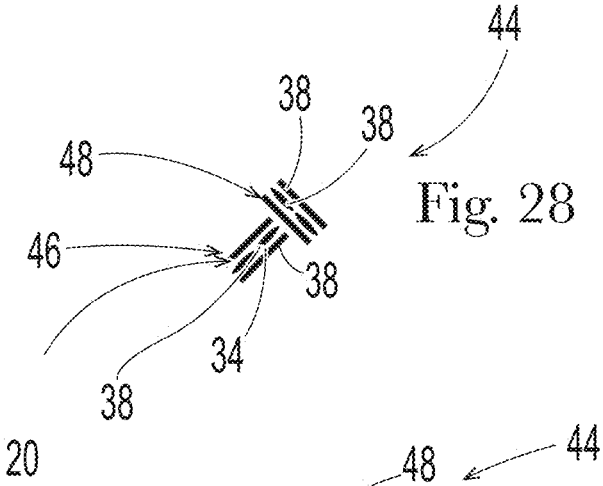
FIG. 28 is a schematic representation of a portion of a pattern of an example of a molding member according to the present invention having a continuous knuckle network and a plurality of discrete pillows used to produce a fibrous structure of the present invention.

In one example as shown in FIG. 28, a repeat unit 44 may comprise a first group 46 comprising two discrete pillows 38 (black regions) of a first pillow length and two discrete pillows 38 (black regions) of a second pillow length shorter than the first pillow length. The discrete pillows 38 are dispersed within a continuous knuckle region 34 (white region). The repeat unit 44 may comprise a second group 48 comprising two discrete pillows 38 of a first pillow length and two discrete pillows 38 of a second pillow length shorter than the first pillow length. The two groups 46, 48 of discrete pillows 38 are non-parallelly juxtaposed in a "T" formation.

Figure 29:
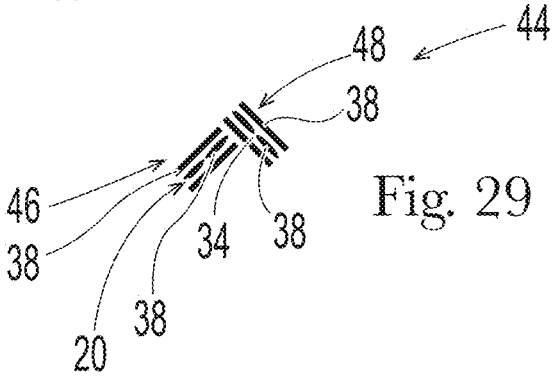
FIG. 29 is a schematic representation of a portion of a pattern of an example of a molding member according to the present invention having a continuous knuckle network and a plurality of discrete pillows used to produce a fibrous structure of the present invention.

In another example as shown in FIG. 29, a repeat unit 44 may comprise a first group 46 comprising two discrete pillows 38 (black regions) of a first pillow length and two discrete pillows 38 (black regions) of a second pillow length shorter than the first pillow length. The discrete pillows 38 are dispersed within a continuous knuckle region 34 (white region). The repeat unit 44 may comprise a second group 48 comprising two discrete pillows 38 of a first pillow length and two discrete pillows 38 of a second pillow length shorter than the first pillow length. The two groups 46, 48 of discrete pillows 38 are non-parallelly juxtaposed in a "L" formation.

Alternatively, or additionally, the discrete pillows 38 within a group, such as group 46 may be different lengths, different shapes, different widths, and/or other different dimensions of discrete pillows and/or discrete pillow regions described herein.

The repeat unit 44 of the present invention may be translated and/or rotated and/or reflected to form the pattern of the molding member 16 of the present invention in order to impart the surface patterns of the present invention to the surfaces of the fibrous structures of the present invention.

In one example, the fibrous structures of the present invention comprises a surface comprising a surface pattern, wherein the surface pattern comprises a continuous knuckle region and a plurality of discrete pillow regions dispersed within the continuous knuckle region, wherein a repeat unit of the surface pattern is defined by two or more groups of two or more discrete pillow regions, wherein the at least two of the two or more groups are non-parallelly juxtaposed, wherein at least two of the two or more discrete pillow regions within one of the at least two groups are parallel to one another.

Examples of non-parallelly juxtaposed groups and/or discrete pillow regions and/or discrete pillows in molding members are shown in FIGS. 10A-10C and 11-29.

In another example, the surface pattern of the fibrous structure may comprise two or more discrete pillow regions within at least two groups that are oriented at an angle of about 90°.

In another example, the surface pattern of the fibrous structure may comprise at least two groups of two or more discrete pillow regions, wherein the at least two groups are oriented at an angle of greater than 20° to less than 85° and/or greater than 30° to less than 85° and/or greater than 35° to less than 80° and/or from about 45° to about 75° to the fibrous structure's cross machine direction.

In another example, the surface pattern of the fibrous structure may comprise at least two discrete pillow regions that are non-parallelly juxtaposed.

In another example, the surface pattern of the fibrous structure may comprise at least two discrete pillow regions within at least two different groups that are non-parallelly juxtaposed.

In another example, the surface pattern of the fibrous structure may comprise at least one discrete pillow region and/or a plurality of discrete pillow regions and/or all discrete pillow regions that exhibit(s) an average discrete pillow region length of greater than 2 mm and/or greater than 3 mm and/or greater than 4 mm and/or greater than 5 mm and/or greater than 6 mm and/or greater than 7 mm and/or greater than 7.5 mm as measured according to the Micro-CT Intensive Property Measurement Test Method described herein.

In another example, the surface pattern of the fibrous structure may comprise at least one discrete pillow region within a group and/or a plurality of discrete pillow regions within a group and/or all discrete pillow regions within a group that exhibit(s) an average discrete pillow region length of greater than 2 mm and/or greater than 3 mm and/or greater than 4 mm and/or greater than 5 mm and/or greater than 6 mm and/or greater than 7 mm and/or greater than 7.5 mm as measured according to the Micro-CT Intensive Property Measurement Test Method described herein.

In another example, the surface pattern of the fibrous structure may comprise at least one discrete pillow region within two or more groups and/or a plurality of discrete pillow regions within two or more groups and/or all discrete pillow regions within two or more groups that exhibit(s) an average discrete pillow region length of greater than 2 mm and/or greater than 3 mm and/or greater than 4 mm and/or greater than 5 mm and/or greater than 6 mm and/or greater than 7 mm and/or greater than 7.5 mm as measured according to the Micro-CT Intensive Property Measurement Test Method described herein.

In another example, the surface pattern of the fibrous structure may comprise at least two groups that comprise at least one discrete pillow region and/or a plurality of discrete pillow regions and/or all discrete pillow regions that exhibit(s) an average discrete pillow region length of greater than 2 mm and/or greater than 3 mm and/or greater than 4 mm and/or greater than 5 mm and/or greater than 6 mm and/or greater than 7 mm and/or greater than 7.5 mm as measured according to the Micro-CT Intensive Property Measurement Test Method described herein.

In another example, the surface pattern of the fibrous structure may comprise at least two groups that comprise a plurality of discrete pillow regions in the at least two groups and/or all discrete pillow regions with the at least two groups that exhibit(s) an average discrete pillow region length of greater than 2 mm and/or greater than 3 mm and/or greater than 4 mm and/or greater than 5 mm and/or greater than 6 mm and/or greater than 7 mm and/or greater than 7.5 mm as measured according to the Micro-CT Intensive Property Measurement Test Method described herein.

In one example, the surface pattern of the fibrous structure may comprise at least two of the discrete pillow regions that are the same in one or more dimensions/properties/characteristics of discrete pillows and/or discrete pillow regions, for example length, width, shape, orientation, etc.

In one example, the surface pattern of the fibrous structure may comprise a plurality of the discrete pillow regions that are the same in one or more dimensions/properties/characteristics of discrete pillows and/or discrete pillow regions, for example length, width, shape, orientation, etc.

In one example, the surface pattern of the fibrous structure may comprise at least two of the discrete pillow regions within a group that are the same in one or more dimensions/properties/characteristics of discrete pillows and/or discrete pillow regions, for example length, width, shape, orientation, etc.

In one example, the surface pattern of the fibrous structure may comprise all of the discrete pillow regions within a group that are the same in one or more dimensions/properties/characteristics of discrete pillows and/or discrete pillow regions, for example length, width, shape, orientation, etc.

In one example, the surface pattern of the fibrous structure may comprise at least two of the discrete pillow regions within at least two groups that are the same in one or more dimensions/properties/characteristics of discrete pillows and/or discrete pillow regions, for example length, width, shape, orientation, etc.

In one example, the surface pattern of the fibrous structure may comprise all of the discrete pillow regions within at least two groups that are the same in one or more dimensions/properties/characteristics of discrete pillows and/or discrete pillow regions, for example length, width, shape, orientation, etc.

In one example, the surface pattern of the fibrous structure may comprise at least two of the discrete pillow regions that are different in one or more dimensions/properties/characteristics of discrete pillows and/or discrete pillow regions, for example length, width, shape, orientation, etc.

In one example, the surface pattern of the fibrous structure may comprise a plurality of the discrete pillow regions that are different in one or more dimensions/properties/characteristics of discrete pillows and/or discrete pillow regions, for example length, width, shape, orientation, etc.

In one example, the surface pattern of the fibrous structure may comprise at least two of the discrete pillow regions within a group that are different in one or more dimensions/properties/characteristics of discrete pillows and/or discrete pillow regions, for example length, width, shape, orientation, etc.

In one example, the surface pattern of the fibrous structure may comprise all of the discrete pillow regions within a group that are the different in one or more dimensions/properties/characteristics of discrete pillows and/or discrete pillow regions, for example length, width, shape, orientation, etc.

In one example, the surface pattern of the fibrous structure may comprise at least two of the discrete pillow regions within at least two groups that are different in one or more dimensions/properties/characteristics of discrete pillows and/or discrete pillow regions, for example length, width, shape, orientation, etc.

In one example, the surface pattern of the fibrous structure may comprise all of the discrete pillow regions within at least two groups that are different in one or more dimensions/properties/characteristics of discrete pillows and/or discrete pillow regions, for example length, width, shape, orientation, etc.

In one example, the surface pattern of the fibrous structure may comprise at least one of the discrete pillow regions exhibits an average discrete pillow region length to average discrete pillow region width ratio of at least 1.3 and/or at least 1.5 and/or at least 2 and/or at least 3 and/or at least 4 and/or at least 5 and/or at least 6 and/or at least 7 and/or at least 8 and/or at least 9 and/or at least 10 as measured according to the Micro-CT Intensive Property Measurement Test Method described herein.

In one example, the surface pattern of the fibrous structure may comprise at least one of the discrete pillow regions exhibits a discrete pillow region perimeter of greater than 12.7 mm and/or greater than 14 mm and/or greater than 16 mm and/or greater than 18 mm and/or greater than 20 mm and/or greater than 24 mm and/or greater than 28 mm as measured according to the Micro-CT Intensive Property Measurement Test Method described herein.

In one example, the surface pattern of the fibrous structure may comprise at least one of the discrete pillow regions exhibits a discrete pillow region perimeter to average knuckle (continuous knuckle) region width ratio of greater than 21 and/or greater than 25 and/or greater than 30 and/or greater than 35 and/or greater than 40 and/or greater than 45 and/or greater than 50 and/or greater than 55 as measured according to the Micro-CT Intensive Property Measurement Test Method described herein.

In one example, the surface pattern of the fibrous structure may comprise at least one of the discrete pillow regions exhibits an average discrete pillow region length to average knuckle (continuous knuckle) region width ratio of greater than 6.5 and/or greater than 7 and/or greater than 8 and/or greater than 10 and/or greater than 12 and/or greater than 15 and/or greater than 18 and/or greater than 20 as measured according to the Micro-CT Intensive Property Measurement Test Method described herein.

In one example, the fibrous structures of the present invention comprise a plurality of fibers, for example pulp fibers, such as wood pulp fibers and/or non-wood pulp fibers.

In one example, the fibrous structures of the present invention may comprise a structured fibrous structure, for example a through-air-dried fibrous structure ply, such as a creped through-air-dried fibrous structure ply and/or an uncreped through-air-dried fibrous structure ply. Other non-limiting examples of structured fibrous structures include fabric creped fibrous structure plies, belt creped fibrous structure plies, ATMOS fibrous structure plies, NTT fibrous structure plies, ETAD fibrous structure plies, QRT fibrous structure plies, and STT fibrous structure plies.

In one example, the fibrous structures of the present invention may comprise a surface pattern that comprises a regular pattern and/or a non-random, repeating pattern and/or a molded microscopical three-dimensional pattern.

Dimensions of discrete pillow regions of the present invention are related to the dimensions of the discrete pillows within the molding members since the discrete pillows impart the discrete pillow regions to the fibrous structures of the present invention.

In one example, the fibrous structures of the present invention may comprise a surface pattern that is wet-formed, for example during the papermaking process for making the fibrous structure.

The fibrous structures of the present invention may be employed as a fibrous structure ply or fibrous structure plies in single- and/or multi-ply sanitary tissue products, for example single- or multi-ply bath tissue products with one or more other fibrous structure plies.

The fibrous structures of the present invention may be convolutely rolled upon itself, with or without a core, to form a roll of fibrous structure and/or a roll of sanitary tissue product, such as a roll of bath tissue product.

Such rolls of fibrous structure and/or sanitary tissue products and/or bath tissue products may package in single roll or multi-roll formats. The package may be made from plastic, polywrap, paper, carton board, and/or other natural, biodegradable and/or compostable materials.

The fibrous structures and/or sanitary tissue products of the present invention may exhibit an average TS7 value of less than 10 and/or less than 9 and/or less than 8 and/or less than 7 and/or less than 6 and/or less than 5.5 and/or greater than 4 and/or greater than 4.5 and/or greater than 5 dB $V^2$ rms as measured according to the Emtec Test Method described herein.

The fibrous structures and/or sanitary tissue products of the present invention may be creped or uncreped.

The fibrous structures and/or sanitary tissue products of the present invention may be wet-laid or air-laid.

The fibrous structures and/or sanitary tissue products of the present invention may be embossed.

The fibrous structures and/or sanitary tissue products of the present invention may comprise a surface softening agent or be void of a surface softening agent. In one example, the sanitary tissue product is a non-lotioned sanitary tissue product, such as a sanitary tissue product comprising a non-lotioned fibrous structure ply, for example a non-lotioned through-air-dried fibrous structure ply, for example a non-lotioned creped through-air-dried fibrous structure ply and/or a non-lotioned uncreped through-air-dried fibrous structure ply. In yet another example, the sanitary tissue product may comprise a non-lotioned fabric creped fibrous structure ply and/or a non-lotioned belt creped fibrous structure ply.

The fibrous structures and/or sanitary tissue products of the present invention may comprise trichome fibers and/or may be void of trichome fibers.

The discrete pillows and/or discrete pillow regions and/or knuckle (continuous knuckle) and/or knuckle (continuous knuckle) region described herein are measured according to the Micro-CT Intensive Property Measurement Test Method described herein.

Figure 30A:
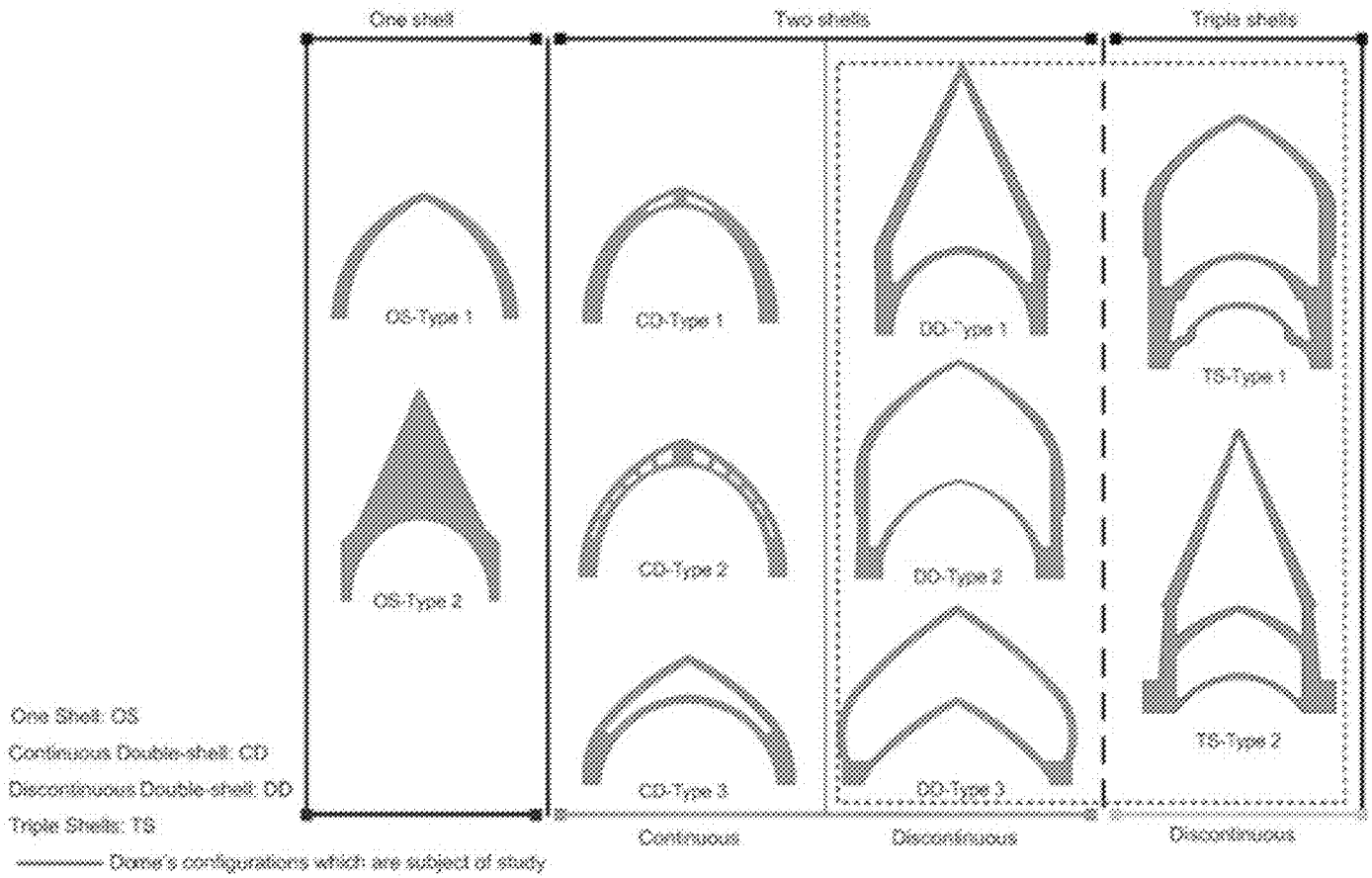
FIG. 30A is image of a table illustrating examples of domes, especially discontinuous multi-shell domes, such as discontinuous double-shell domes and discontinuous triple-shell domes, that are representative of the structures of at least one or more of the discrete pillows of the fibrous structures of the present invention.

In one example of the present invention, a fibrous structure and/or sanitary tissue product of the present invention comprises one or more, for example two or more, for example a plurality of discrete pillows that exhibit a discontinuous multi-shell dome as shown in FIG. 30A, for example a discontinuous double-shell dome, as generally described in FIG. 1 of ASHKAN, M. 2010. Discontinuous Double-shell Domes through Islamic eras in the Middle East and Central Asia: History, Morphology, Typologies, Geometry, and Construction. *Nexus Network Journal* 12: 287-319, incorporated herein by reference. Additional descriptions of discontinuous multi-shell domes, for example discontinuous double-shell domes, are described in GEORG, R. 2012. Historical Analysis of Arches and Modern Shells, A thesis submitted to the Faculty of the Graduate School of the University of Colorado.

Figure 30B:
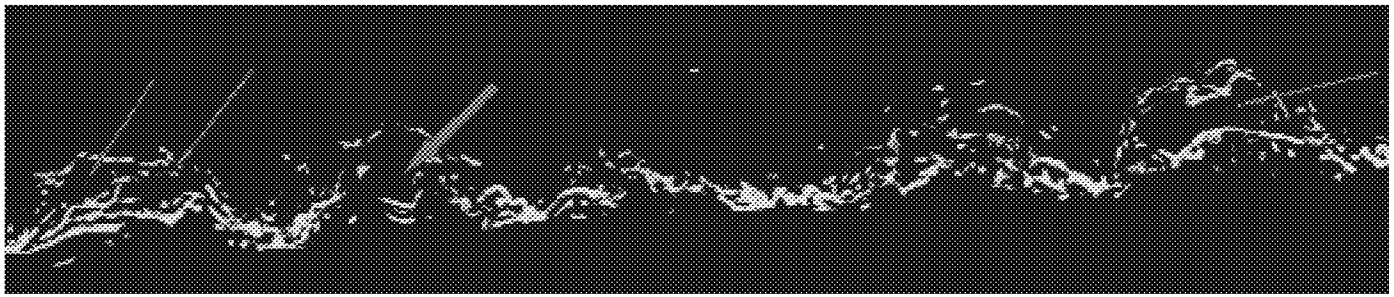
FIG. 30B is a cut plane micro-CT image of examples of discrete pillow regions comprising a discontinuous multi-shell (double-shell) domes within a fibrous structure according to the present invention.

In one example, the one or more discrete pillows of the fibrous structures of the present invention exhibit a top shell of the discontinuous double-shell dome (which forms a surface of the fibrous structure, a consumer contacting surface or a non-consumer contacting surface, the surface may be described as a fabric side out surface or a fabric side in surface where the pillows would not form a consumer contacting surface and may for an interior surface of a fibrous structure ply in a multi-ply fibrous structure configuration) that comprises hardwood fibers, for example hardwood pulp fibers, such as eucalyptus fibers, and/or non-wood fibers, for example non-wood pulp fibers, such as trichomes, and the bottom shell of the discontinuous double-shell dome As shown in FIG. 30B, a micro-CT cut plane of a fibrous structure of the present invention shows two or more discrete pillows identified by the arrows.

Figure 30C:
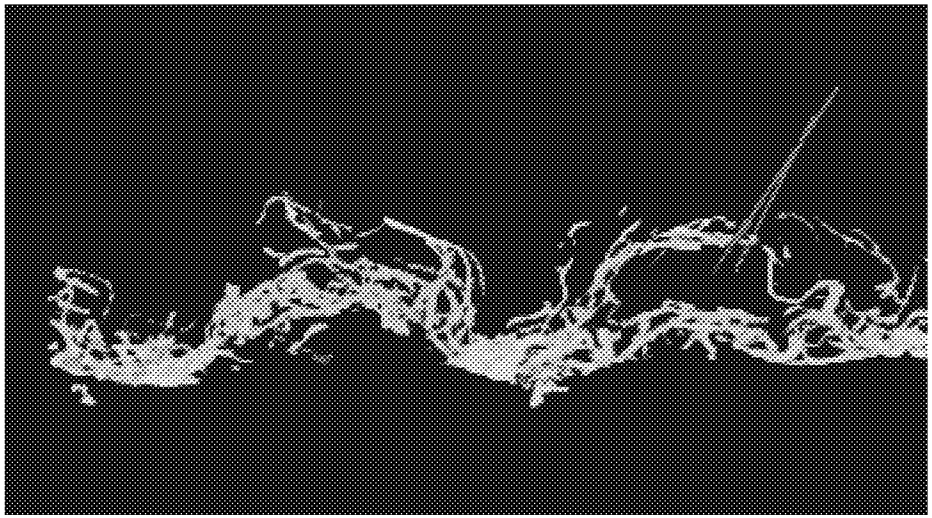
FIG. 30C is a cut plane micro-CT image of an example of a discrete pillow region comprising a discontinuous multi-shell (double-shell) domes within a fibrous structure according to the present invention.

As shown in FIG. 30C, a micro-CT cut plane of a fibrous structure of the present invention shows a discrete pillow identified by the arrows.

Figure 30D:
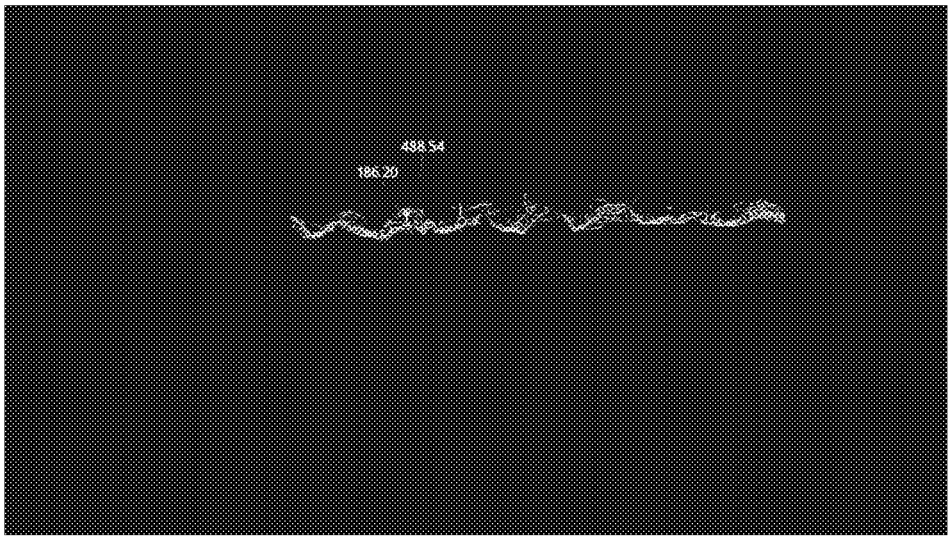
FIG. 30D is a cut plane micro-CT image of an example of a discrete pillow region comprising a discontinuous multi-shell (double-shell) domes within a fibrous structure according to the present invention, wherein the maximum height of the discrete pillow region and width of the pillow region are shown.
Figure 30E:
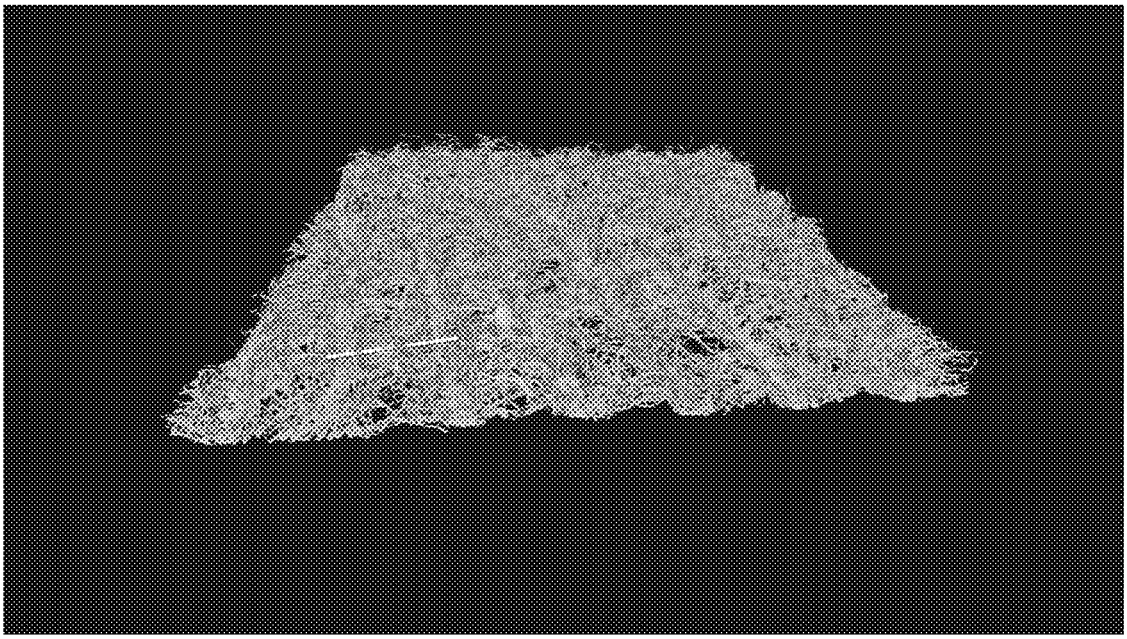
FIG. 30E is a perspective micro-CT image of an example of a fibrous structure comprising a discrete pillow region upon which a cut plane designation has been drawn and from which a cut plane according to the Micro-CT Intensive Property Measurement Test Method can be viewed.

As shown in FIGS. 30D and 30E, the measurement of the discontinuous multi-shell (in this case double-shell) dome of a discrete pillow of a fibrous structure, is made according to the Micro-CT Intensive Property Measurement Test Method described herein, wherein a cut plane designation is identified on a fibrous structure, for example a fibrous structure according to the present invention as shown by the line in FIG. 30E. A cut plane micro-CT image is then captured from the cut plane designation as shown in FIG. 30D according to the Micro-CT Intensive Property Measurement Test Method. The discrete pillow's maximum height cut plane is identified and the discrete pillow's maximum height is then measured from the maximum height cut plane. From this maximum height cut plane the discrete pillow's width is also measured.

In one example, a fibrous structure of the present invention comprises at least one discrete pillow that exhibits a maximum height of greater than 135 and/or greater than 145 and/or greater than 155 and/or greater than 165 and/or greater than 175 and/or greater than 185 and/or greater than 200 and/or greater than 225 and/or greater than 240 and/or greater than 260 and/or greater than 270 and/or at least 275 μm as measured according to the Micro-CT Intensive Property Measurement Test Method described herein.

In one example, a fibrous structure of the present invention comprises at least one discrete pillow that exhibits a width of greater than 250 and/or greater than 275 and/or greater than 300 and/or greater than 325 and/or greater than 350 and/or greater than 375 and/or greater than 400 and/or greater than 425 and/or greater than 450 and/or greater than 475 and/or greater than 485 μm as measured according to the Micro-CT Intensive Property Measurement Test Method described herein.

In one example, a fibrous structure of the present invention comprises at least one discrete pillow that exhibits a maximum height to width ratio of greater than 0.25 and/or greater than 0.30 and/or greater than 0.35 and/or greater than 0.40 and/or greater than 0.45 and/or greater than 0.50 and/or greater than 0.55 and/or greater than 0.60 and/or greater than 0.65 and/or greater than 0.70 and/or greater than 0.75 as measured according to the Micro-CT Intensive Property Measurement Test Method described herein.

In one example, a fibrous structure of the present invention comprises a plurality of discrete pillows that exhibit an average maximum height of greater than 125 and/or greater than 135 and/or greater than 145 and/or greater than 155 and/or greater than 165 and/or greater than 175 and/or greater than 185 and/or greater than 190 μm as measured according to the Micro-CT Intensive Property Measurement Test Method described herein.

In one example, a fibrous structure of the present invention comprises a plurality of discrete pillows that exhibit an average width of greater than 280 and/or greater than 290 and/or greater than 300 and/or greater than 325 and/or greater than 350 and/or greater than 375 and/or greater than 400 and/or greater than 425 and/or greater than 450 and/or greater than 475 and/or greater than 485 μm as measured according to the Micro-CT Intensive Property Measurement Test Method described herein.

In one example, a fibrous structure of the present invention comprises at least one discrete pillow that exhibits an average maximum height to average width ratio of greater than 0.25 and/or greater than 0.30 and/or greater than 0.35 and/or greater than 0.40 and/or greater than 0.45 and/or greater than 0.50 and/or greater than 0.55 and/or greater than 0.60 and/or greater than 0.65 and/or greater than 0.70 and/or greater than 0.75 as measured according to the Micro-CT Intensive Property Measurement Test Method described herein.

As shown in Table 1 below, the maximum heights of discrete pillows, widths, ratios and averages thereof of the discrete pillows of a fibrous structure according to the present invention made on a molding member as shown in FIG. 10C and as measured according to the Micro-CT Intensive Property Measurement Test Method are set forth. In addition, Table 1 sets forth the maximum heights of a semi-continuous pillow, widths, ratios and averages thereof that are present in a commercially available Charmin® Ultra Soft made in 2020.

TABLE 1

| Invention (FIG. 10C) | | Charmin ® Ultra Soft (2020) | | Invention (FIG. 10C) | Charmin ® Ultra Soft (2020) |
|---|---|---|---|---|---|
| Height (μm) | Width (μm) | Height (μm) | Width (μm) | Height:Width Ratio | Height:Width Ratio |
| 149 | 456 | 119 | 296 | 0.33 | 0.40 |
| 176 | 334 | 111 | 315 | 0.53 | 0.35 |
| 150 | 425 | 99 | 214 | 0.35 | 0.46 |

TABLE 1-continued

| Invention (FIG. 10C) | | Charmin ® Ultra Soft (2020) | | Invention (FIG. 10C) | Charmin ® Ultra Soft (2020) |
|---|---|---|---|---|---|
| Height (μm) | Width (μm) | Height (μm) | Width (μm) | Height:Width Ratio | Height:Width Ratio |
| 186 | 489 | 143 | 262 | 0.38 | 0.55 |
| 211 | 409 | 100 | 289 | 0.52 | 0.35 |
| 275 | 348 | 125 | 246 | 0.79 | 0.51 |
| Avg | Avg | Avg | Avg | Avg | Avg |
| 191 | 410 | 116 | 270 | 0.48 | 0.44 |

As shown in Table 2 below, pillow and knuckle properties measured according to the Micro-CT Intensive Property Measurement Test Method of inventive fibrous structures made on molding members as shown in FIG. 11 and FIG. 10C and a commercially available Charmin® Ultra Soft 2019 product containing semi-continuous pillows are set forth.

TABLE 2

| | Charmin ® Ultra Soft (2019) | Invention (FIG. 11) | Invention (FIG. 10C) |
|---|---|---|---|
| Average Pillow Basis Weight (gsm) | 29.38 | 25.28 | 25.35 |
| Average Pillow Thickness (μm) | 224.6 | 177.2 | 194.2 |
| Average Pillow Volumetric Density (g/cm$^3$) | 0.1702 | 0.1842 | 0.1796 |
| Average Knuckle Basis Weight (gsm) | 27.12 | 28.82 | 34.49 |
| Average Knuckle Thickness (gsm) | 99.8 | 79.4 | 109.1 |
| Average Knuckle Volumetric Density (g/cm$^3$) | 0.3388 | 0.4674 | 0.3705 |
| Knuckle Density/Pillow Density Ratio | 1.9906 | 2.5375 | 2.0629 |
| Knuckle Basis Weight/Pillow Basis Weight Ratio | 0.92 | 1.14 | 1.36 |
| Knuckle Thickness/Pillow Thickness Ratio | 0.4 | 0.4 | 0.6 |

As shown by the data in Table 2, the inventive fibrous structures showed higher Average Knuckle Basis Weight values than the Charmin® Ultra Soft 2019 product. Without wishing to be bound by theory, this difference is believed to result from the knuckle angle relative to the CD for the inventive fibrous structures made on the molding members shown in FIGS. 11 and 10C are lower than the knuckle angle relative to the CD for the Charmin® Ultra Soft 2019 product. As a result, when these inventive fibrous structures are creped during their creping process, the knuckle width is foreshortened more than the knuckle width of the Charmin® Ultra Soft 2019 product, which leads to high knuckle basis weight values. This high knuckle basis weight value also leads to higher knuckle volumetric density, a higher ratio of knuckle density/pillow density, and a higher ratio of knuckle basis weight/pillow basis weight. Not to be bound by theory, in one example of the present invention, it is believe that when making fabric side out fibrous structures and/or sanitary tissue products with lower density pillow on the consumer-facing surface, it is desirable to concentrate the knuckle basis weight in a smaller area to allow for more of the overall weight of the sheet to be concentrated in the lower density pillows in order to drive improved softness.

In one example of the present invention, a fibrous structure comprises a knuckle, for example a continuous knuckle network, and one or more discrete pillows, for example a plurality of discrete pillows dispersed within the continuous knuckle network wherein the knuckle and/or one or more pillows exhibit one or more of the following properties as measured according to the Micro-CT Intensive Property Measurement Test Method described herein:

a. an Average Pillow Basis Weight of less than 29 and/or less than 28 and/or less than 27 and/or less than 26 and/or less than 25.5 gsm;
b. an Average Pillow Thickness of less than 220 and/or less than 215 and/or less than 210 and/or less than 205 and/or less than 200 and/or less than 195 and/or less than 190 and/or less than 185 and/or less than 180 μm;
c. an Average Pillow Volumetric Density of greater than 0.175 and/or greater than 0.179 and/or greater than 0.180 and/or greater than 0.182 and/or greater than 0.184 $g/cm^3$;
d. an Average Knuckle Basis Weight of greater than 27.5 and/or greater than 28.0 and/or greater than 28.5 and/or greater than 29.0 and/or greater than 29.5 and/or greater than 30.0 and/or greater than 31.0 and/or greater than 32.0 and/or greater than 33.0 and/or greater than 34.0 and/or greater than 34.25 gsm;
e. an Average Knuckle Thickness of greater than 100.0 and/or greater than 102.0 and/or greater than 104.0 and/or greater than 106.0 and/or greater than 108.0 and/or greater than 109.0 μm;
f. an Average Knuckle Volumetric Density of greater than 0.345 and/or greater than 0.350 and/or greater than 0.365 and/or greater than 0.380 and/or greater than 0.400 and/or greater than 0.420 and/or greater than 0.440 and/or greater than 0.460 $g/cm^3$;
g. a Knuckle Density/Pillow Density Ratio of greater than 2.00 and/or greater than 2.05 and/or greater than 2.10 and/or greater than 2.15 and/or greater than 2.20 and/or greater than 2.25 and/or greater than 2.30 and/or greater than 2.35 and/or greater than 2.40 and/or greater than 2.45 and/or greater than 2.50;
h. a Knuckle Basis Weight/Pillow Basis Weight Ratio of greater than 0.95 and/or greater than 1.00 and/or greater than 1.05 and/or greater than 1.10 and/or greater than 1.13 and/or greater than 1.20 and/or greater than 1.25 and/or greater than 1.30 and/or greater than 1.35; and
i. a Knuckle Thickness/Pillow Thickness Ratio of greater than 0.45 and/or greater than 0.50 and/or greater than 0.55 and/or at least 0.6.

Molding Members

The fibrous structures and/or sanitary tissue products of the present invention and/or fibrous structure plies employed in the sanitary tissue products of the present invention are formed on molding members, for example patterned molding members, that result in the fibrous structures and/or sanitary tissue products of the present invention. In one example, the molding member comprises a non-random repeating pattern. In another example, the molding member comprises a resinous pattern.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

As described herein, a non-limiting example of a molding member suitable for use in the present invention may comprise a through-air-drying belt comprising resin on a surface of and/or locked onto (for example a portion of the resin penetrates through) a reinforcing element in a pattern.

Without wishing to be bound by theory, foreshortening (dry & wet crepe, fabric crepe, rush transfer, etc.) is an integral part of fibrous structure and/or sanitary tissue paper making, helping to produce the desired balance of strength, stretch, softness, absorbency, etc. Fibrous structure support, transport and molding members used in the papermaking process, such as rolls, wires, felts, fabrics, belts, etc. have been variously engineered to interact with foreshortening to further control the fibrous structure and/or sanitary tissue product properties.

Non-Limiting Examples of Making Fibrous Structures and/or Sanitary Tissue Products In one example, the method for making the fibrous structures and/or sanitary tissue products of the present invention may be a fibrous structure and/or sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

Figure 31:
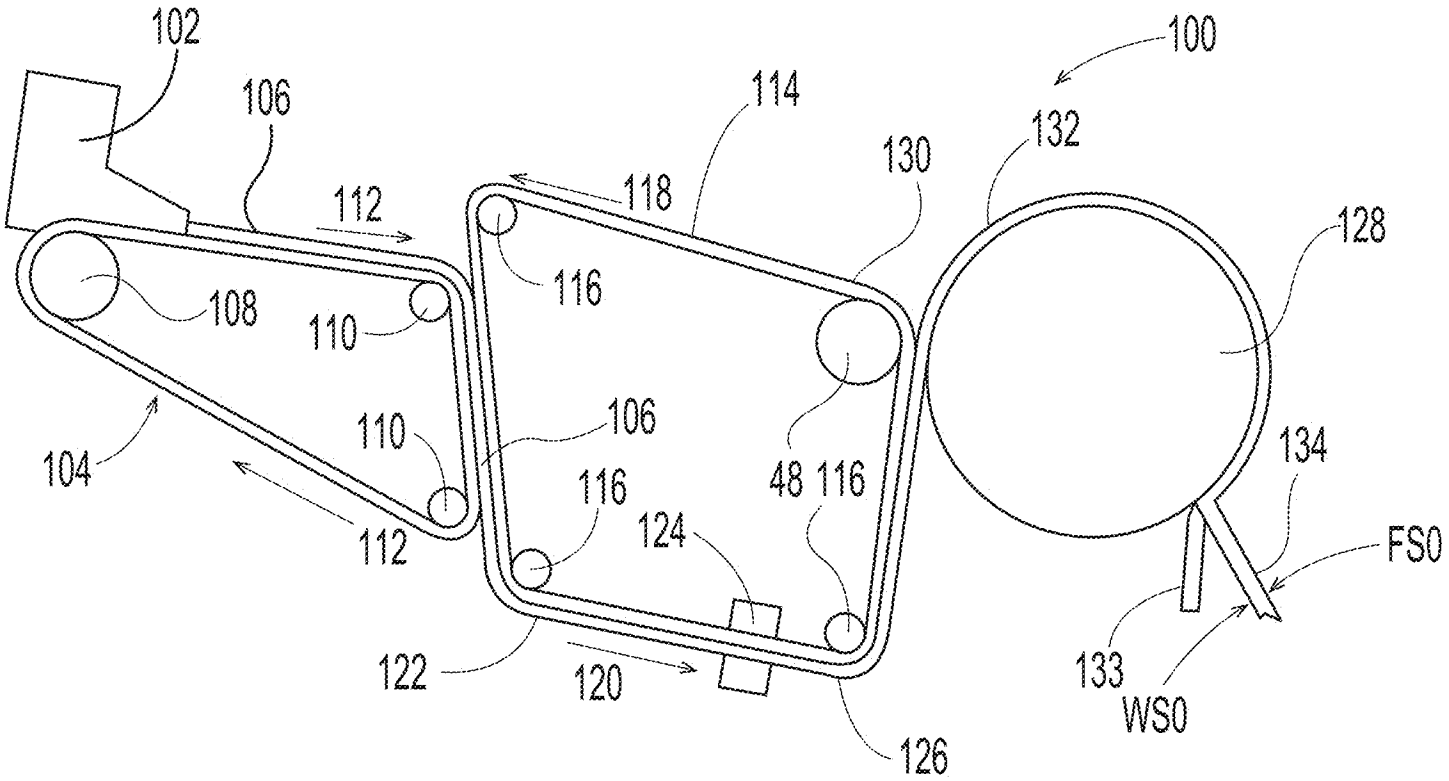
FIG. 31 is a schematic representation of an example of a through-air-drying papermaking process for making a fibrous structure and/or sanitary tissue product according to the present invention.

As shown in FIG. 31, one example of a process and equipment, represented as 100 for making a sanitary tissue product according to the present invention comprises supplying an aqueous dispersion of fibers (a fibrous furnish or fiber slurry) to a headbox 102 which can be of any convenient design. From headbox 102 the aqueous dispersion of fibers is delivered to a first foraminous member 104 which is typically a Fourdrinier wire, to produce an embryonic fibrous structure 106.

The first foraminous member 104 may be supported by a breast roll 108 and a plurality of return rolls 110 of which only two are shown. The first foraminous member 104 can be propelled in the direction indicated by directional arrow 112 by a drive means, not shown. Optional auxiliary units and/or devices commonly associated fibrous structure making machines and with the first foraminous member 104, but not shown, include forming boards, hydrofoils, vacuum boxes, tension rolls, support rolls, wire cleaning showers, and the like.

After the aqueous dispersion of fibers is deposited onto the first foraminous member 104, embryonic fibrous structure 106 is formed, typically by the removal of a portion of the aqueous dispersing medium by techniques well known to those skilled in the art. Vacuum boxes, forming boards, hydrofoils, and the like are useful in effecting water removal. The embryonic fibrous structure 106 may travel with the first foraminous member 104 about return roll 110 and is brought into contact with a patterned molding member 114, such as a 3D patterned through-air-drying belt. While in contact with the patterned molding member 114, the embryonic fibrous structure 106 will be deflected, rearranged, and/or further dewatered.

The patterned molding member 114 may be in the form of an endless belt. In this simplified representation, the patterned molding member 114 passes around and about patterned molding member return rolls 116 and impression nip roll 118 and may travel in the direction indicated by directional arrow 120. Associated with patterned molding member 114, but not shown, may be various support rolls, other return rolls, cleaning means, drive means well known to those skilled in the art that may be commonly used in fibrous structure making machines.

After the embryonic fibrous structure 106 has been associated with the patterned molding member 114, fibers within the embryonic fibrous structure 106 are deflected into pillows and/or pillow network ("deflection conduits") present in the patterned molding member 114. In one example of this process step, there is essentially no water removal from the embryonic fibrous structure 106 through the deflection conduits after the embryonic fibrous structure 106 has been associated with the patterned molding member 114 but prior to the deflecting of the fibers into the deflection conduits. Further water removal from the embryonic fibrous structure 106 can occur during and/or after the time the fibers are being deflected into the deflection conduits. Water removal from the embryonic fibrous structure 106 may continue until the consistency of the embryonic fibrous structure 106 associated with patterned molding member 114 is increased to from about 25% to about 35%. Once this consistency of the embryonic fibrous structure 106 is achieved, then the embryonic fibrous structure 106 can be referred to as an intermediate fibrous structure 122. During the process of forming the embryonic fibrous structure 106, sufficient water may be removed, such as by a noncompressive process, from the embryonic fibrous structure 106 before it becomes associated with the patterned molding member 114 so that the consistency of the embryonic fibrous structure 116 may be from about 10% to about 30%.

While applicants decline to be bound by any particular theory of operation, it appears that the deflection of the fibers in the embryonic fibrous structure and water removal from the embryonic fibrous structure begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous structure, may cause an apparent increase in surface area of the embryonic fibrous structure. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous structure. This decrease in fiber mobility may tend to fix and/or freeze the fibers in place after they have been deflected and rearranged. Of course, the drying of the fibrous structure in a later step in the process of this invention serves to more firmly fix and/or freeze the fibers in position.

Any convenient means conventionally known in the papermaking art can be used to dry the intermediate fibrous structure 122. Examples of such suitable drying process include subjecting the intermediate fibrous structure 122 to conventional and/or flow-through dryers and/or Yankee dryers.

In one example of a drying process, the intermediate fibrous structure 122 in association with the patterned molding member 114 passes around the patterned molding member return roll 116 and travels in the direction indicated by directional arrow 120. The intermediate fibrous structure 122 may first pass through an optional predryer 124. This predryer 124 can be a conventional flow-through dryer (hot air dryer) well known to those skilled in the art. Optionally, the predryer 124 can be a so-called capillary dewatering apparatus. In such an apparatus, the intermediate fibrous structure 122 passes over a sector of a cylinder having preferential-capillary-size pores through its cylindrical-shaped porous cover. Optionally, the predryer 124 can be a combination capillary dewatering apparatus and flow-through dryer. The quantity of water removed in the predryer 124 may be controlled so that a predried fibrous structure 126 exiting the predryer 124 has a consistency of from about 30% to about 98%. The predried fibrous structure 126, which may still be associated with patterned molding member 114, may pass around another patterned molding member return roll 116 and as it travels to an impression nip roll 118. As the predried fibrous structure 126 passes through the nip formed between impression nip roll 118 and a surface of a Yankee dryer 128, the pattern formed by the top surface 130 of patterned molding member 114 is impressed into the predried fibrous structure 126 to form a 3D patterned fibrous structure 132. The imprinted fibrous structure 132 can then be adhered to the surface of the Yankee dryer 128 where it can be dried to a consistency of at least about 95%.

The 3D patterned fibrous structure 132 can then be foreshortened by creping the 3D patterned fibrous structure 132 with a creping blade 133 to remove the 3D patterned fibrous structure 132 from the surface of the Yankee dryer 128 resulting in the production of a 3D patterned creped fibrous structure 134 in accordance with the present invention. As used herein, foreshortening refers to the reduction in length of a dry (having a consistency of at least about 90% and/or at least about 95%) fibrous structure which occurs when energy is applied to the dry fibrous structure in such a way that the length of the fibrous structure is reduced and the fibers in the fibrous structure are rearranged with an accompanying disruption of fiber-fiber bonds. Foreshortening can be accomplished in any of several well-known ways. One common method of foreshortening is creping. The 3D patterned creped fibrous structure 134 may be subjected to post processing steps such as calendaring, tuft generating operations, and/or embossing and/or converting.

Figure 32:
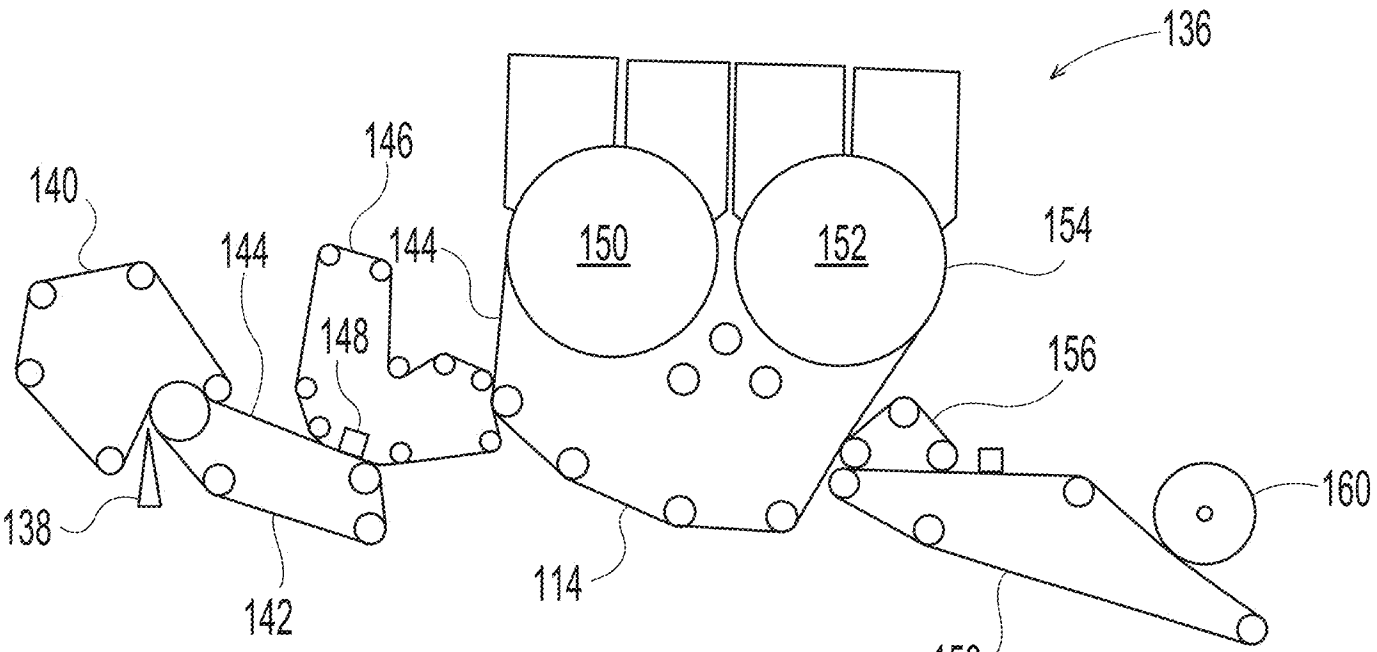
FIG. 32 is a schematic representation of an example of an uncreped through-air-drying papermaking process for making a fibrous structure and/or sanitary tissue product according to the present invention.

Another example of a papermaking process for making the sanitary tissue products of the present invention is illustrated in FIG. 32. FIG. 32 illustrates an uncreped through-air-drying process 136. In this example, a multi-layered headbox 138 deposits an aqueous suspension of papermaking fibers between forming wires 140 and 142 to form an embryonic fibrous structure 144. The embryonic fibrous structure 144 is transferred to a slower moving transfer fabric 146 with the aid of at least one vacuum box 148. The level of vacuum used for the fibrous structure transfers can be from about 3 to about 15 inches of mercury (76 to about 381 millimeters of mercury). The vacuum box 148 (negative pressure) can be supplemented or replaced by the use of positive pressure from the opposite side of the embryonic fibrous structure 144 to blow the embryonic fibrous structure 144 onto the next fabric in addition to or as a replacement for sucking it onto the next fabric with vacuum. Also, a vacuum roll or rolls can be used to replace the vacuum box(es) 148.

The embryonic fibrous structure 144 is then transferred to a molding member 114 of the present invention, such as a through-air-drying fabric, and passed over through-air-dryers 150 and 152 to dry the embryonic fibrous structure 144 to form a 3D patterned fibrous structure 154. While supported by the molding member 114, the 3D patterned fibrous structure 154 is finally dried to a consistency of about 94% percent or greater. After drying, the 3D patterned fibrous structure 154 is transferred from the molding member 114 to fabric 156 and thereafter briefly sandwiched between fabrics 156 and 158. The dried 3D patterned fibrous structure 154 remains with fabric 158 until it is wound up at the reel 160 ("parent roll") as a finished fibrous structure. Thereafter, the finished 3D patterned fibrous structure 154 can be unwound, calendered and converted into the sanitary tissue product of the present invention, such as a roll of bath tissue, in any suitable manner.

Figure 33:
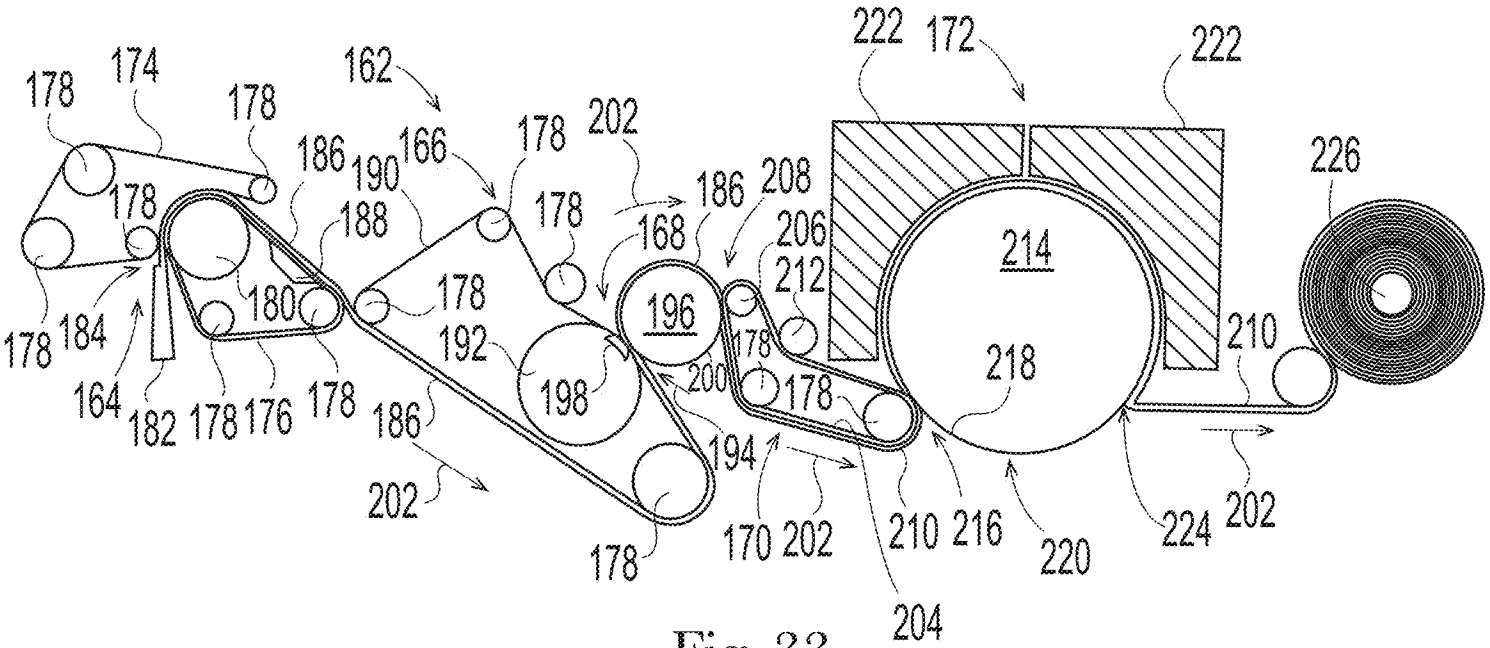
FIG. 33 is a schematic representation of an example of fabric creped papermaking process for making a fibrous structure and/or sanitary tissue product according to the present invention.

Yet another example of a papermaking process for making the sanitary tissue products of the present invention is illustrated in FIG. 33. FIG. 33 illustrates a papermaking machine 162 having a conventional twin wire forming section 164, a felt run section 166, a shoe press section 168, a molding member section 170, in this case a creping fabric section, and a Yankee dryer section 172 suitable for practicing the present invention. Forming section 164 includes a pair of forming fabrics 174 and 176 supported by a plurality of rolls 178 and a forming roll 180. A headbox 182 provides papermaking furnish to a nip 184 between forming roll 180 and roll 178 and the fabrics 174 and 176. The furnish forms an embryonic fibrous structure 186 which is dewatered on the fabrics 174 and 176 with the assistance of vacuum, for example, by way of vacuum box 188.

The embryonic fibrous structure 186 is advanced to a papermaking felt 190 which is supported by a plurality of rolls 178 and the felt 190 is in contact with a shoe press roll 192. The embryonic fibrous structure 186 is of low consistency as it is transferred to the felt 190. Transfer may be assisted by vacuum; such as by a vacuum roll if so desired or a pickup or vacuum shoe as is known in the art. As the embryonic fibrous structure 186 reaches the shoe press roll 192 it may have a consistency of 10-25% as it enters the shoe press nip 194 between shoe press roll 192 and transfer roll 196. Transfer roll 196 may be a heated roll if so desired. Instead of a shoe press roll 192, it could be a conventional suction pressure roll. If a shoe press roll 192 is employed it is desirable that roll 178 immediately prior to the shoe press roll 192 is a vacuum roll effective to remove water from the felt 190 prior to the felt 190 entering the shoe press nip 194 since water from the furnish will be pressed into the felt 190 in the shoe press nip 194. In any case, using a vacuum roll at the roll 178 is typically desirable to ensure the embryonic fibrous structure 186 remains in contact with the felt 190 during the direction change as one of skill in the art will appreciate from the diagram.

The embryonic fibrous structure 186 is wet-pressed on the felt 190 in the shoe press nip 194 with the assistance of pressure shoe 198. The embryonic fibrous structure 186 is thus compactively dewatered at the shoe press nip 194, typically by increasing the consistency by 15 or more points at this stage of the process. The configuration shown at shoe press nip 194 is generally termed a shoe press; in connection with the present invention transfer roll 196 is operative as a transfer cylinder which operates to convey embryonic fibrous structure 186 at high speed, typically 1000 feet/minute (fpm) to 6000 fpm to the patterned molding member section 170 of the present invention, for example a through-air-drying fabric section, also referred to in this process as a creping fabric section.

Transfer roll 196 has a smooth transfer roll surface 200 which may be provided with adhesive and/or release agents if needed. Embryonic fibrous structure 186 is adhered to transfer roll surface 200 which is rotating at a high angular velocity as the embryonic fibrous structure 186 continues to advance in the machine-direction indicated by arrows 202. On the transfer roll 196, embryonic fibrous structure 186 has a generally random apparent distribution of fiber.

Embryonic fibrous structure 186 enters shoe press nip 194 typically at consistencies of 10-25% and is dewatered and dried to consistencies of from about 25 to about 70% by the time it is transferred to the molding member 204 according to the present invention, which in this case is a patterned creping fabric, as shown in the diagram.

Molding member 204 is supported on a plurality of rolls 178 and a press nip roll 206 and forms a molding member nip 208, for example fabric crepe nip, with transfer roll 196 as shown.

The molding member 204 defines a creping nip over the distance in which molding member 204 is adapted to contact transfer roll 196; that is, applies significant pressure to the embryonic fibrous structure 186 against the transfer roll 196. To this end, backing (or creping) press nip roll 206 may be provided with a soft deformable surface which will increase the length of the creping nip and increase the fabric creping angle between the molding member 204 and the embryonic fibrous structure 186 and the point of contact or a shoe press roll could be used as press nip roll 206 to increase effective contact with the embryonic fibrous structure 186 in high impact molding member nip 208 where embryonic fibrous structure 186 is transferred to molding member 204 and advanced in the machine-direction 202. By using different equipment at the molding member nip 208, it is possible to adjust the fabric creping angle or the takeaway angle from the molding member nip 208. Thus, it is possible to influence the nature and amount of redistribution of fiber, delamination/debonding which may occur at molding member nip 208 by adjusting these nip parameters. In some embodiments it may by desirable to restructure the z-direction interfiber characteristics while in other cases it may be desired to influence properties only in the plane of the fibrous structure. The molding member nip parameters can influence the distribution of fiber in the fibrous structure in a variety of directions, including inducing changes in the z-direction as well as the MD and CD. In any case, the transfer from the transfer roll to the molding member is high impact in that the fabric is traveling slower than the fibrous structure and a significant velocity change occurs. Typically, the fibrous structure is creped anywhere from 10-60% and even higher during transfer from the transfer roll to the molding member.

Molding member nip 208 generally extends over a molding member nip distance of anywhere from about ⅛" to about 2", typically ½" to 2". For a molding member 204, for example creping fabric, with 32 CD strands per inch, embryonic fibrous structure 186 thus will encounter anywhere from about 4 to 64 weft filaments in the molding member nip 208.

The nip pressure in molding member nip 208, that is, the loading between roll 206 and transfer roll 196 is suitably 20-100 pounds per linear inch (PLI).

After passing through the molding member nip 208, and for example fabric creping the embryonic fibrous structure 186, a 3D patterned fibrous structure 210 continues to advance along MD 202 where it is wet-pressed onto Yankee cylinder (dryer) 214 in transfer nip 216. Transfer at nip 216 occurs at a 3D patterned fibrous structure 210 consistency of generally from about 25 to about 70%. At these consistencies, it is difficult to adhere the 3D patterned fibrous structure 210 to the Yankee cylinder surface 218 firmly enough to remove the 3D patterned fibrous structure 210 from the molding member 204 thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee dryer is not achieved.

It has been found in accordance with the present invention that the use of particular adhesives cooperate with a moderately moist fibrous structure (25-70% consistency) to adhere it to the Yankee dryer sufficiently to allow for high velocity operation of the system and high jet velocity impingement air drying. In this connection, a poly(vinyl alcohol)/polyamide adhesive composition as noted above is applied at 220 as needed.

The 3D patterned fibrous structure is dried on Yankee cylinder 214 which is a heated cylinder and by high jet velocity impingement air in Yankee hood 222. As the Yankee cylinder 214 rotates, 3D patterned fibrous structure 210 is creped from the Yankee cylinder 214 by creping doctor blade 224 and wound on a take-up roll 226. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference: U.S. Pat. No. 5,865,955 of Ilvespaaet et al. U.S. Pat. No. 5,968,590 of Ahonen et al. U.S. Pat. No. 6,001,421 of Ahonen et al. U.S. Pat. No. 6,119,362 of Sundqvist et al. U.S. patent application Ser. No. 09/733,172, entitled Wet Crepe, Impingement-Air Dry Process for Making Absorbent Sheet, now U.S. Pat. No. 6,432,267. A through drying unit as is well known in the art and described in U.S. Pat. No. 3,432,936 to Cole et al., the disclosure of which is incorporated herein by reference as is U.S. Pat. No. 5,851,353 which discloses a can-drying system.

Figure 34:
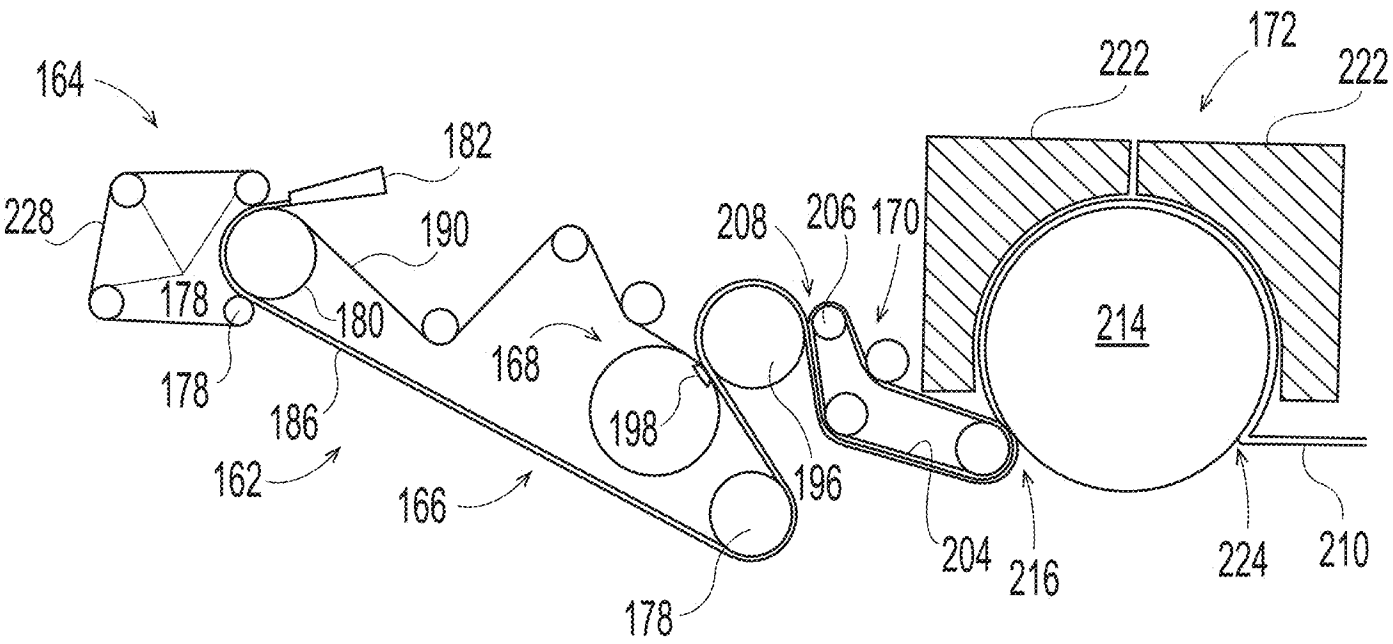
FIG. 34 is a schematic representation of another example of a fabric creped papermaking process for making a fibrous structure and/or sanitary tissue product according to the present invention.

There is shown in FIG. 34 a papermaking machine 162, similar to FIG. 33, for use in connection with the present invention. Papermaking machine 162 is a three fabric loop machine having a forming section 164 generally referred to in the art as a crescent former. Forming section 164 includes a forming wire 228 supported by a plurality of rolls such as rolls 178. The forming section 164 also includes a forming roll 180 which supports paper making felt 190 such that embryonic fibrous structure 186 is formed directly on the felt 190. Felt run 166 extends to a shoe press section 168 wherein the moist embryonic fibrous structure 186 is deposited on a transfer roll 196 (also referred to sometimes as a backing roll) as described above. Thereafter, embryonic fibrous structure 186 is creped onto molding member 204, such as a crepe fabric, in molding member nip 208 before being deposited on Yankee dryer 214 in another press nip 216. The papermaking machine 162 may include a vacuum turning roll, in some embodiments; however, the three loop system may be configured in a variety of ways wherein a turning roll is not necessary. This feature is particularly important in connection with the rebuild of a paper machine inasmuch as the expense of relocating associated equipment i.e. pulping or fiber processing equipment and/or the large and expensive drying equipment such as the Yankee dryer or plurality of can dryers would make a rebuild prohibitively expensive unless the improvements could be configured to be compatible with the existing facility.

Figure 35:
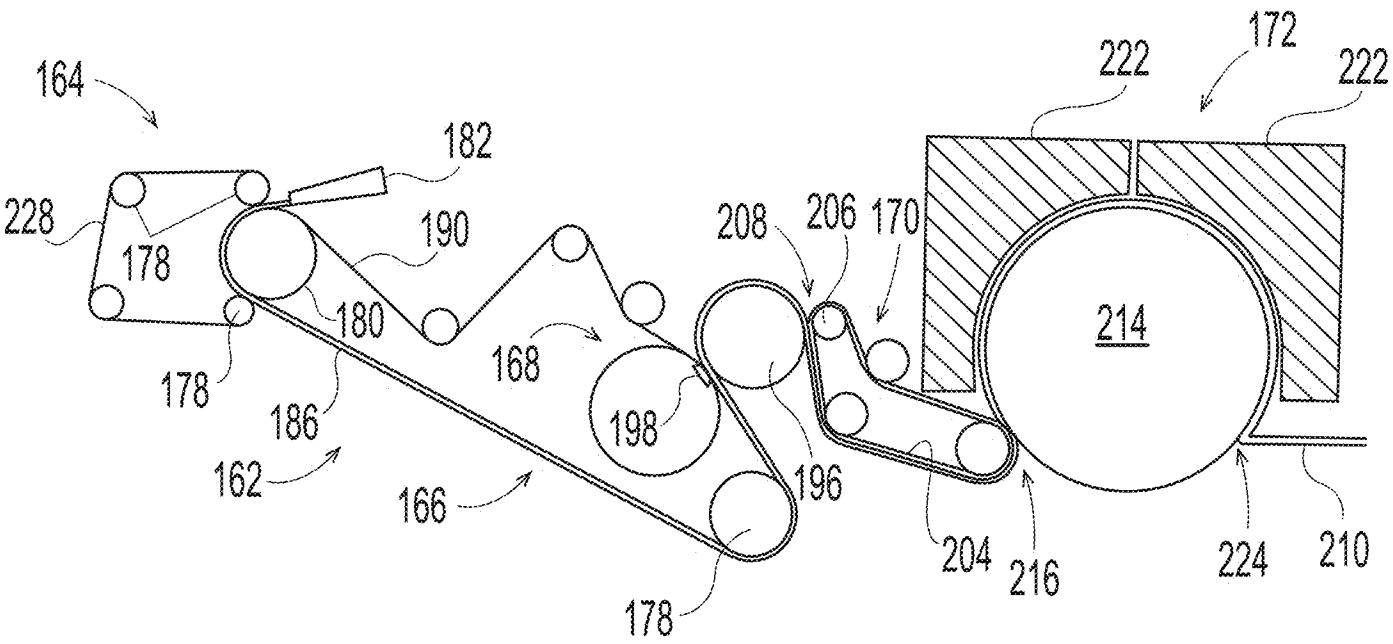
FIG. 35 is a schematic representation of an example of belt creped papermaking process for making a fibrous structure and/or sanitary tissue product according to the present invention.

FIG. 35 shows another example of a papermaking process to make the sanitary tissue products of the present invention. FIG. 35 illustrates a papermaking machine 162 for use in connection with the present invention. Papermaking machine 162 is a three fabric loop machine having a forming section 164, generally referred to in the art as a crescent former. Forming section 164 includes headbox 182 depositing a furnish on forming wire 174 supported by a plurality of rolls 178. The forming section 164 also includes a forming roll 180, which supports papermaking felt 190, such that embryonic fibrous structure 186 is formed directly on felt 190. Felt run 166 extends to a shoe press section 168 wherein the moist embryonic fibrous structure 186 is deposited on a transfer roll 196 and wet-pressed concurrently with the transfer. Thereafter, embryonic fibrous structure 186 is transferred to the molding member section 170, by being transferred to and/or creped onto molding member 204 of the present invention, for example a through-air-drying belt, in molding member nip 208, for example belt crepe nip, before being optionally vacuum drawn by suction box (not shown) and then deposited on Yankee dryer 214 in another press nip 216 using a creping adhesive, as noted above. Transfer to a Yankee dryer from the creping belt differs from conventional transfers in a conventional wet press (CWP) from a felt to a Yankee. In a CWP process, pressures in the transfer nip may be 500 PLI (87.6 kN/meter) or so, and the pressured contact area between the Yankee surface and the fibrous structure is close to or at 100%. The press roll may be a suction roll which may have a P&J hardness of 25-30. On the other hand, a belt crepe process of the present invention typically involves transfer to a Yankee with 4-40% pressured contact area between the fibrous structure and the Yankee surface at a pressure of 250-350 PLI (43.8-61.3 kN/meter). No suction is applied in the transfer nip, and a softer pressure roll is used, P&J hardness 35-45. The papermaking machine may include a suction roll, in some embodiments; however, the three loop system may be configured in a variety of ways wherein a turning roll is not necessary. This feature is particularly important in connection with the rebuild of a paper machine in as much as the expense of relocating associated equipment, i.e., the headbox, pulping or fiber processing equipment and/or the large and expensive drying equipment, such as the Yankee dryer or plurality of can dryers, would make a rebuild prohibitively expensive, unless the improvements could be configured to be compatible with the existing facility.

In addition to the above methods for making fibrous structures, the fibrous structures of the present invention may also be made on other papermaking machines and process such as the ETAD process as described in U.S. Pat. Nos. 7,339,378, 7,442,278, and 7,494,563 all of which are incorporated herein by reference; the NTT process as described in WO 2009/061079 A1, US Patent Application Publication No. 2011/0180223 A1, and US Patent Application Publication No. 2010/0065234 A1 all of which are incorporated herein by reference; the QRT process as described in US Patent Application Publication No. 2008/0156450 A1 and U.S. Pat. Nos. 7,811,418, 8,871,060 all of which are incorporated herein by reference; the STT process as disclosed in U.S. Pat. No. 7,887,673 incorporated herein by reference; the ATMOS process as described in U.S. Pat. Nos. 7,744,726, 6,821,391, 7,387,706, 7,351,307, 7,951,269, 8,118,979, 8,440,055, 7,951,269 or U.S. Pat. Nos. 8,118,979, 8,440,055, 8,196,314, 8,402,673, 8,435,384, 8,544,184, 8,382,956, 8,580,083, 7,476,293, 7,510,631, 7,686,923, 7,931,781, 8,075,739, 8,092,652, 7,905,989, 7,582,187, 7,691,230 all of which are incorporated herein by reference.

In addition, molding members, such as structuring belts used for NTT, QRT, and ETAD and their methods for making are described in U.S. Pat. No. 8,980,062, U.S. Patent Application Publication No. US 2010/0236034, WO 2009/067079 A1, and US Patent Application Publication No. 2010/0065234 A1 all of which are incorporated by reference.

Dimensions of the Fibrous Structures and/or Molding Member Surface Patterns

Table 3 below sets forth dimensions of the molding member surface patterns used to make the fibrous structures of the present invention along with dimensions of prior art molding members used to make prior art fibrous structures as measured according to the Micro-CT Intensive Property Measurement Test Method described herein.

TABLE 3

Figure 4:
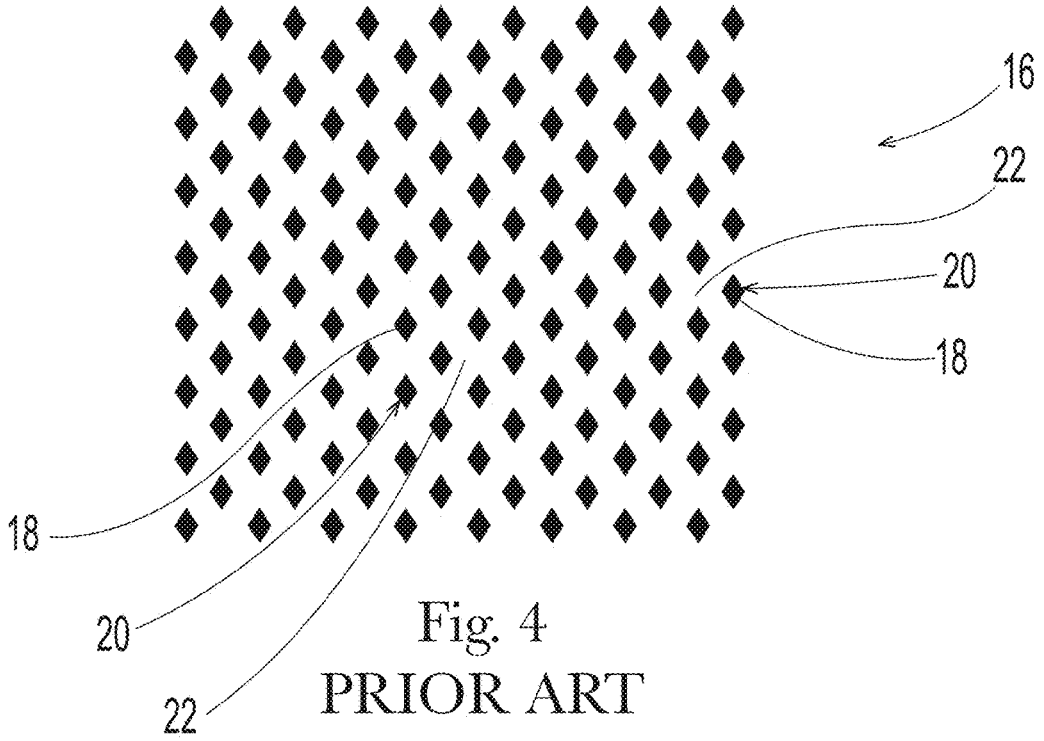
Fig. 4 PRIOR ART
FIG. 4 is a schematic representation of a portion of the pattern of a prior art molding member having a continuous pillow network and a plurality of discrete knuckles used to produce a prior art fibrous structure.
Figure 5:
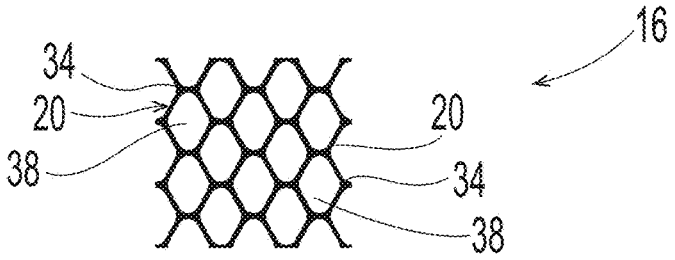
Fig. 5 PRIOR ART
FIG. 5 is a schematic representation of a portion of the pattern of a prior art molding member having a continuous knuckle network and a plurality of discrete pillows used to produce a prior art fibrous structure.
Figure 6:
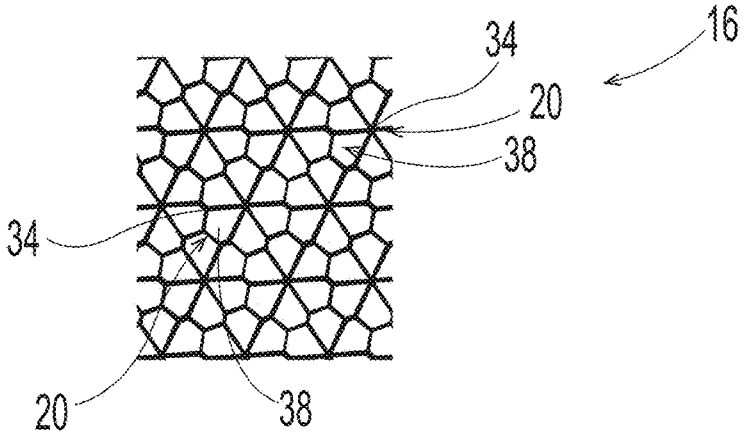
Fig. 6 PRIOR ART
FIG. 6 is a schematic representation of a portion of the pattern of a prior art molding member having a continuous knuckle network and a plurality of discrete pillows used to produce a prior art fibrous structure.
Figure 7:
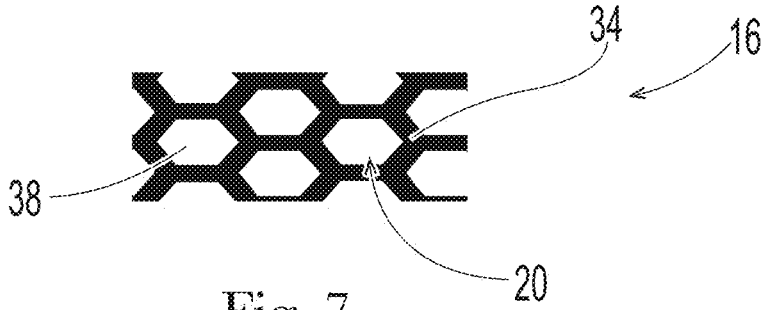
Fig. 7 PRIOR ART
FIG. 7 is a schematic representation of a portion of the pattern of a prior art molding member having a continuous knuckle network and a plurality of discrete pillows used to produce a prior art fibrous structure.
Figure 8:
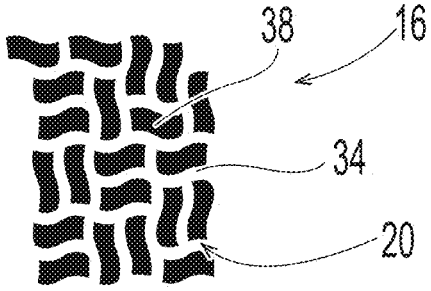
Fig. 8 PRIOR ART
FIG. 8 is a schematic representation of a portion of the pattern of a prior art molding member having a continuous knuckle network and a plurality of discrete pillows used to produce a prior art fibrous structure.
Figure 9A:
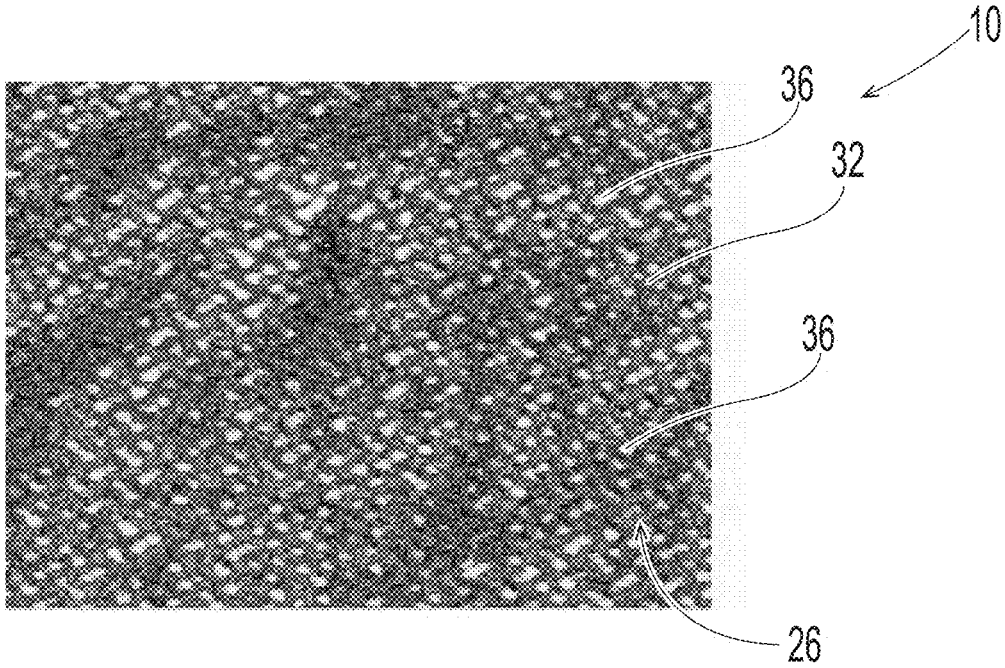
Fig. 9A PRIOR ART
FIG. 9A is a MikroCAD image of a prior art fibrous structure having a surface pattern having a continuous knuckle region and a plurality of discrete pillow regions, but are void of groups of two or more discrete pillow regions.
Figure 9B:
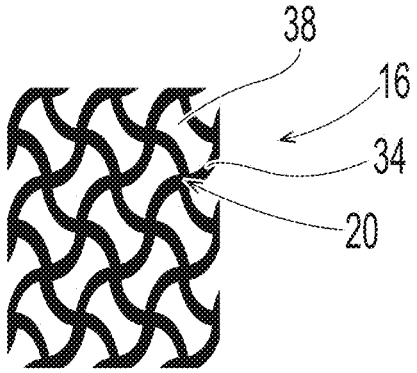
Fig. 9B PRIOR ART
FIG. 9B is a schematic representation of a portion of the pattern of a prior art molding member having a continuous knuckle network and a plurality of discrete pillows used to produce the prior art fibrous structure of FIG. 9A.

| Molding Member | Average Continuous Knuckle Width (mm) | Maximum Continuous Knuckle Width (mm) | Minimum Continuous Knuckle Width (mm) | Standard Deviation of the Continuous Knuckle Width (mm) | Relative Standard Deviation of the Continuous Knuckle Width (%) |
|---|---|---|---|---|---|
| Invention-FIG. 10C | 0.41 | 0.41 | 0.41 | 0.00 | 0% |
| Invention-FIG. 11 | 0.38 | 0.38 | 0.38 | 0.00 | 0% |
| Prior Art FIG. 7 | 0.30 | 0.30 | 0.30 | 0.00 | 0% |
| Similar to Prior Art FIG. 7 | — | 0.33 | 0.32 | — | — |
| Prior Art FIG. 9B | 0.55 | 0.55 | 0.55 | 0.00 | 0% |
| Prior Art FIG. 8 | 0.31 | 0.31 | 0.31 | 0.00 | 0% |
| Prior Art FIG. 6 | 0.33 | 0.33 | 0.33 | 0.00 | 0% |
| Prior Art FIG. 5 | — | 0.35 | 0.30 | — | — |
| Prior Art-U.S. Pat. No. 8,968,516 FIG. 4 | — | — | — | — | — |
| Prior Art-U.S. Pat No. 8,968,516 FIG. 5 | — | — | — | — | — |

| Molding Member | Average Discrete Pillow Width (mm) | Maximum Discrete Pillow Width (mm) | Minimum Discrete Pillow Width (mm) | Standard Deviation of the Discrete Pillow Width (mm) | Relative Standard Deviation of the Discrete Pillow Width (%) |
|---|---|---|---|---|---|
| Invention-FIG. 10C | 0.93 | 0.93 | 0.93 | 0.00 | 0% |
| Invention-FIG. 11 | 0.93 | 0.93 | 0.93 | 0.00 | 0% |
| Prior Art FIG. 7 | — | 1.06 | — | — | — |
| Similar to Prior Art FIG. 7 | — | 0.79 | — | — | — |
| Prior Art FIG. 9B | 1.52 | 2.10 | 1.14 | 0.37 | 24% |
| Prior Art FIG. 8 | 0.56 | 0.56 | 0.56 | 0.00 | 0% |
| Prior Art FIG. 6 | 1.69 | 2.68 | 0.50 | 0.75 | 44% |
| Prior Art FIG. 5 | 1.91 | 2.59 | 1.19 | 0.53 | 28% |
| Prior Art-U.S. Pat. No. 8,968,516 FIG. 4 | 0.71 | 0.71 | 0.71 | 0.00 | 0% |
| Prior Art-U.S. Pat No. 8,968,516 FIG. 5 | 0.41 | 0.41 | 0.41 | 0.00 | 0% |

TABLE 3-continued

| Molding Member | Average Discrete Pillow Length (mm) | Discrete Pillow Perimeter (mm) | Average Discrete Pillow Length/Average Discrete Pillow Width (mm/mm) | Average Discrete Pillow Length/Maximum Discrete Pillow Width (mm/mm) | Average Discrete Pillow Length/Minimum Discrete Pillow Width (mm/mm) |
|---|---|---|---|---|---|
| Invention-FIG. 10C | 8.51 | 18.88 | 9.15 | 9.15 | 9.15 |
| Invention-FIG. 11 | 9.58 | 21.01 | 10.33 | 10.33 | 10.33 |
| Prior Art FIG. 7 | 1.22 | — | — | 1.15 | — |
| Similar to Prior Art FIG. 7 | 1.12 | — | — | 1.41 | — |
| Prior Art FIG. 9B | 3.51 | 10.06 | 2.30 | 1.67 | 3.09 |
| Prior Art FIG. 8 | 1.42 | 3.96 | 2.56 | 2.56 | 2.56 |
| Prior Art FIG. 6 | 3.30 | 9.99 | 1.95 | 1.23 | 6.67 |
| Prior Art FIG. 5 | 3.51 | 10.84 | 1.83 | 1.35 | 2.95 |
| Prior Art-U.S. Pat. No. 8,968,516 FIG. 4 | 1.50 | 4.42 | 2.11 | 2.11 | 2.11 |
| Prior Art-U.S. Pat. No. 8,968,516 FIG. 5 | 0.99 | 2.79 | 2.44 | 2.44 | 2.44 |

| Molding Member | Individual Pillow Perimeter/Maximum Knuckle Width | Individual Pillow Perimeter/Minimum Knuckle Width | Individual Pillow Perimeter/Average Knuckle Width |
|---|---|---|---|
| Invention-FIG. 10C | 45.60 | 45.60 | 45.60 |
| Invention-FIG. 11 | 55.13 | 55.13 | 55.13 |
| Prior Art FIG. 7 | — | — | — |
| Similar to Prior Art FIG. 7 | — | — | — |
| Prior Art FIG. 9B | 18.25 | 18.25 | 18.25 |
| Prior Art FIG. 8 | 12.56 | 12.56 | 12.56 |
| Prior Art FIG. 6 | 30.48 | 30.48 | 30.48 |
| Prior Art FIG. 5 | 31.37 | 35.56 | — |
| Prior Art-U.S. Pat. No. 8,968,516 FIG. 4 | — | — | — |
| Prior Art-U.S. Pat. No. 8,968,516 FIG. 5 | — | — | — |

| Molding Member | Average Pillow Length/Average Knuckle Width | Average Pillow Length/Maximum Knuckle Width | Average Pillow Length/Minimum Knuckle Width |
|---|---|---|---|
| Invention-FIG. 10C | 20.55 | 20.55 | 20.55 |
| Invention-FIG. 11 | 25.13 | 25.13 | 25.13 |
| Prior Art FIG. 7 | 4.04 | 4.04 | 4.04 |
| Similar to Prior Art FIG. 7 | — | 3.36 | 3.52 |
| Prior Art FIG. 9B | 6.36 | 6.36 | 6.36 |
| Prior Art FIG. 8 | 4.52 | 4.52 | 4.52 |
| Prior Art FIG. 6 | 10.08 | 10.08 | 10.08 |
| Prior Art FIG. 5 | | 10.15 | 11.50 |
| Prior Art-U.S. Pat. No. 8,968,516 FIG. 4 | — | — | — |
| Prior Art-U.S. Pat. No. 8,968,516 FIG. 5 | — | — | — |

NON-LIMITING EXAMPLES OF METHODS FOR MAKING SANITARY TISSUE PRODUCTS OF THE PRESENT INVENTION

Example 1

Through-Air-Drying Belt (Continuous Knuckle, Fabric Side Out, 75 Degree Knuckle Orientation Relative to CD)

The following Example illustrates a non-limiting example for a preparation of a sanitary tissue product comprising a fibrous structure according to the present invention on a pilot-scale Fourdrinier fibrous structure making (papermaking) machine.

An aqueous slurry of eucalyptus (Suzano Papel e Celulose Brazilian bleached hardwood kraft pulp) pulp fibers is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top chamber of a multi-layered, three-chambered headbox of a Fourdrinier wet-laid papermaking machine.

Additionally, an aqueous slurry of eucalyptus (Suzano Papel e Celulose Brazilian bleached hardwood kraft pulp) pulp fibers is prepared at about 1.5% fiber by weight using a conventional repulper, then transferred to a hardwood fiber stock chest. The eucalyptus fiber slurry of the hardwood stock chest is pumped through a stock pipe and mixed with the aqueous slurry of Northern Softwood Kraft (NSK), described in the next paragraph, to a fan pump where the slurry consistency is reduced from about 1.5% by fiber weight to about 0.15% by fiber weight. The 0.15% eucalyptus/NSK slurry is then pumped and distributed in the center and bottom chamber of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center and bottom chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.25% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber. The NSK/Eucalyptus fiber slurry is directed to the center and bottom headbox chambers. All three fiber layers are delivered simultaneously in superposed relation onto the Fourdrinier wire to form thereon a three-layer embryonic fibrous structure (web), of which about 40% of the top side is made up of the eucalyptus fibers, about 17% is made of the eucalyptus fibers in the center and bottom layers, and about 43% is made up of the NSK fibers in the center and bottom layers. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 18-22% at the point of transfer, to a 3D patterned, continuous knuckle, through-air-drying belt as shown in FIG. 11. The speed of the 3D patterned through-air-drying belt is 800 feet per minute (fpm), which is the same speed of the Fourdrinier wire. The 3D patterned through-air-drying belt is designed to yield a fibrous structure comprising a pattern of continuous high density knuckle region oriented approximately 75 Degrees relative to the cross direction. Each continuous high density knuckle region oriented approximately 75 Degrees relative to the cross direction is separated by a low density discrete pillow region oriented approximately 75 Degrees relative to the cross direction. This 3D patterned through-air-drying belt is formed by casting a layer of an impervious resin surface of a continuous knuckle onto a fiber mesh supporting fabric. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-44), about 20% CREPETROL® 5688. CREPETROL® 5688 is commercially available from Solenis. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275-350° F. and a speed of about 800 fpm. The fibrous structure is wound in a roll (parent roll) using a surface driven reel drum having a surface speed of about 600-700 fpm.

Two parent rolls of the fibrous structure are then converted into a sanitary tissue product by loading the roll of fibrous structure into an unwind stand. The two parent rolls are converted with the low density pillow side out. The line speed is 550 ft/min. One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.5% of a proprietary quaternary amine softener is added to the top side of the multi-ply sanitary tissue product. Approximately 0.5% of a proprietary quaternary amine softener is added to the bottom side of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The molding member used to make the multi-ply sanitary tissue product of this example exhibits the dimensions shown in Table 1 above.

Example 2

Through-Air-Drying Belt (Continuous Knuckle, Fabric Side Out, 45 Degree Knuckle Orientation Relative to CD)

The following Example illustrates a non-limiting example for a preparation of a sanitary tissue product comprising a fibrous structure according to the present invention on a pilot-scale Fourdrinier fibrous structure making (papermaking) machine.

An aqueous slurry of eucalyptus (Suzano Papel e Celulose Brazilian bleached hardwood kraft pulp) pulp fibers is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top chamber of a multi-layered, three-chambered headbox of a Fourdrinier wet-laid papermaking machine.

Additionally, an aqueous slurry of eucalyptus (Suzano Papel e Celulose Brazilian bleached hardwood kraft pulp) pulp fibers is prepared at about 1.5% fiber by weight using a conventional repulper, then transferred to a hardwood fiber stock chest. The eucalyptus fiber slurry of the hardwood stock chest is pumped through a stock pipe and mixed with the aqueous slurry of Northern Softwood Kraft (NSK), described in the next paragraph, to a fan pump where the slurry consistency is reduced from about 1.5% by fiber weight to about 0.15% by fiber weight. The 0.15% eucalyptus/NSK slurry is then pumped and distributed in the center and bottom chamber of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center and bottom chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.25% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber. The NSK/Eucalyptus fiber slurry is directed to the center and bottom headbox chambers. All three fiber layers are delivered simultaneously in superposed relation onto the Fourdrinier wire to form thereon a three-layer embryonic fibrous structure (web), of which about 40% of the top side is made up of the eucalyptus fibers, about 17% is made of the eucalyptus fibers in the center and bottom layers, and about 43% is made up of the NSK fibers in the center and bottom layers. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 18-22% at the point of transfer, to a 3D patterned, continuous knuckle, through-air-drying belt as shown in FIG. 10C. The speed of the 3D patterned through-air-drying belt is 800 feet per minute (fpm), which is the same speed of the Fourdrinier wire. The 3D patterned through-air-drying belt is designed to yield a fibrous structure as shown in FIGS. 10A and 10B comprising a pattern of continuous high density knuckle region oriented approximately 45 Degrees relative to the cross direction. Each continuous high density knuckle region oriented approximately 45 Degrees relative to the cross direction is separated by a low density discrete pillow region oriented approximately 45 Degrees relative to the cross direction. This 3D patterned through-air-drying belt is formed by casting a layer of an impervious resin surface of a continuous knuckle onto a fiber mesh supporting fabric. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-44), about 20% CREPETROL® 5688. CREPETROL® 5688 is commercially available from Solenis. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275-350° F. and a speed of about 800 fpm. The fibrous structure is wound in a roll (parent roll) using a surface driven reel drum having a surface speed of about 600-700 fpm.

Two parent rolls of the fibrous structure are then converted into a sanitary tissue product by loading the roll of fibrous structure into an unwind stand. The two parent rolls are converted with the low density pillow side out. The line speed is 550 ft/min. One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.5% of a proprietary quaternary amine softener is added to the top side of the multi-ply sanitary tissue product. Approximately 0.5% of a proprietary quaternary amine softener is added to the bottom side of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The molding member used to make the multi-ply sanitary tissue product of this example exhibits the dimensions shown in Table 1 above. The multi-ply sanitary tissue product of this example exhibits the discrete pillow region, knuckle (continuous knuckle) region dimensions shown in Table 4 below as measured according to the Micro-CT Intensive Property Measurement Test Method described herein.

TABLE 4

| Discrete Pillow Region/Knuckle (Continuous Knuckle) Region Dimensions | Bottom Layer Image Measurements | Top Layer Image Measurements | Density Image Measurements |
|---|---|---|---|
| Average Pillow Length (mm) | 5.63 | 5.69 | 5.53 |
| Standard Deviation of the Pillow Length (mm) | 0.10 | 0.08 | 0.14 |
| Relative Standard Deviation of the Pillow Length (%) | 2% | 1% | 3% |
| Maximum Pillow Width (mm) | 0.95 | 0.86 | 0.82 |
| Minimum Pillow Width (mm) | 0.76 | 0.73 | 0.60 |
| Average Pillow Width (mm) | 0.85 | 0.78 | 0.74 |
| Standard Deviation of the Pillow Width (mm) | 0.07 | 0.04 | 0.07 |
| Relative Standard Deviation of the Pillow Width (%) | 8% | 5% | 10% |
| Pillow Perimeter (mm) | 12.95 | 12.95 | 12.54 |
| Maximum Knuckle Width (mm) | 0.33 | 0.30 | 0.31 |
| Minimum Knuckle Width (mm) | 0.25 | 0.18 | 0.16 |
| Average Knuckle Width (mm) | 0.29 | 0.23 | 0.22 |
| Standard Deviation of the Knuckle Width (mm) | 0.03 | 0.04 | 0.04 |
| Relative Standard Deviation of the Knuckle Width (%) | 9% | 16% | 21% |
| Average Pillow Length/Average Pillow Width | 6.65 | 7.26 | 7.46 |
| Average Pillow Length/Maximum Pillow Width | 5.96 | 6.64 | 6.77 |
| Average Pillow Length/Minimum Pillow Width | 7.36 | 7.81 | 9.29 |
| Individual Pillow Perimeter/Maximum Knuckle Width | 38.91 | 43.52 | 40.28 |
| Individual Pillow Perimeter/Minimum Knuckle Width | 52.24 | 72.24 | 80.03 |
| Individual Pillow Perimeter/Average Knuckle Width | 44.20 | 56.71 | 57.73 |
| Average Pillow Length/Average Knuckle Width | 19.21 | 24.92 | 25.45 |
| Average Pillow Length/Maximum Knuckle Width | 16.91 | 19.13 | 17.76 |
| Average Pillow Length/Minimum Knuckle Width | 22.70 | 31.75 | 35.29 |

Example 3

Through-Air-Drying Belt (Continuous Knuckle, Fabric Side Out, 75 Degree Knuckle Orientation Relative to CD)—Lotioned The following Example illustrates a non-limiting example for a preparation of a lotioned sanitary tissue product comprising a fibrous structure according to the present invention on a pilot-scale Fourdrinier fibrous structure making (papermaking) machine.

An aqueous slurry of eucalyptus (Suzano Papel e Celulose Brazilian bleached hardwood kraft pulp) pulp fibers is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top chamber of a multi-layered, three-chambered headbox of a Fourdrinier wet-laid papermaking machine.

Additionally, an aqueous slurry of eucalyptus (Suzano Papel e Celulose Brazilian bleached hardwood kraft pulp) pulp fibers is prepared at about 1.5% fiber by weight using a conventional repulper, then transferred to a hardwood fiber stock chest. The eucalyptus fiber slurry of the hardwood stock chest is pumped through a stock pipe and mixed with the aqueous slurry of Northern Softwood Kraft (NSK), described in the next paragraph, to a fan pump where the slurry consistency is reduced from about 1.5% by fiber weight to about 0.15% by fiber weight. The 0.15% eucalyptus/NSK slurry is then pumped and distributed in the center and bottom chamber of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center and bottom chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.25% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber. The NSK/Eucalyptus fiber slurry is directed to the center and bottom headbox chambers. All three fiber layers are delivered simultaneously in superposed relation onto the Fourdrinier wire to form thereon a three-layer embryonic fibrous structure (web), of which about 45 of the top side is made up of the eucalyptus fibers, about 10% is made of the eucalyptus fibers in the center and bottom layers, and about 45% is made up of the NSK fibers in the center and bottom layers. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 18-22% at the point of transfer, to a 3D patterned, continuous knuckle, through-air-drying belt as shown in FIG. 11. The speed of the 3D patterned through-air-drying belt is 800 feet per minute (fpm), which is the same speed of the Fourdrinier wire. The 3D patterned through-air-drying belt is designed to yield a fibrous structure comprising a pattern of continuous high density knuckle region oriented approximately 75 Degrees relative to the cross direction. Each continuous high density knuckle region oriented approximately 75 Degrees relative to the cross direction is separated by a low density discrete pillow region oriented approximately 75 Degrees relative to the cross direction. This 3D patterned through-air-drying belt is formed by casting a layer of an impervious resin surface of a continuous knuckle onto a fiber mesh supporting fabric. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-44), about 20% CREPETROL® 5688. CREPETROL® 5688 is commercially available from Solenis. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275-350° F. and a speed of about 800 fpm. The fibrous structure is wound in a roll (parent roll) using a surface driven reel drum having a surface speed of about 600-700 fpm.

Two parent rolls of the fibrous structure are then converted into a sanitary tissue product by loading the roll of fibrous structure into an unwind stand. The two parent rolls are converted with the low density pillow side out. The line speed is 550 ft/min. One parent roll of the fibrous structure is unwound, transported, and then combined with the fibrous structure from the other parent roll to make a multi-ply (2-ply) sanitary tissue product. Approximately 0.45% of a proprietary amino-silicone softener is added to the top side of the multi-ply sanitary tissue product. Approximately 0.45% of a proprietary amino-silicone softener is added to the bottom side of the multi-ply sanitary tissue product. Approximately 2.5 lbs./3000 $ft^2$ of a proprietary lotion formulation is added to the top side of the multi-ply sanitary tissue product. Approximately 2.5 lbs./3000 $ft^2$ of a proprietary lotion formulation is added to the bottom side of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The molding member used to make the multi-ply sanitary tissue product of this example exhibits the same dimensions shown in Table 1 above for Example 1.

COMPARATIVE EXAMPLES OF METHODS FOR MAKING COMPARATIVE SANITARY TISSUE PRODUCTS

Comparative Example 1

Through-Air-Drying Belt (Continuous Knuckle, Fabric Side Out, Knuckle Orientation Varies Relative to CD)

The following Example illustrates a non-limiting example for a preparation of a sanitary tissue product comprising a Continuous Knuckle, Fabric Side Out, various angle Knuckle relative to CD fibrous structure according to the Points of Comparison in the Data Table on a full-scale Fourdrinier fibrous structure making (papermaking) machine.

An aqueous slurry of eucalyptus (Suzano Papel e Celulose Brazilian bleached hardwood kraft pulp) pulp fibers is prepared at about 3-6% fiber by weight using a conventional repulper, then transferred to a hardwood fiber stock chest. The eucalyptus fiber slurry of the hardwood stock chest is pumped through a stock pipe to an additional Hardwood stock check and then to a hardwood fan pump where the slurry consistency is reduced from about 3% by fiber weight to about 0.15% by fiber weight. The 0.15% eucalyptus slurry is then pumped and distributed in the Fabric-side chamber and Wire-Side chamber of a multi-layered, three-chambered headbox of a Fourdrinier wet-laid papermaking machine.

Additionally, an aqueous slurry of NSK (Northern Softwood Kraft) pulp fibers is prepared at about 3-6% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is directed to a Mix Tank, where it is mixed with a Broke stream (described in the paragraph below). The refined NSK fiber slurry is directed to a fan pump where the NSK slurry consistency is reduced from about 3% by fiber weight to about 0.15% by fiber weight. The 0.15% NSK slurry is then directed and distributed to the center chamber of a multi-layered, three-chambered headbox of a Fourdrinier wet-laid papermaking machine.

Additionally, an aqueous slurry of a mixture of Eucalyptus and NSK fibers that have been reprocessed from scrap Charmin is prepared at about 3-6% fiber by weight using a conventional repulper, then transferred to a Broke storage chest. The Broke fiber slurry is then directed to a Mix Tank where it is mixed with the refined NSK referenced in the paragraph above. The Broke fiber slurry is directed to a fan pump where the Broke slurry consistency is reduced from about 3% by fiber weight to about 0.15% by fiber weight. The 0.15% Broke slurry is then directed and distributed to the center chamber of a multi-layered three-chambered headbox of a Fourdrinier wet-laid papermaking machine.

In order to impart temporary wet strength to the finished fibrous structure, a 1% dispersion of temporary wet strengthening additive (e.g., Parez® 750C commercially available from Kemira) is prepared and is added to the combined NSK/Broke fiber stock pipe coming out of the Mix Tank referenced in the preceding two paragraphs at a rate sufficient to deliver 0.8%-2.5 temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK fiber and Broke fiber slurry is directed to the center headbox chamber. All three fiber layers are delivered simultaneously in superposed relation onto the Fourdrinier wire to form thereon a three-layer embryonic fibrous structure (web), of which about 20-40% of the sheet is made up of the eucalyptus fibers in the fabric-layer headbox chamber, about 20-40% is made of the NSK fibers in the center layer, and about 20-40% is made up of the Euc fibers in the wire layer. Dewatering occurs through the Fourdrinier wire and is assisted by a deflector and wire table vacuum boxes. The Fourdrinier wire is a 84M (84 by 76 5A, Albany International). The speed of the Fourdrinier wire is about 2800-4000 feet per minute (fpm).

Figure 9C:
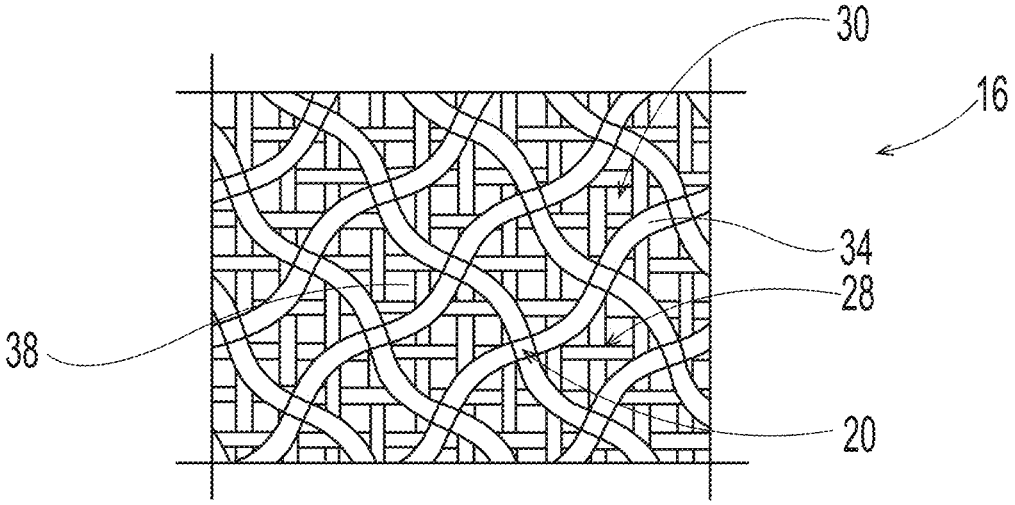
Fig. 9C PRIOR ART
FIG. 9C is a schematic representation of a closeup of a portion of the prior art molding member of FIG. 9B showing the resinous continuous knuckle network, which may lock onto the reinforcing element by a portion of the resin penetrating through the reinforcing element to the backside, and the discrete pillows.

The embryonic wet fibrous structure is transferred from the Fourdrinier wire, at a fiber consistency of about 14-25% at the point of transfer, to a 3D patterned, discrete knuckle, through-air-drying belt as shown in Prior Art FIGS. 9B and 9C. The speed of the 3D patterned through-air-drying belt is 2800-4000 feet per minute (fpm), which is the same speed of the Fourdrinier wire. The 3D patterned through-air-drying belt is designed to yield a fibrous structure as shown in Prior Art FIG. 9A comprising a pattern of continuous high density knuckle regions that vary in their angle relative to the cross direction. Each continuous high density knuckle region that vary in their angle relative to the cross direction is separated by a low density discrete pillow region oriented that vary in their angle relative to the cross direction. This 3D patterned through-air-drying belt is formed by casting a layer of an impervious resin surface of discrete knuckles onto a fiber mesh supporting fabric similar to that shown in Prior Art FIG. 9C. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-70% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 90% polyvinyl alcohol (PVA 88-44), about 10% Crepertrol® 6115. Crepetrol® 6115 is commercially available from Hercules Inc. The creping adhesive is delivered to the Yankee surface at a rate of about 0.10-0.20% adhesive solids based on the dry weight of the fibrous structure. The fiber consistency is increased to about 94-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 2800-4000 fpm. Approximately 1.0% of a proprietary quaternary amine softener is sprayed onto the sheet, therefore being added to both sides of a 2 ply sheet. The fibrous structure is wound in a roll (parent roll) using a surface driven reel drum having a surface speed of about 2200-3400 fpm.

Two parent rolls of the fibrous structure are then converted into a sanitary tissue product by loading the roll of fibrous structure into an unwind stand. The two parent rolls are converted with the low density pillow side out. The line speed is 750-1500 ft/min Both parent roll of the fibrous structure are unwound and transported to a combiner where the fibrous structure is combined with a hot-melt adhesive to make a multi-ply (2-ply) sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The molding member used to make the multi-ply sanitary tissue product of this example exhibits the dimensions shown in Table 1 above.

Comparative Example 2

Through-Air-Drying Belt (Continuous Pillow, Discrete Knuckles, Fabric Side Out, Pillow Orientation 45° Relative to CD)

The following Example illustrates a non-limiting example for a preparation of a sanitary tissue product comprising a fibrous structure according to the present invention on a pilot-scale Fourdrinier fibrous structure making (papermaking) machine.

An aqueous slurry of eucalyptus (Suzano Papel e Celulose Brazilian bleached hardwood kraft pulp) pulp fibers is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet-laid papermaking machine.

Additionally, an aqueous slurry of eucalyptus (Suzano Papel e Celulose Brazilian bleached hardwood kraft pulp) pulp fibers is prepared at about 1.5% fiber by weight using a conventional repulper, then transferred to a hardwood fiber stock chest. The eucalyptus fiber slurry of the hardwood stock chest is pumped through a stock pipe and mixed with the aqueous slurry of Northern Softwood Kraft (NSK), described in the next paragraph, to a fan pump where the slurry consistency is reduced from about 1.5% by fiber weight to about 0.15% by fiber weight. The 0.15% eucalyptus/NSK slurry is then pumped and distributed in the center chamber of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.25% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK/Eucalyptus fiber slurry is directed to the center headbox chamber. All three fiber layers are delivered simultaneously in superposed relation onto the Fourdrinier wire to form thereon a three-layer embryonic fibrous structure (web), of which about 40% of the top side is made up of the eucalyptus fibers, about 15% is made of the eucalyptus fibers on the bottom side, about 40% is made up of the NSK fibers in the center, and about 5% is made up of the eucalyptus fiber in the center. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

Figure 1B:
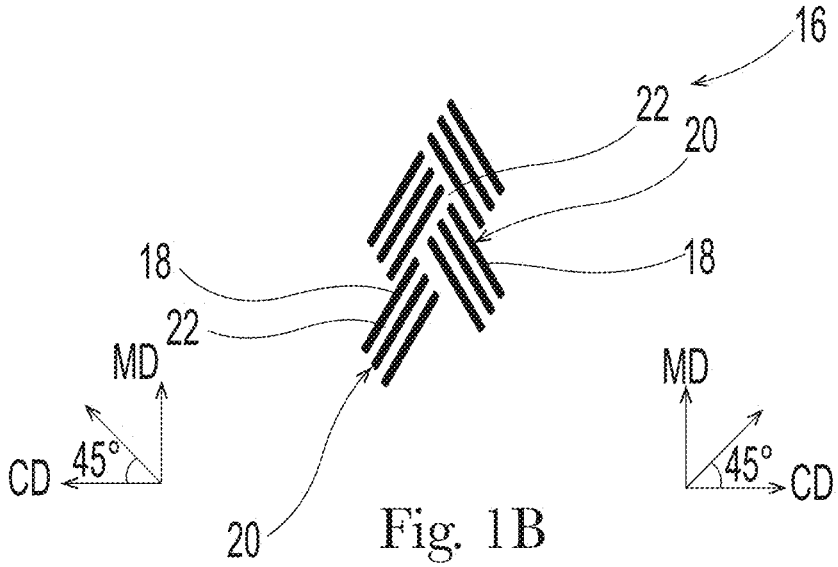
Fig. 1B PRIOR ART
FIG. 1B is a schematic representation of a portion of the pattern of a molding member having a continuous pillow network and a plurality of discrete knuckles used to produce the prior art fibrous structure of FIG. 1A.
Figure 2A:
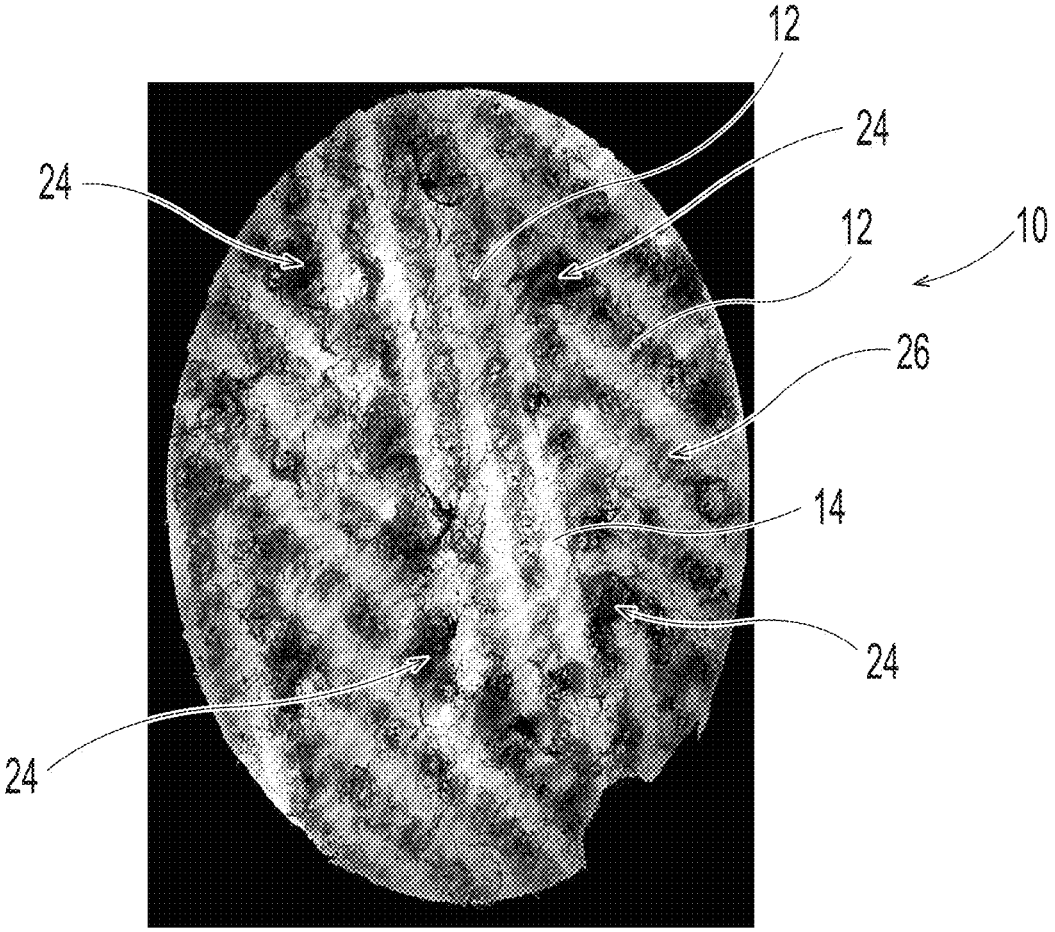
Fig. 2A PRIOR ART
FIG. 2A is a Micro-CT image of a prior art fibrous structure that illustrates nubs present in the prior art fibrous structure having a surface pattern having a continuous pillow region and a plurality of discrete knuckle regions that are oriented at an angle of 75° relative to the CD.
Figure 2B:
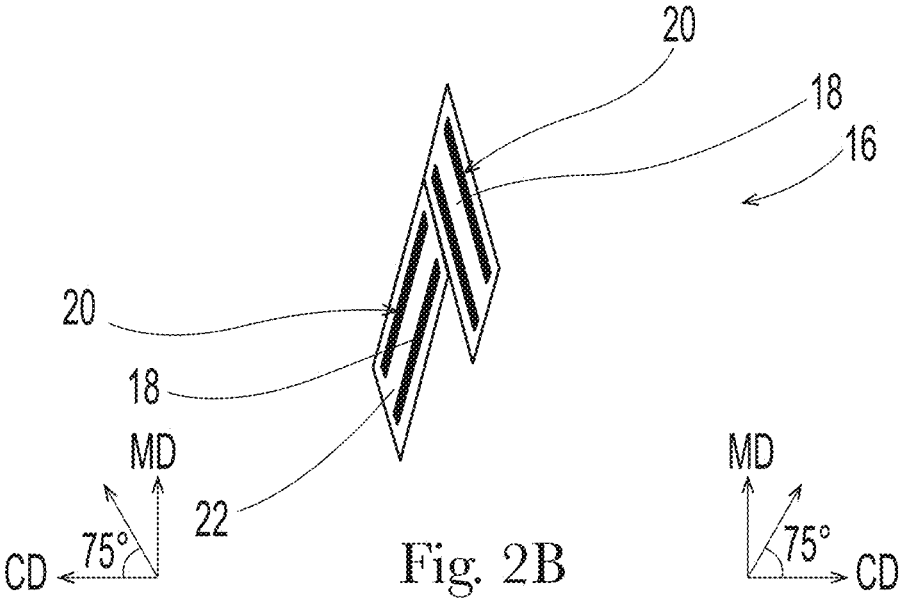
Fig. 2B PRIOR ART
FIG. 2B is a schematic representation of a portion of the pattern of a prior art molding member having a continuous pillow network and a plurality of discrete knuckles used to produce the prior art fibrous structure of FIG. 2A.
Figure 2C:
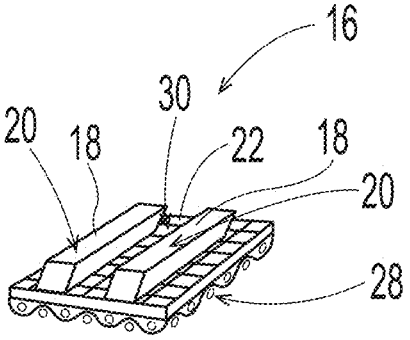
Fig. 2C PRIOR ART
FIG. 2C is a schematic representation of a closeup of a portion of the prior art molding member of FIG. 2B showing the resinous discrete knuckles, which may lock onto the reinforcing element by a portion of the resin penetrating through the reinforcing element to the backside, and the continuous pillow network.
Figure 3:
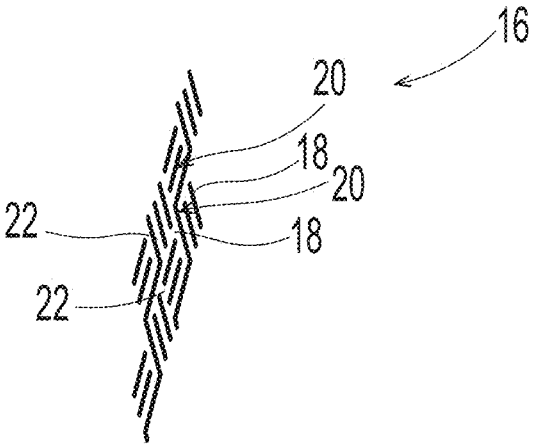
Fig. 3 PRIOR ART
FIG. 3 is a schematic representation of a portion of the pattern of a prior art molding member having a continuous pillow network and a plurality of discrete knuckles used to produce a prior art fibrous structure.

The embryonic wet fibrous structure is transferred from the Fourdrinier wire, at a fiber consistency of about 18-22% at the point of transfer, to a 3D patterned, discrete knuckle, through-air-drying belt as shown in FIG. 1B. The speed of the 3D patterned through-air-drying belt is 800 feet per minute (fpm), which is the same speed of the Fourdrinier wire. The 3D patterned through-air-drying belt is designed to yield a fibrous structure as shown in FIG. 1A comprising a pattern of discrete high density knuckle regions oriented approximately 75 Degrees relative to the cross direction. Each discrete high density knuckle region oriented approximately 75 Degrees relative to the cross direction is separated by a low density continuous pillow region oriented approximately 75 Degrees relative to the cross direction. This 3D patterned through-air-drying belt is formed by casting a layer of an impervious resin surface of discrete knuckles onto a fiber mesh supporting fabric similar to that shown in Prior Art FIG. 9C. The supporting fabric is a 98×52 filament, dual layer fine mesh. The thickness of the resin cast is about 12.5 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 640 fpm.

Two parent rolls of the fibrous structure are then converted into a sanitary tissue product by loading the roll of fibrous structure into an unwind stand. The two parent rolls are converted with the low density pillow side out. The line speed is 550 ft/min One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.75% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The molding member used to make the multi-ply sanitary tissue product of this example exhibits the dimensions shown in Table 1 above.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Emtec Test Method

TS7 and TS750 values are measured using an EMTEC Tissue Softness Analyzer ("Emtec TSA") (Emtec Electronic GmbH, Leipzig, Germany) interfaced with a computer running Emtec TSA software (version 3.19 or equivalent). According to Emtec, the TS7 value correlates with the real material softness, while the TS750 value correlates with the felt smoothness/roughness of the material. The Emtec TSA comprises a rotor with vertical blades which rotate on the test sample at a defined and calibrated rotational speed (set by manufacturer) and contact force of 100 mN. Contact between the vertical blades and the test piece creates vibrations, which create sound that is recorded by a microphone within the instrument. The recorded sound file is then analyzed by the Emtec TSA software. The sample preparation, instrument operation and testing procedures are performed according the instrument manufacture's specifications.

Sample Preparation

Test samples are prepared by cutting square or circular samples from a finished product. Test samples are cut to a length and width (or diameter if circular) of no less than about 90 mm, and no greater than about 120 mm, in any of these dimensions, to ensure the sample can be clamped into the TSA instrument properly. Test samples are selected to avoid perforations, creases or folds within the testing region. Prepare 8 substantially similar replicate samples for testing. Equilibrate all samples at TAPPI standard temperature and relative humidity conditions (23° C.±2° C. and 50%±2%) for at least 1 hour prior to conducting the TSA testing, which is also conducted under TAPPI conditions.

Testing Procedure

Calibrate the instrument according to the manufacturer's instructions using the 1-point calibration method with Emtec reference standards ("ref.2 samples"). If these reference samples are no longer available, use the appropriate reference samples provided by the manufacturer. Calibrate the instrument according to the manufacturer's recommendation and instruction, so that the results will be comparable to those obtained when using the 1-point calibration method with Emtec reference standards ("ref.2 samples").

Mount the test sample into the instrument, and perform the test according to the manufacturer's instructions. When complete, the software displays values for TS7 and TS750. Record each of these values to the nearest 0.01 dB $V^2$ rms. The test piece is then removed from the instrument and discarded. This testing is performed individually on the top surface (outer facing surface of a rolled product) of four of the replicate samples, and on the bottom surface (inner facing surface of a rolled product) of the other four replicate samples.

The four test result values for TS7 and TS750 from the top surface are averaged (using a simple numerical average); the same is done for the four test result values for TS7 and TS750 from the bottom surface. Report the individual average values of TS7 and TS750 for both the top and bottom surfaces on a particular test sample to the nearest 0.01 dB $V^2$ rms. Additionally, average together all eight test value results for TS7 and TS750, and report the overall average values for TS7 and TS750 on a particular test sample to the nearest 0.01 dB $V^2$ rms.

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example,

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Caliper Test Method

Caliper of a fibrous structure and/or sanitary tissue product is measured using a ProGage Thickness Tester (Thwing-Albert Instrument Company, West Berlin, NJ) with a pressure foot diameter of 2.00 inches (area of 3.14 $in^2$) at a pressure of 95 $g/in^2$. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 $g/in^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Density Test Method

The density of a fibrous structure and/or sanitary tissue product is calculated as the quotient of the Basis Weight of a fibrous structure or sanitary tissue product expressed in lbs/3000 $ft^2$ divided by the Caliper (at 95 $g/in^2$) of the fibrous structure or sanitary tissue product expressed in mils. The final Density value is calculated in $lbs/ft^3$ and/or $g/cm^3$, by using the appropriate converting factors.

Micro-CT ("μCT") Intensive Property Measurement Test Method

The micro-CT intensive property measurement method measures the basis weight, thickness, and density values, as well as dimensions, within visually discernable features and regions of a substrate sample. It is based on analysis of a 3D x-ray sample image obtained on a micro-CT instrument (a suitable instrument is the Scanco μCT 50 available from Scanco Medical AG, Switzerland, or equivalent). The micro-CT instrument is a cone beam microtomograph with a shielded cabinet. A maintenance free x-ray tube is used as the source with an adjustable diameter focal spot. The x-ray beam passes through the sample, where some of the x-rays are attenuated by the sample. The extent of attenuation correlates to the mass of material the x-rays have to pass through. The transmitted x-rays continue on to the digital detector array and generate a 2D projection image of the sample. A 3D image of the sample is generated by collecting several individual projection images of the sample as it is rotated, which are then reconstructed into a single 3D image. The instrument is interfaced with a computer running software to control the image acquisition and save the raw data. The 3D image is then analyzed using image analysis software (suitable image analysis software is MATLAB available from The Mathworks, Inc., Natick, MA, or Avizo available from Thermo Fisher Scientific, Waltham, MA, or equivalent) to measure intensive property values, as well as dimensions, of features and regions within the sample.

Sample Preparation:

To obtain a sample for measurement, lay a single layer of the dry substrate material out flat and die cut a circular piece with a diameter of 16 mm. If the sample being measured is a 2 (or more) ply finished product, carefully separate an individual ply of the finished product prior to die cutting. The sample weight is recorded. A sample may be cut from any location containing the region to be analyzed. A region to be analyzed is one where there are visually discernible knuckle regions and pillow regions. Regions within different samples taken from the same substrate material can be analyzed and compared to each other. Care should be taken to avoid folds, wrinkles or tears when selecting a location for sampling.

Image Acquisition:

Set up and calibrate the micro-CT instrument according to the manufacturer's specifications. Place the sample into the appropriate holder, between two rings of low-density material, which have an inner diameter of 12 mm. This will allow the central portion of the sample to lay horizontal and be scanned without having any other materials directly adjacent to its upper and lower surfaces. Measurements should be taken in this region. The 3D image field of view is approximately 20 mm on each side in the xy-plane with a resolution of approximately 3400 by 3400 pixels, and with a sufficient number of 6 micron thick slices collected to fully include the z-direction of the sample. The reconstructed 3D image contains isotropic voxels of 6 microns. Images were acquired with the source at 45 kVp and 133 μA with no additional low energy filter. These current and voltage settings should be optimized to produce the maximum contrast in the projection data with sufficient x-ray penetration through the sample, but once optimized held constant for all substantially similar samples. A total of 1700 projections images are obtained with an integration time of 500 ms and 4 averages. The projection images are reconstructed into the 3D image and saved in 16-bit format to preserve the full detector output signal for analysis.

3D Image Processing:

Load the 3D image into the image analysis software. The largest cross-sectional area of the sample should be nearly parallel with the x-y plane, with the z-axis being perpendicular. Threshold the 3D image at a value which separates, and removes, the background signal due to air, but maintains the signal from the sample fibers within the substrate.

Discontinuous Multi-Shell Dome Feature Dimension Measurements:

Load the thresholded 3D image into the image analysis software and select a vertical cut plane (as shown in FIG. 30E) that allows for virtual cross-sectional images of the sample to be visualized. Advance the vertical cut plane through the sample until a discontinuous multi-shell dome feature of interest is identified. Visually inspect the series of individual cross-sectional images encompassing the identified discontinuous multi-shell dome feature of interest, and select the cross-sectional image containing the portion of dome feature with the greatest amount of separation between shells (see for example FIG. 30D). Manually measure and record the maximum vertical height of separation between the discontinuous dome shells, as well as the maximum horizontal width of the dome feature within the same maximum height cross-sectional image (see for example FIG. 30D). Repeat this procedure for a total of 5-6 replicate dome features and calculate the arithmetic mean of the recorded height and width values. Report these mean values as the maximum height and width to the nearest 1 μm (micron).

Figure 36A:
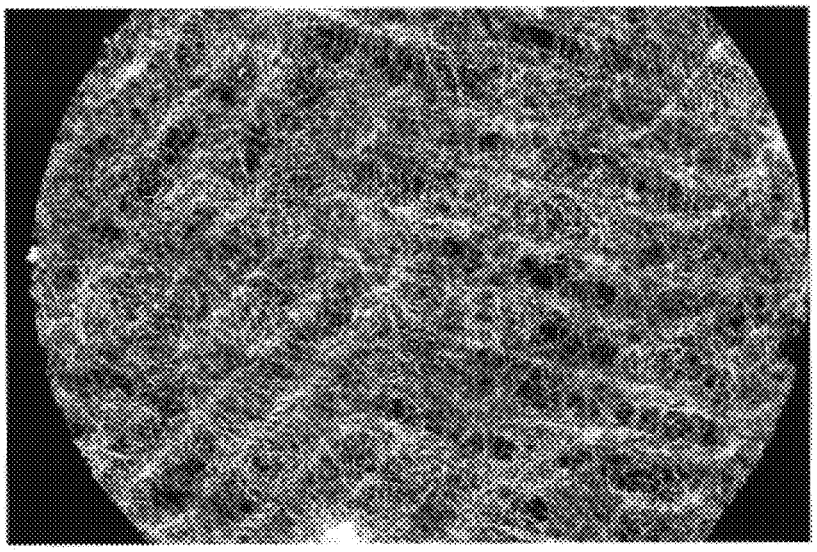
FIG. 36A is a basis weight Micro-CT image of the fibrous structure of the present invention of Example 2.

Intensive Property Images:

Five 2D intensive property images are generated from the thresholded 3D image. The first is the Basis Weight Image (see for example FIG. 36A), which is a projection image. Each x-y pixel in this image represents the summation of the intensity values along voxels in the z-direction. This results in a 2D image where each pixel now has a value equal to the cumulative signal through the entire sample.

The weight of the sample divided by the z-direction projected area of the punched sample provides the actual basis weight of the sample. This value is correlated with the signal intensity of Basis Weight image described above, regressed to the origin, allowing it to be represented in units of grams per square meter (gsm).

Figure 36B:
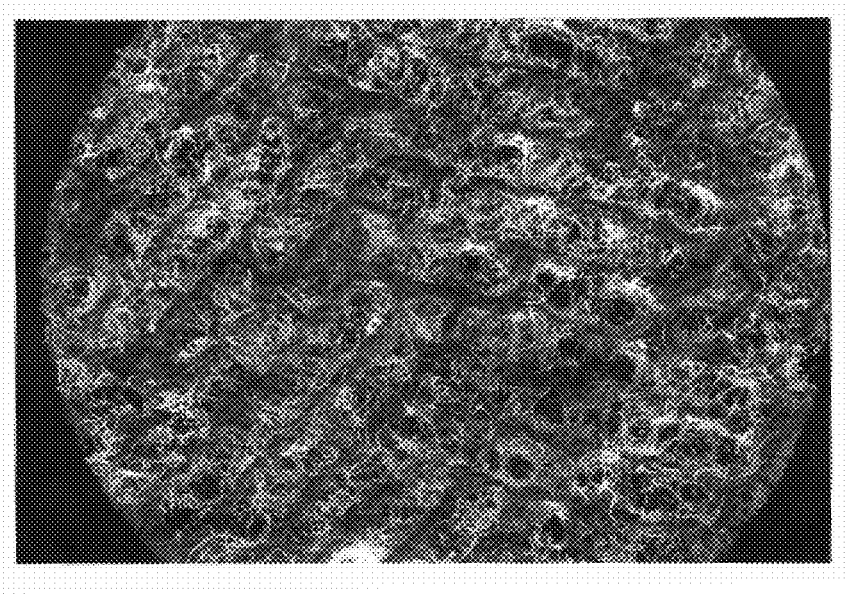
FIG. 36B is a thickness Micro-CT image of the fibrous structure of the present invention of Example 2.

The second intensive property 2D image is the Thickness Image (see for example FIG. 36B). To generate this image the upper and lower surfaces of the sample are identified, and the distance between these surfaces is calculated giving the sample thickness. The upper surface of the sample is identified by starting at the uppermost z-direction slice and evaluating each slice going through the sample to locate the z-direction voxel for all pixel positions in the xy-plane where sample signal was first detected. The same procedure is followed for identifying the lower surface of the sample, except the z-direction voxels located are all the positions in the xy-plane where sample signal was last detected. Once the upper and lower surfaces have been identified they are smoothed with a 15×15 median filter to remove signal from stray fibers. The 2D Thickness Image is then generated by counting the number of voxels that exist between the upper and lower surfaces for each of the pixel positions in the xy-plane. This raw thickness value is then converted to actual distance, in microns, by multiplying the voxel count by the 6 μm slice thickness resolution.

Figure 36C:
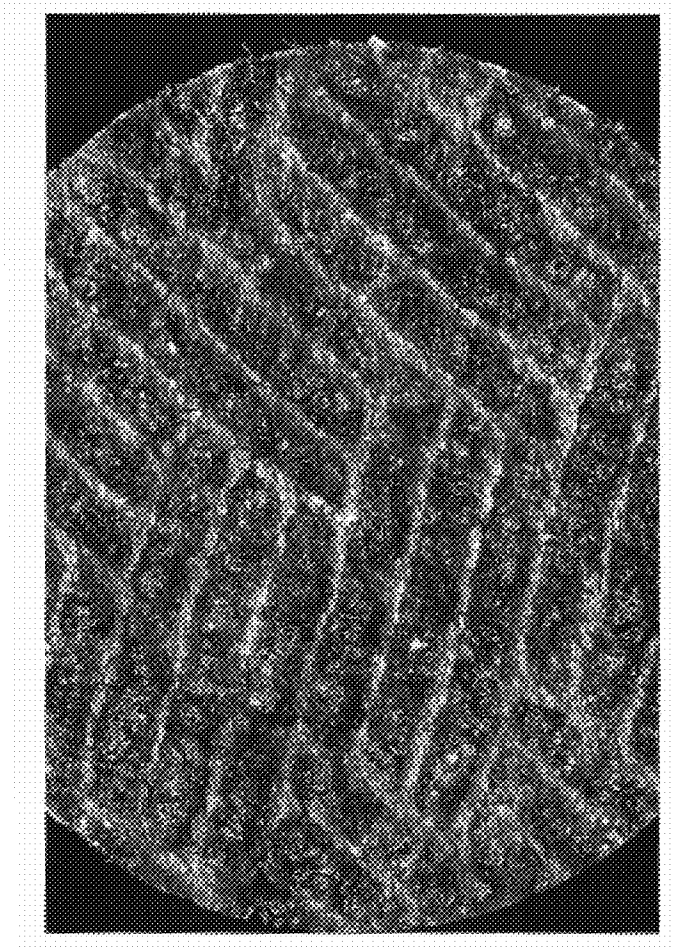
FIG. 36C is a density Micro-CT image of the fibrous structure of the present invention of Example 2.

The third intensive property 2D image is the Density Image (see for example FIG. 36C). To generate this image divide each xy-plane pixel value in the Basis Weight Image, in units of gsm, by the corresponding pixel in the Thickness Image, in units of microns. The units of the Density Image are grams per cubic centimeter (g/cc).

Figure 36D:
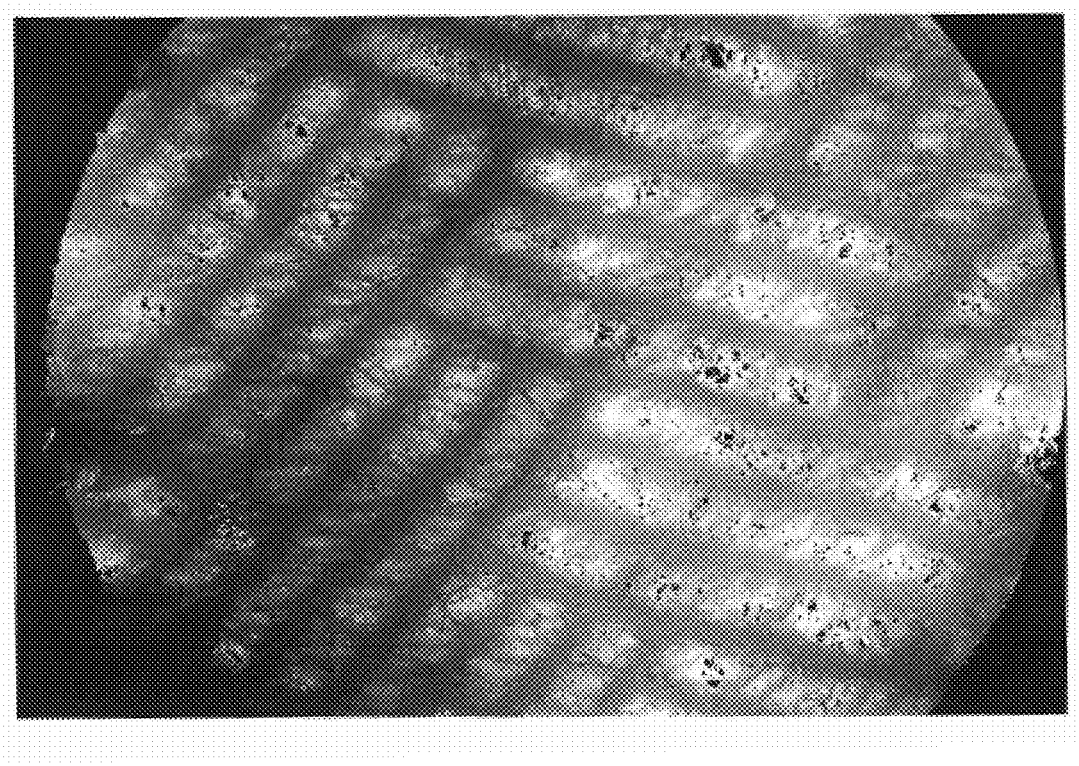
FIG. 36D is a top layer Micro-CT image of the fibrous structure of the present invention of Example 2.
Figure 36E:
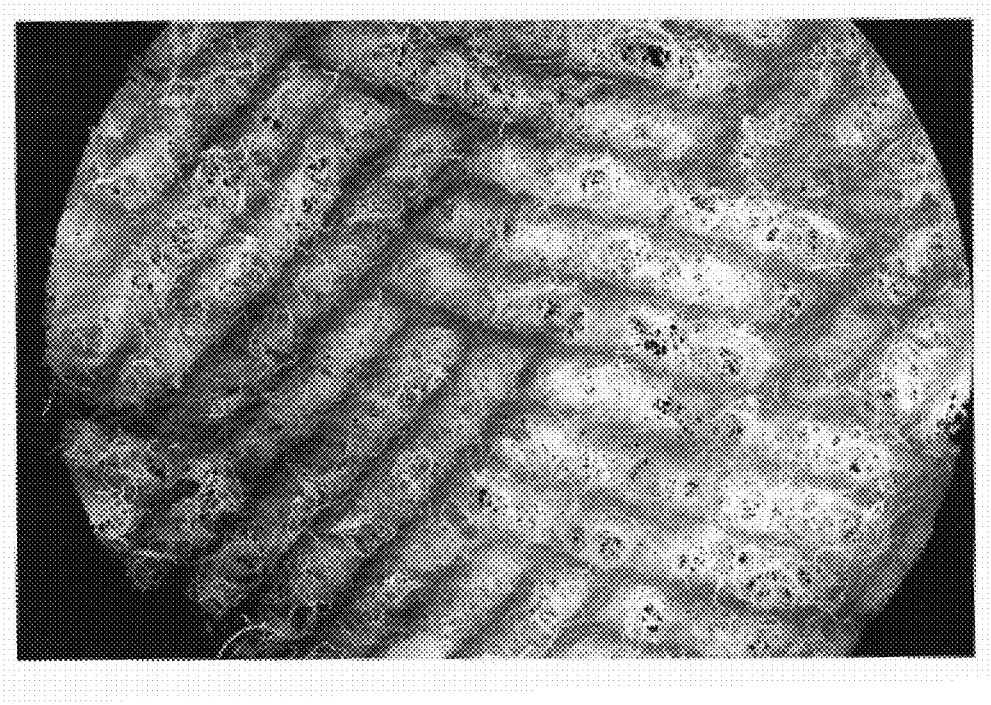
FIG. 36E is a bottom layer Micro-CT image of the fibrous structure of the present invention of Example 2.

For each x-y location, the first and last occurrence of a thresholded voxel position in the z-direction is recorded. This provides two sets of points representing the Top Layer and Bottom Layer of the sample. Each set of points are fit to a second-order polynomial to provide smooth top and bottom surfaces. These surfaces define fourth and fifth 2D intensive property images, the top-layer and bottom-layer of the sample (see for example FIGS. 36D and 36E respectively). These surfaces are saved as images with the gray values of each pixel representing the z-value of the surface point.

Discrete Pillow Region and Knuckle (Continuous Knuckle) Region Dimension Measurements:

As outlined above, five different types of 2D intensive property images are created. These images include: (1) a basis weight image, (2) a thickness image, (3) a density image, (4) a top-layer image, and (5) a bottom-layer image.

To measure discrete pillow and knuckle (continuous in the surface pattern) regions dimensions, begin by identifying the boundary of the selected discrete pillow region or knuckle region, avoid analyzing any discrete pillow or knuckle regions containing embossing. The boundary of a discrete pillow region or knuckle region is identified by visual discernment of differences in intensive properties when compared to other regions within the sample. For example, a discrete pillow region boundary and/or knuckle region boundary can be identified based by visually discerning a density difference when compared to another region in the sample. Any of the intensive properties (basis weight, thickness, density, top-layer, and bottom-layer) can be used to discern discrete pillow region boundaries and/or knuckle region boundaries on either the physical sample itself or any of the micro-CT 2D intensive property images.

Once the boundary of a discrete pillow region has been identified, first locate the major axis (maximum feret diameter) of a discrete pillow region. Second, the major axis should then be measured from one end of the discrete pillow region to the other. Any image-analysis software could be used to measure the discrete pillow region length, as long as the calibration (i.e. number of pixels=a certain length) is known. Third, at least 10 measurements should be made of individual discrete pillow regions to accurately measure the discrete pillow region length. The average discrete pillow region length would be the average of these individual discrete pillow region length measurements, reported to the nearest 0.1 mm. The standard deviation of the discrete pillow region length would be the standard deviation of the individual discrete pillow region length measurements. The relative standard deviation of the discrete pillow region length would be the standard deviation of the discrete pillow region length divided by the average discrete pillow region length multiplied by 100 and reported to the nearest whole percent.

In order to measure discrete pillow region (low-density part of the structure) width, first, one should identify the widest part of the discrete pillow region. Second, a line should be drawn perpendicular to the major axis, identified earlier in the test method, at the identified widest part of the discrete pillow region. Third, the line that was drawn perpendicular to the major axis at the identified widest part of the discrete pillow region should be measured. This measurement would be the maximum discrete pillow region width. Fourth, one should identify the narrowest part of the discrete pillow region. Fifth, a line should be drawn perpendicular to the major axis, identified earlier in the test method, at the identified narrowest part of the discrete pillow region. Sixth, the line that was drawn perpendicular to the major axis at the identified narrowest part of the discrete pillow region should be measured. This measurement would be the minimum discrete pillow region width. Seventh, at least 10 equidistant lines should be drawn perpendicular to the major axis. Eighth, these lines should be measured. The average discrete pillow region width would be the average of the individual discrete pillow region width measurements, reported to the nearest 0.1 mm. The maximum and minimum discrete pillow region widths should be included in that average. The standard deviation of the discrete pillow region width would be the standard deviation of the individual discrete pillow region width measurements. The relative standard deviation of the discrete pillow region width would be the standard deviation of the discrete pillow region width divided by the average discrete pillow region width multiplied by 100 and reported to the nearest whole percent. In addition to the discrete pillow region length and width, the discrete pillow region perimeter and area are also measured and reported.

In order to measure knuckle region (high-density part of the structure) width, one should identify the major axis of the knuckle region. Second, one should identify the widest part of the knuckle region. Third, a line should be drawn perpendicular to the major axis of the knuckle region, at the identified widest part of the knuckle region. Fourth, the line that was drawn perpendicular to the major axis at the identified widest part of the knuckle region should be measured. This measurement would be the maximum knuckle region width. Fifth, one should identify the narrowest part of the knuckle region. Sixth, a line should be drawn perpendicular to the major axis at the identified narrowest part of the knuckle region. Seventh, the line that was drawn perpendicular to the major axis at the identified narrowest part of the knuckle region should be measured. This measurement would be the minimum knuckle region width. Eighth, at least 10 equidistant lines should be drawn perpendicular to the major axis. Ninth, these lines should be measured. The average knuckle region width would be the average of the individual knuckle region width measurements, reported to the nearest 0.1 mm. The maximum and minimum knuckle region widths should be included in that average. The standard deviation of the knuckle region width would be the standard deviation of the individual knuckle region width measurements. The relative standard deviation of the knuckle region width would be the standard deviation of the knuckle region width divided by the average knuckle region width multiplied by 100 and reported to the nearest whole percent.

Micro-CT Basis Weight, Thickness and Density Intensive Properties:

Once the boundary of a region (pillow or knuckle) has been identified draw the largest circular region of interest that can be inscribed within the region. From each of the first three intensive property images calculate the average basis weight, thickness and density within the region of interest. Record these values as the region's micro-CT basis weight to the nearest 0.01 gsm, micro-CT thickness to the nearest 0.1 micron and micro-CT density to the nearest 0.0001 g/cc.

In the interests of brevity and conciseness, any ranges of values set forth in this specification are to be construed as written description support for Claims reciting any sub-ranges having endpoints which are whole number values within the specified range in question. By way of a hypothetical illustrative example, a disclosure in this specification of a range of 1-5 shall be considered to support Claims to any of the following sub-ranges: 1-4; 1-3; 1-2; 2-5; 2-4; 2-3; 3-5; 3-4; and 4-5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a surface comprising a surface pattern, wherein the surface pattern comprises a continuous knuckle region network and a plurality of discrete pillow regions, each having a width, dispersed within the knuckle region network such that the fibrous structure is void of nubs and exhibits a TS7 of less than 5.5 dB $V^2$ rms as measured according to the Emtec Test Method, wherein a repeat unit of the surface pattern is defined by two or more groups of two or more pillow regions dispersed in the knuckle region network, wherein at least two of the two or more groups of pillow regions are non-parallelly juxtaposed;

wherein at least one of the pillow regions exhibits a pillow region perimeter to average knuckle region network width ratio of greater than 21 as measured according to a Micro-CT Intensive Property Measurement Test Method; and wherein a discrete pillow region width exhibits a relative standard deviation of less than 25% as measured according to the Micro CT Intensive Property Measurement Test Method.

2. The fibrous structure according to claim 1 wherein at least two of the two or more pillow regions within one of the two or more groups are parallel to one another.

3. The fibrous structure according to claim 1 wherein at least two of two or more pillow regions within at least two of the two or more groups are oriented at an angle of about 90'.

4. The fibrous structure according to claim 1 wherein the at least two groups of pillow regions are oriented at an angle of greater than 20° to less than 85° to the fibrous structure's cross machine direction.

5. The fibrous structure according to claim 1 wherein at least one of the pillow regions exhibits an average pillow region length of greater than 2 mm as measured according to a Micro-CT Intensive Property Measurement Test Method.

6. The fibrous structure according to claim 1 wherein a plurality of the pillow regions exhibit average pillow region length of greater than 2 mm as measured according to a Micro-CT Intensive Property Measurement Test Method.

7. The fibrous structure according to claim 1 wherein at least one of the pillow regions exhibits an average pillow region length to average pillow region width ratio of at least 1.3 as measured according to a Micro-CT Intensive Property Measurement Test Method.

8. The fibrous structure according to claim 1 wherein at least one of the pillow regions exhibits a pillow region perimeter of greater than 12.7 mm as measured according to a Micro-CT Intensive Property Measurement Test Method.

9. The fibrous structure according to claim 1 wherein at least one of the pillow regions exhibits an average pillow region length to average knuckle region network width ratio of greater than 6.5 as measured according to a Micro-CT Intensive Property Measurement Test Method.

10. The fibrous structure according to claim 1 wherein the fibrous structure comprises a plurality of fibers.

11. The fibrous structure according to claim 10 wherein the plurality of fibers comprise a plurality of pulp fibers.

12. The fibrous structure according to claim 11 wherein the plurality of pulp fibers comprise a plurality of wood pulp fibers.

13. The fibrous structure according to claim 11 wherein the plurality of pulp fibers comprise non-wood pulp fibers.

14. The fibrous structure according to claim 1 wherein the fibrous structure comprises a structured fibrous structure.

15. The fibrous structure according to claim 14 wherein the structured fibrous structure comprises a through-air-dried fibrous structure ply.

16. The fibrous structure according to claim 1 wherein the surface pattern comprises a molded microscopical three-dimensional pattern.

17. A single- or multi-ply sanitary tissue product comprising a fibrous structure according to claim 1.

18. A roll of sanitary tissue product comprising a single- or multi-ply sanitary tissue product according to claim 17.

19. A package comprising one or more rolls of sanitary tissue product according to claim 18.

* * * * *